US008616279B2

(12) United States Patent
Symington et al.

(10) Patent No.: US 8,616,279 B2
(45) Date of Patent: Dec. 31, 2013

(54) WATER TREATMENT FOLLOWING SHALE OIL PRODUCTION BY IN SITU HEATING

(75) Inventors: William A. Symington, Houston, TX (US); Piyush S. Shah, Houston, TX (US); John D Miller, Katy, TX (US); Jesse D Yeakel, Missouri City, TX (US); Ganesh L Ghurye, Pearland, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 377 days.

(21) Appl. No.: 12/683,843

(22) Filed: Jan. 7, 2010

(65) Prior Publication Data

US 2010/0218946 A1 Sep. 2, 2010

Related U.S. Application Data

(60) Provisional application No. 61/154,670, filed on Feb. 23, 2009.

(51) Int. Cl.
*E21B 43/24* (2006.01)

(52) U.S. Cl.
USPC ..... 166/272.1; 166/261; 210/747.1

(58) Field of Classification Search
USPC ..... 166/245, 256, 261, 272.1, 52, 302, 60; 210/498, 747.1
See application file for complete search history.

(56) References Cited

U.S. PATENT DOCUMENTS 363,419 A 5/1887 Poetsch
895,612 A 8/1908 Baker
1,342,780 A 6/1920 Vedder
1,422,204 A 7/1922 Hoover et al.
1,666,488 A 4/1928 Crawshaw
1,701,884 A 2/1929 Hogle
1,872,906 A 8/1932 Doherty (Continued)

FOREIGN PATENT DOCUMENTS

CA 994694 8/1976 ..... 196/14
CA 1288043 8/1991 ..... 166/38

(Continued)

OTHER PUBLICATIONS

Miknis, F.P, et al (1985) "Isothermal Decomposition of Colorado Oil Shale", DOE/FE/60177-2288 (DE87009043) May 1985.

(Continued)

*Primary Examiner* — Shane Bomar
*Assistant Examiner* — Catherine Loikith
(74) *Attorney, Agent, or Firm* — ExxonMobil Upstream Research Company-Law Department

(57) ABSTRACT

A method for treating water at a water treatment facility is provided. In one aspect, the water has been circulated through a subsurface formation in a shale oil development area. The subsurface formation may comprise shale that has been spent due to pyrolysis of formation hydrocarbons. The method in one embodiment includes receiving the water at the water treatment facility, and treating the water at the water treatment facility in order to (i) substantially separate oil from the water, (ii) substantially remove organic materials from the water, (iii) substantially reduce hardness and alkalinity of the water, (iv) substantially remove dissolved inorganic solids from the water, and/or (v) substantially remove suspended solids from the water. The method may further includes delivering the water that has been treated at the water treatment facility re-injecting the treated water into the subsurface formation to continue leaching out contaminants from the spent shale.

29 Claims, 10 Drawing Sheets

(56) References Cited

U.S. PATENT DOCUMENTS

| | | | | |
|---|---|---|---|---|
| 2,033,560 | A | 3/1936 | Wells | 166/1 |
| 2,033,561 | A | 3/1936 | Wells | 166/21 |
| 2,534,737 | A | 12/1950 | Rose | 73/38 |
| 2,584,605 | A | 2/1952 | Merriam et al. | |
| 2,634,961 | A | 4/1953 | Ljungstrom | 262/3 |
| 2,732,195 | A | 1/1956 | Ljungstrom | 262/3 |
| 2,777,679 | A | 1/1957 | Ljungstrom | 262/3 |
| 2,780,450 | A | 2/1957 | Ljungstrom | 262/3 |
| 2,795,279 | A | 6/1957 | Sarapuu | |
| 2,812,160 | A | 11/1957 | West et al. | 255/1.4 |
| 2,813,583 | A | 11/1957 | Marx et al. | |
| 2,847,071 | A | 8/1958 | De Priester | 166/39 |
| 2,887,160 | A | 5/1959 | De Priester et al. | 166/59 |
| 2,895,555 | A | 7/1959 | De Priester | 166/59 |
| 2,923,535 | A | 2/1960 | Ljungstrom | 262/3 |
| 2,944,803 | A | 7/1960 | Hanson | 262/3 |
| 2,952,450 | A | 9/1960 | Purre | 262/3 |
| 2,974,937 | A | 3/1961 | Kiel | |
| 3,004,601 | A | 10/1961 | Bodine | 166/39 |
| 3,013,609 | A | 12/1961 | Brink | 166/39 |
| 3,095,031 | A | 6/1963 | Eurenius et al. | 158/99 |
| 3,106,244 | A | 10/1963 | Parker | |
| 3,109,482 | A | 11/1963 | O'Brien | 158/115 |
| 3,127,936 | A | 4/1964 | Eurenius | 166/39 |
| 3,137,347 | A | 6/1964 | Parker | 166/39 |
| 3,149,672 | A | 9/1964 | Orkiszewski et al. | 166/39 |
| 3,170,815 | A | 2/1965 | White | |
| 3,180,411 | A | 4/1965 | Parker | 166/11 |
| 3,183,675 | A | 5/1965 | Schroeder | 61/36 |
| 3,183,971 | A | 5/1965 | McEver et al. | |
| 3,194,315 | A | 7/1965 | Rogers | 166/57 |
| 3,205,942 | A | 9/1965 | Sandberg | |
| 3,225,829 | A | 12/1965 | Chown et al. | 166/59 |
| 3,228,869 | A | 1/1966 | Irish | |
| 3,241,611 | A | 3/1966 | Dougan | 166/7 |
| 3,241,615 | A | 3/1966 | Brandt et al. | 166/59 |
| 3,254,721 | A | 6/1966 | Smith et al. | 166/59 |
| 3,256,935 | A | 6/1966 | Nabor et al. | 166/9 |
| 3,263,211 | A | 7/1966 | Heidman | |
| 3,267,680 | A | 8/1966 | Schlumberger | 61/36 |
| 3,271,962 | A | 9/1966 | Dahms et al. | 61/36 |
| 3,284,281 | A | 11/1966 | Thomas | 166/2 |
| 3,285,335 | A | 11/1966 | Reistle, Jr. | |
| 3,288,648 | A | 11/1966 | Jones | |
| 3,294,167 | A | 12/1966 | Vogel | 166/11 |
| 3,295,328 | A | 1/1967 | Bishop | 61/0.5 |
| 3,323,840 | A | 6/1967 | Mason et al. | |
| 3,358,756 | A | 12/1967 | Vogel | |
| 3,372,550 | A | 3/1968 | Schroeder | 61/36 |
| 3,376,403 | A | 4/1968 | Mircea | 219/10.49 |
| 3,382,922 | A | 5/1968 | Needham | |
| 3,400,762 | A | 9/1968 | Peacock et al. | 166/11 |
| 3,436,919 | A | 4/1969 | Shock et al. | 61/0.5 |
| 3,439,744 | A | 4/1969 | Bradley | |
| 3,468,376 | A | 9/1969 | Slusser et al. | 166/272 |
| 3,500,913 | A | 3/1970 | Nordgren et al. | 166/259 |
| 3,501,201 | A | 3/1970 | Closmann et al. | 299/4 |
| 3,502,372 | A | 3/1970 | Prats | 299/5 |
| 3,513,914 | A | 5/1970 | Vogel | 166/271 |
| 3,515,213 | A | 6/1970 | Prats | |
| 3,516,495 | A | 6/1970 | Patton | |
| 3,521,709 | A | 7/1970 | Needham | |
| 3,528,252 | A | 9/1970 | Gail | 61/36 |
| 3,528,501 | A | 9/1970 | Parker | |
| 3,547,193 | A | 12/1970 | Gill | |
| 3,559,737 | A | 2/1971 | Ralstin et al. | 166/281 |
| 3,572,838 | A | 3/1971 | Templeton | |
| 3,599,714 | A | 8/1971 | Messman et al. | 166/258 |
| 3,602,310 | A | 8/1971 | Halbert | 166/303 |
| 3,613,785 | A | 10/1971 | Closmann et al. | 166/271 |
| 3,620,300 | A | 11/1971 | Crowson | 166/248 |
| 3,642,066 | A | 2/1972 | Gill | 166/248 |
| 3,661,423 | A | 5/1972 | Garret | |
| 3,692,111 | A | 9/1972 | Breithaupt et al. | 166/252 |
| 3,695,354 | A | 10/1972 | Dilgren et al. | |
| 3,700,280 | A | 10/1972 | Papadopoulos et al. | 299/5 |
| 3,724,225 | A | 4/1973 | Mancini et al. | 62/12 |
| 3,729,965 | A | 5/1973 | Gartner | 70/395 |
| 3,730,270 | A | 5/1973 | Allred | |
| 3,739,851 | A | 6/1973 | Beard | 166/254 |
| 3,741,306 | A | 6/1973 | Papadopoulos | 166/252 |
| 3,759,328 | A | 9/1973 | Ueber et al. | 166/303 |
| 3,759,329 | A | 9/1973 | Ross | 166/308.1 |
| 3,759,574 | A | 9/1973 | Beard | 299/4 |
| 3,779,601 | A | 12/1973 | Beard | |
| 3,880,238 | A | 4/1975 | Tham et al. | |
| 3,882,937 | A | 5/1975 | Robinson | 166/267 |
| 3,882,941 | A | 5/1975 | Pelofsky | |
| 3,888,307 | A | 6/1975 | Closmann | |
| 3,924,680 | A | 12/1975 | Terry | |
| 3,943,722 | A | 3/1976 | Ross | 61/36 |
| 3,950,029 | A | 4/1976 | Timmins | 299/2 |
| 3,958,636 | A | 5/1976 | Perkins | |
| 3,967,853 | A | 7/1976 | Closmann et al. | |
| 3,978,920 | A | 9/1976 | Badyopadhyay | 166/258 |
| 3,999,607 | A | 12/1976 | Pennington et al. | |
| 4,003,432 | A | 1/1977 | Paull et al. | 166/271 |
| 4,005,750 | A | 2/1977 | Shuck | 166/308 |
| 4,007,786 | A | 2/1977 | Schlinger | |
| 4,008,762 | A | 2/1977 | Fisher et al. | |
| 4,008,769 | A | 2/1977 | Chang | |
| 4,014,575 | A | 3/1977 | French et al. | |
| 4,030,549 | A | 6/1977 | Bouck | 166/280 |
| 4,037,655 | A | 7/1977 | Carpenter | |
| 4,043,393 | A | 8/1977 | Fisher et al. | |
| 4,047,760 | A | 9/1977 | Ridley | |
| 4,057,510 | A | 11/1977 | Crouch et al. | |
| 4,065,183 | A | 12/1977 | Hill et al. | 229/4 |
| 4,067,390 | A | 1/1978 | Camacho et al. | 166/302 |
| 4,069,868 | A | 1/1978 | Terry | |
| 4,071,278 | A | 1/1978 | Carpenter et al. | 299/5 |
| 4,093,025 | A | 6/1978 | Terry | |
| 4,096,034 | A | 6/1978 | Anthony | 176/87 |
| 4,125,159 | A | 11/1978 | Vann | 166/285 |
| 4,140,180 | A | 2/1979 | Bridges et al. | 166/248 |
| 4,149,595 | A | 4/1979 | Cha | |
| 4,160,479 | A | 7/1979 | Richardson et al. | |
| 4,163,475 | A | 8/1979 | Cha et al. | |
| 4,167,291 | A | 9/1979 | Ridley | |
| 4,169,506 | A | 10/1979 | Berry | |
| 4,185,693 | A | 1/1980 | Crumb et al. | |
| 4,186,801 | A | 2/1980 | Madgavkar et al. | |
| 4,202,168 | A | 5/1980 | Acheson et al. | |
| 4,239,283 | A | 12/1980 | Ridley | 299/2 |
| 4,246,966 | A | 1/1981 | Stoddard et al. | |
| 4,250,230 | A | 2/1981 | Terry | |
| 4,265,310 | A | 5/1981 | Britton et al. | 166/259 |
| 4,271,905 | A | 6/1981 | Redford et al. | |
| 4,272,127 | A | 6/1981 | Hutchins | 299/2 |
| 4,285,401 | A | 8/1981 | Erickson | |
| 4,318,723 | A | 3/1982 | Holmes et al. | |
| 4,319,635 | A | 3/1982 | Jones | 166/263 |
| 4,320,801 | A | 3/1982 | Rowland et al. | 166/248 |
| 4,324,291 | A | 4/1982 | Wong et al. | |
| 4,340,934 | A | 7/1982 | Segesman | |
| 4,344,485 | A | 8/1982 | Butler | |
| 4,358,222 | A | 11/1982 | Landau | 405/130 |
| 4,362,213 | A | 12/1982 | Tabor | |
| 4,368,921 | A | 1/1983 | Hutchins | 299/2 |
| 4,369,842 | A | 1/1983 | Cha | 166/251 |
| 4,372,615 | A | 2/1983 | Ricketts | 299/2 |
| 4,375,302 | A | 3/1983 | Kalmar | 299/4 |
| 4,384,614 | A | 5/1983 | Justheim | |
| 4,397,502 | A | 8/1983 | Hines | 299/2 |
| 4,401,162 | A | 8/1983 | Osborne | 166/248 |
| 4,412,585 | A | 11/1983 | Bouck | 166/248 |
| 4,417,449 | A | 11/1983 | Hegarty et al. | |
| 4,468,376 | A | 8/1984 | Suggitt | |
| 4,472,935 | A | 9/1984 | Acheson et al. | |
| 4,473,114 | A | 9/1984 | Bell et al. | |
| 4,474,238 | A | 10/1984 | Gentry et al. | 166/268 |
| 4,483,398 | A | 11/1984 | Peters et al. | |
| 4,485,869 | A | 12/1984 | Sresty et al. | 166/248 |
| 4,487,257 | A | 12/1984 | Dauphine | 166/60 |

(56) References Cited

U.S. PATENT DOCUMENTS 4,487,260 A 12/1984 Pittman et al. ..... 166/259
4,495,056 A * 1/1985 Venardos et al. ..... 208/425
4,511,382 A 4/1985 Valencia et al. ..... 62/20
4,532,991 A * 8/1985 Hoekstra et al. ..... 166/261
4,533,372 A 8/1985 Valencia et al. ..... 62/12
4,537,067 A 8/1985 Sharp et al. ..... 73/151
4,545,435 A 10/1985 Bridges et al.
4,546,829 A 10/1985 Martin et al.
4,550,779 A 11/1985 Zakiewicz ..... 166/248
4,552,214 A * 11/1985 Forgac et al. ..... 166/259
4,567,945 A 2/1986 Segalman ..... 166/248
4,585,063 A * 4/1986 Venardos et al. ..... 166/259
4,589,491 A 5/1986 Perkins ..... 166/302
4,589,973 A 5/1986 Minden
4,602,144 A 7/1986 Vogel
4,607,488 A 8/1986 Karinthi et al. ..... 62/45
4,626,665 A 12/1986 Fort ..... 219/534
4,633,948 A 1/1987 Closmann
4,634,315 A 1/1987 Owen et al. ..... 405/217
4,637,464 A * 1/1987 Forgac et al. ..... 106/261
4,640,352 A 2/1987 Vanmeurs et al. ..... 166/245
4,671,863 A 6/1987 Tejeda ..... 204/266
4,694,907 A 9/1987 Stahl et al. ..... 166/303
4,704,514 A 11/1987 Van Egmond et al. ..... 219/278
4,705,108 A 11/1987 Little et al. ..... 166/248
4,706,751 A 11/1987 Gondouin
4,730,671 A 3/1988 Perkins
4,737,267 A 4/1988 Pao et al.
4,747,642 A 5/1988 Gash et al. ..... 299/11
4,754,808 A 7/1988 Harmon et al. ..... 166/254
4,776,638 A 10/1988 Hahn
4,779,680 A 10/1988 Sydansk
4,815,790 A 3/1989 Rosar et al. ..... 299/4
4,817,711 A 4/1989 Jeambey
4,828,031 A 5/1989 Davis
4,860,544 A 8/1989 Krieg et al. ..... 62/45
4,886,118 A 12/1989 Van Meurs et al. ..... 166/245
4,923,493 A 5/1990 Valencia et al. ..... 62/13
4,926,941 A 5/1990 Glandt et al. ..... 166/248
4,928,765 A 5/1990 Nielson
4,929,341 A 5/1990 Thirumalachar et al.
4,974,425 A 12/1990 Krieg et al. ..... 62/45.1
5,016,709 A 5/1991 Combe et al. ..... 166/245
5,036,918 A 8/1991 Jennings et al.
5,050,386 A 9/1991 Krieg et al. ..... 62/45.1
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al. ..... 62/12
5,217,076 A 6/1993 Masek
5,236,039 A 8/1993 Edelstein
5,255,742 A 10/1993 Mikus ..... 166/303
5,275,063 A 1/1994 Steiger et al. ..... 73/865
5,297,420 A 3/1994 Gilliland
5,297,626 A 3/1994 Vinegar et al. ..... 166/271
5,305,829 A 4/1994 Kumar ..... 166/245
5,372,708 A 12/1994 Gewertz
5,377,756 A 1/1995 Northrop et al.
5,392,854 A 2/1995 Vinegar et al. ..... 166/271
5,411,089 A 5/1995 Vinegar et al. ..... 166/272
5,416,257 A 5/1995 Peters ..... 588/1
5,620,049 A 4/1997 Gipson et al. ..... 166/248
5,621,844 A 4/1997 Bridges
5,661,977 A 9/1997 Shnell
5,730,550 A 3/1998 Andersland et al. ..... 405/128
5,838,634 A 11/1998 Jones et al.
5,844,799 A 12/1998 Joseph et al.
5,868,202 A 2/1999 Hsu
5,899,269 A 5/1999 Wellington et al. ..... 166/58
5,905,657 A 5/1999 Celniker
5,907,662 A 5/1999 Buettner
5,956,971 A 9/1999 Cole et al. ..... 62/623
6,015,015 A 1/2000 Luft et al.
6,016,867 A 1/2000 Gregoli et al.
6,023,554 A 2/2000 Vinegar et al. ..... 392/301
6,055,803 A 5/2000 Mastronarde et al.
6,056,057 A 5/2000 Vinegar et al.
6,079,499 A 6/2000 Mikus et al.
6,148,911 A 11/2000 Gipson et al. ..... 166/248
6,158,517 A 12/2000 Hsu
6,246,963 B1 6/2001 Cross et al.
6,247,358 B1 6/2001 Dos Santos ..... 73/152.11
6,328,104 B1 12/2001 Graue
6,434,435 B1 8/2002 Tubel et al.
6,434,436 B1 8/2002 Tubel et al.
6,480,790 B1 11/2002 Calvert et al.
6,540,018 B1 4/2003 Vinegar et al.
6,581,684 B2 6/2003 Wellington et al. ..... 166/245
6,585,046 B2 7/2003 Neuroth et al.
6,589,303 B1 7/2003 Lokhandwala et al.
6,591,906 B2 7/2003 Wellington et al.
6,607,036 B2 8/2003 Ranson et al. ..... 166/302
6,609,761 B1 8/2003 Ramey et al. ..... 299/5
6,668,922 B2 12/2003 Ziauddin et al.
6,684,644 B2 2/2004 Mittricker et al. ..... 60/772
6,684,948 B1 2/2004 Savage
6,708,758 B2 3/2004 de Rouffignac et al. ..... 166/245
6,709,573 B2 3/2004 Smith
6,712,136 B2 3/2004 de Rouffignac et al. ..... 166/245
6,715,546 B2 4/2004 Vinegar et al. ..... 166/245
6,722,429 B2 4/2004 de Rouffignac et al. ..... 166/245
6,742,588 B2 6/2004 Wellington et al. ..... 166/245
6,745,831 B2 6/2004 De Rouffignac et al.
6,745,832 B2 6/2004 Wellington et al. ..... 166/245
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al. ..... 166/245
6,796,139 B2 9/2004 Briley et al. ..... 62/260
6,820,689 B2 11/2004 Sarada
6,832,485 B2 12/2004 Sugarmen et al.
6,854,929 B2 2/2005 Vinegar et al. ..... 405/129.65
6,858,049 B2 2/2005 Mittricker ..... 48/127.7
6,877,555 B2 4/2005 Karanikas et al.
6,880,633 B2 4/2005 Wellington et al. ..... 166/245
6,887,369 B2 5/2005 Moulton et al. ..... 208/107
6,896,053 B2 5/2005 Berchenko et al. ..... 166/245
6,896,707 B2 5/2005 O'Rear et al.
6,913,078 B2 7/2005 Shahin et al. ..... 166/245
6,918,444 B2 7/2005 Passey et al. ..... 166/258
6,923,155 B2 8/2005 Gottemoller et al.
6,923,258 B2 8/2005 Wellington et al. ..... 166/245
6,932,155 B2 8/2005 Vinegar et al. ..... 166/245
6,948,562 B2 9/2005 Wellington et al. ..... 166/272.1
6,951,247 B2 10/2005 De Rouffignac et al.
6,953,087 B2 10/2005 de Rouffignac et al. ..... 166/245
6,964,300 B2 11/2005 Vinegar et al. ..... 166/245
6,969,123 B2 11/2005 Vinegar et al. ..... 299/3
6,988,549 B1 1/2006 Babcock
6,994,160 B2 2/2006 Wellington et al.
6,997,518 B2 2/2006 Vinegar et al. ..... 299/5
7,001,519 B2 2/2006 Linden et al. ..... 210/602
7,004,247 B2 2/2006 Cole et al. ..... 166/242.1
7,004,251 B2 2/2006 Ward et al.
7,011,154 B2 3/2006 Maher et al. ..... 166/245
7,028,543 B2 4/2006 Hardage et al.
7,032,660 B2 4/2006 Vinegar et al. ..... 166/245
7,036,583 B2 5/2006 de Rouffignac et al. ..... 166/245
7,048,051 B2 5/2006 McQueen
7,051,807 B2 5/2006 Vinegar et al.
7,055,600 B2 6/2006 Messier et al.
7,063,145 B2 6/2006 Veenstra et al.
7,066,254 B2 6/2006 Vinegar et al. ..... 166/245
7,073,578 B2 7/2006 Vinegar et al. ..... 166/245
7,077,198 B2 7/2006 Vinegar et al. ..... 166/245
7,077,199 B2 7/2006 Vinegar et al. ..... 166/250.1
7,093,655 B2 8/2006 Atkinson ..... 166/266
7,096,942 B1 8/2006 de Rouffignac et al. ..... 166/245
7,096,953 B2 8/2006 de Rouffignac et al. ..... 166/302
7,100,994 B2 9/2006 Vinegar et al. ..... 299/7
7,104,319 B2 9/2006 Vinegar et al. ..... 166/245
7,121,342 B2 10/2006 Vinegar et al. ..... 166/302

(56) References Cited

U.S. PATENT DOCUMENTS

| | | | | |
|---|---|---|---|---|
| 7,124,029 | B2 | 10/2006 | Jammes et al. | |
| 7,165,615 | B2 | 1/2007 | Vinegar et al. | |
| 7,181,380 | B2 | 2/2007 | Dusterhoft et al. | |
| 7,198,107 | B2 | 4/2007 | Maguire | |
| 7,219,734 | B2 | 5/2007 | Bai et al. | |
| 7,225,866 | B2 | 6/2007 | Berchenko et al. | 166/245 |
| 7,243,618 | B2 | 7/2007 | Gurevich | |
| 7,322,415 | B2 | 1/2008 | de St. Remey | |
| 7,331,385 | B2 | 2/2008 | Symington et al. | 166/248 |
| 7,353,872 | B2 | 4/2008 | Sandberg | 166/249 |
| 7,357,180 | B2 | 4/2008 | Vinegar et al. | 166/254.1 |
| 7,441,603 | B2 | 10/2008 | Kaminsky et al. | 166/308.1 |
| 7,461,691 | B2 | 12/2008 | Vinegar et al. | |
| 7,484,561 | B2 | 2/2009 | Bridges | |
| 7,516,785 | B2 | 4/2009 | Kaminsky | 166/245 |
| 7,516,786 | B2 | 4/2009 | Dallas et al. | |
| 7,516,787 | B2 | 4/2009 | Kaminsky | 166/250.1 |
| 7,546,873 | B2 | 6/2009 | Kim et al. | |
| 7,549,470 | B2 | 6/2009 | Vinegar et al. | 166/245 |
| 7,556,095 | B2 | 7/2009 | Vinegar | 166/302 |
| 7,617,869 | B2 | 11/2009 | Carney | |
| 7,631,691 | B2 | 12/2009 | Symington et al. | |
| 7,644,993 | B2 | 1/2010 | Kaminsky et al. | |
| 7,647,971 | B2 | 1/2010 | Kaminsky | |
| 7,647,972 | B2 | 1/2010 | Kaminsky | |
| 7,654,320 | B2 | 2/2010 | Payton | |
| 7,669,657 | B2 | 3/2010 | Symington et al. | |
| 7,743,826 | B2 | 6/2010 | Harris et al. | |
| 7,798,221 | B2 | 9/2010 | Vinegar et al. | |
| 7,857,056 | B2 | 12/2010 | Kaminsky et al. | |
| 7,860,377 | B2 | 12/2010 | Vinegar et al. | |
| 7,905,288 | B2 | 3/2011 | Kinkead | |
| 2001/0049342 | A1 | 12/2001 | Passey et al. | |
| 2002/0013687 | A1 | 1/2002 | Ortoleva | |
| 2002/0023751 | A1 | 2/2002 | Neuroth et al. | |
| 2002/0029882 | A1 | 3/2002 | Rouffignac et al. | |
| 2002/0049360 | A1 | 4/2002 | Wellington et al. | |
| 2002/0077515 | A1 | 6/2002 | Wellington et al. | |
| 2002/0099504 | A1 | 7/2002 | Cross et al. | |
| 2003/0080604 | A1 | 5/2003 | Vinegar et al. | |
| 2003/0085570 | A1 | 5/2003 | Ernst et al. | |
| 2003/0111223 | A1 | 6/2003 | Rouffignac et al. | |
| 2003/0131994 | A1 | 7/2003 | Vinegar et al. | |
| 2003/0131995 | A1 | 7/2003 | de Rouffignac et al. | |
| 2003/0178195 | A1 | 9/2003 | Agee et al. | |
| 2003/0183390 | A1 | 10/2003 | Veenstra et al. | |
| 2003/0192691 | A1 | 10/2003 | Vinegar et al. | |
| 2003/0196788 | A1 | 10/2003 | Vinegar et al. | |
| 2003/0196789 | A1 | 10/2003 | Wellington | |
| 2003/0209348 | A1 | 11/2003 | Ward et al. | |
| 2003/0213594 | A1 | 11/2003 | Wellington et al. | |
| 2004/0020642 | A1 | 2/2004 | Vinegar et al. | |
| 2004/0120772 | A1* | 6/2004 | Vinegar et al. | 405/128.85 |
| 2004/0140095 | A1 | 7/2004 | Vinegar et al. | |
| 2004/0198611 | A1 | 10/2004 | Atkinson | |
| 2004/0200618 | A1 | 10/2004 | Piekenbrock | |
| 2004/0211557 | A1 | 10/2004 | Cole et al. | |
| 2005/0051327 | A1 | 3/2005 | Vinegar et al. | |
| 2005/0252656 | A1 | 11/2005 | Maguire | |
| 2005/0252832 | A1 | 11/2005 | Doyle et al. | |
| 2005/0252833 | A1 | 11/2005 | Doyle et al. | |
| 2005/0269077 | A1 | 12/2005 | Sandberg | 166/249 |
| 2005/0269088 | A1 | 12/2005 | Vinegar et al. | |
| 2006/0021752 | A1 | 2/2006 | de St. Remey | |
| 2006/0100837 | A1 | 5/2006 | Symington et al. | |
| 2006/0213657 | A1 | 9/2006 | Berchenko et al. | |
| 2007/0000662 | A1 | 1/2007 | Symington et al. | |
| 2007/0023186 | A1 | 2/2007 | Kaminsky et al. | |
| 2007/0045265 | A1 | 3/2007 | McKinzie, II | 219/207 |
| 2007/0045267 | A1 | 3/2007 | Vinegar et al. | |
| 2007/0084418 | A1 | 4/2007 | Gurevich | |
| 2007/0095537 | A1 | 5/2007 | Vinegar | |
| 2007/0102359 | A1 | 5/2007 | Lombardi et al. | 210/639 |
| 2007/0131415 | A1 | 6/2007 | Vinegar et al. | |
| 2007/0137869 | A1 | 6/2007 | MacDougall et al. | |
| 2007/0144732 | A1 | 6/2007 | Kim et al. | 166/245 |
| 2007/0209799 | A1 | 9/2007 | Vinegar et al. | 166/302 |
| 2007/0246994 | A1 | 10/2007 | Symington et al. | 299/3 |
| 2008/0087420 | A1 | 4/2008 | Symington et al. | 166/245 |
| 2008/0087421 | A1 | 4/2008 | Kaminsky | 166/245 |
| 2008/0087426 | A1 | 4/2008 | Kaminsky | 166/271 |
| 2008/0087427 | A1 | 4/2008 | Symington et al. | 166/272.1 |
| 2008/0087428 | A1 | 4/2008 | Symington et al. | 166/272.2 |
| 2008/0127632 | A1 | 6/2008 | Finkenrath | |
| 2008/0173443 | A1 | 7/2008 | Symington et al. | 166/248 |
| 2008/0185145 | A1 | 8/2008 | Carney et al. | |
| 2008/0207970 | A1 | 8/2008 | Meurer et al. | 484/24 |
| 2008/0230219 | A1 | 9/2008 | Kaminsky | 166/248 |
| 2008/0271885 | A1 | 11/2008 | Kaminsky | 166/245 |
| 2008/0283241 | A1 | 11/2008 | Kaminsky et al. | 166/245 |
| 2008/0289819 | A1 | 11/2008 | Kaminsky et al. | 166/256 |
| 2008/0290719 | A1 | 11/2008 | Symington et al. | 299/3 |
| 2009/0038795 | A1 | 2/2009 | Kaminsky et al. | |
| 2009/0050319 | A1 | 2/2009 | Kaminsky et al. | 166/257 |
| 2009/0101346 | A1 | 4/2009 | Vinegar et al. | |
| 2009/0101348 | A1 | 4/2009 | Kaminsky | |
| 2009/0107679 | A1 | 4/2009 | Kaminsky | |
| 2009/0133935 | A1 | 5/2009 | Kinkead | |
| 2009/0145598 | A1 | 6/2009 | Symington et al. | |
| 2009/0308608 | A1* | 12/2009 | Kaminsky et al. | 166/272.1 |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Symington et al. | |
| 2010/0101793 | A1 | 4/2010 | Symington et al. | |
| 2010/0133143 | A1 | 6/2010 | Roes et al. | |
| 2010/0218946 | A1 | 9/2010 | Symington et al. | |
| 2010/0282460 | A1 | 11/2010 | Stone et al. | |
| 2010/0319909 | A1 | 12/2010 | Symington et al. | |
| 2011/0000221 | A1 | 1/2011 | Minta et al. | |
| 2011/0000671 | A1 | 1/2011 | Hershkowitz | |

FOREIGN PATENT DOCUMENTS

| | | | |
|---|---|---|---|
| CA | 2560223 | 3/2007 | |
| EP | 0387846 | 9/1990 | |
| EP | 0866212 | 9/1998 | |
| GB | 855408 | 11/1960 | 68/85 |
| GB | 1454324 | 11/1976 | |
| GB | 1463444 | 2/1977 | |
| GB | 1 478 880 | 7/1977 | |
| GB | 1501310 | 2/1978 | |
| GB | 1559948 | 1/1980 | |
| GB | 1595082 | 8/1981 | |
| WO | WO 82/01408 | 4/1982 | |
| WO | WO 90/06480 | 6/1990 | |
| WO | WO 99/67504 | 12/1999 | |
| WO | WO 01/78914 | 10/2001 | |
| WO | WO 01/81505 | 11/2001 | |
| WO | WO 02/085821 | 10/2002 | |
| WO | WO 2005/010320 | 2/2005 | |
| WO | WO 2005/045192 | 5/2005 | |
| WO | WO 2006/115943 | 11/2006 | |
| WO | WO 2007/033371 | 3/2007 | |
| WO | WO 2007/050445 | 5/2007 | |
| WO | WO 2007/050479 | 5/2007 | |
| WO | WO 2010/047859 | 4/2010 | |
| WO | WO2011/116148 | 9/2011 | |

OTHER PUBLICATIONS

Motzfeldt, K. (1954) "The Thermal Decomposition of Sodium Carbonate by the Effusion Method," *Jrnl. Phys. Chem.*, v. LIX, pp. 139-147.

Mut, Stephen (2005) "The Potential of Oil Shale," *Shell Oil Presentation at National Academies, Trends in Oil Supply Demand*, in Washington, DC, Oct. 20-21, 2005, 11 pages.

Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.

Newkirk, A. E. et al. (1958) "Drying and Decomposition of Sodium Carbonate," *Anal. Chem.*, 30(5), pp. 982-984.

(56) References Cited

OTHER PUBLICATIONS

Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol.*, pp. 1078-1088.
Rajeshwar, K. et al. (1979) "Review: Thermophysical Properties of Oil Shales", *Journal of Materials Science*, v.14, pp. 2025-2052.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; Electrical resistivity of materials. Retrieved from internet: http://www.reade.com/Particle%5FBriefings/elec%5Fres.html.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smith, F. M. (1966) "A Down-hole Burner—Versatile Tool for Well Heating," *25th Tech. Conf on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stevens, A. L., and Zahradnik, R. L. (1983) "Results from the simultaneous processing of modified in situ retorts 7& 8", Gary, J. H., ed., *16th Oil Shale Symp.*, CSM, p. 267-280.
Stoss, K. et al. (1979) "Uses and Limitations of Ground Freezing With Liquid Nitrogen," *Engineering Geology*, 13, pp. 485-494.
Symington, W.A., et al (2006) ExxonMobil's electrofrac process for in situ oil shale conversion 26th Oil Shale Symposium, Colorado School of Mines.
Templeton, C. C. (1978) "Pressure-Temperature Relationship for Decomposition of Sodium Bicarbonate from 200 to 600° F," *J. of Chem. and Eng. Data*, 23(1), pp. 7-8.
Thomas, A. M. (1963) "Thermal Decomposition of Sodium Carbonate Solutions," *J. of Chem. and Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations* 7576, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-174, 175-198 and 254-266.
Tissot, B. P., and Welte, D. H. (1984) *Petroleum Formation and Occurrence*, New York, Springer-Verlag, p. 267-289 and 470-492.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Yen, T. F. et al. (1976) *Oil Shale*, Amsterdam, Elsevier, p. 216-267.
Oil & Gas Journal, 1998, "Aussie oil shale project moves to Stage 2", Oct. 26, p. 42.
Reade Advanced Materials; Electrical resistivity of materials. Retrieved from internet: http://www.reade.com/Particle%5FBriefings/elec%5Fres.html.
"Encyclopedia of Chemical Technology" (4th ed.), *Alkali and Chlorine Products*, pp. 1025-1039 (1998).
EP Search Report dated Apr. 21, 2006 (RS113865, corresponding to U.S. Appl. No. 11/726,651).
EP Search Report dated Feb. 16, 2007 (RS 114807, Corresponding to U.S. Appl. No. 11/973,753).
EP Search Report dated Mar. 12, 2009 (EP 08 00 3956,-Corresponding to U.S. Appl. No. 12/271,521).
EP Search Report dated Dec. 29, 2003 (RS 110243, Corresponding to US Pat 7,331,385).
International Search Report for PCT/US04/11508, Jan. 5, 2005.
International Search Report for PCT/US07/07133, Jan. 4, 2008.
International Search Report for PCT/US07/21669, Apr. 29, 2008.
International Search Report for PCT/US08/88045, Feb. 12, 2009.
International Search Report for PCT/US07/021968, May 14, 2008.
International Search Report for PCT/US07/021968, May 21, 2008.
International Search Report for PCT/US08/083815, Mar. 20, 2009.
International Search Report for PCT/US09/055403, Oct. 22, 2009.
US Pat No. 7,331,385—Office Action mailed Jul. 12, 2007.
US Pat No. 7,516,785—Office Action mailed Apr. 2, 2008.
US Pat No. 7,516,787—Office Action mailed Apr. 3, 2008.
US Pat No. 7,644,993—Office Action mailed Jun. 24, 2009.
U.S. Appl. No. 11/973,750 Office Action mailed Dec. 4, 2008.
Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.
Baugman, G. L. (1978) *Synthetic Fuels Data Handbook*, Second Edition, Cameron Engineers Inc.
Berry, K. L., et al. (1982) "Modified in situ retorting results of two field retorts", Gary, J. H., ed., 15th Oil Shale Symp., CSM, pp. 385-396.
Boyer, H. E. et al. (1985) "Chapter 16: Heat-Resistant Materials," *Metals Handbook*, American Society for Metals, 16 pages.
Brandt, H. et al. (1965) "Stimulating Heavy Oil Reservoirs With Downhole Air-Gas Burners," *World Oil*, (Sep. 1965), pp. 91-95.
Bridges, J. E., et al. (1983) "The IITRI in situ fuel recovery process", *J. Microwave Power*, v. 18, pp. 3-14.
Burnham, A. K. et al. (1983) "High-Pressure Pyrolysis of Green River Oil Shale" in Geochemistry and Chemistry of Oil Shales: ACS Symposium Series.
Burwell, E. L. et al. (1970) "Shale Oil Recovery by In-Situ Retorting—A Pilot Study" Journal of Petroleum Engr., Dec. 1970, pp. 1520-1524.
Chute, F. S., and Vermeulen, F. E., (1988) "Present and potential applications of electromagnetic heating in the in situ recovery of oil", AOSTRA J. Res., v. 4, pp. 19-33.

(56) References Cited

OTHER PUBLICATIONS

Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.
Cook, G. L. et al. (1968) "The Composition of Green River Shale Oils" United Nations Symposium of the Development and Utilization of Oil Shale Resources, 23 pgs.
Covell, J. R., et al. (1984) "Indirect in situ retorting of oil shale using the TREE process", Gary, J. H., ed., 17th Oil Shale Symposium Proceedings, Colorado School of Mines, pp. 46-58. c.
Cummins, J. J. et al. (1972) "Thermal Degradation of Green River Kerogen at 150 to 350C: Rate of Product Formation, Report of Investigation 7620," *US Bureau of Mines*, 1972.
Day, R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jrnl. Petro. Tech.*, (Dec. 1963), pp. 1297-1302.
Dougan, P. M. et al. (1981) "BX In Situ Oil Shale Project," *Colorado School of Mines; Fourteenth Oil Shale Symposium Proceedings*, 1981, pp. 118-127.
Dougan, P. M. (1979) "The BX In Situ Oil Shale Project," *Chem. Engr. Progress*, pp. 81-84.
Duncan, D. C., (1967) "Geologic Setting of Oil Shale Deposits and World Prospects," *in Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fisher, S. T. (1980) "A Comparison of Eleven Processes for Production of Energy from the Solid Fossil Fuels of North America," *SPE* 9098, pp. 1-27.
Fox, J. P, (1980) "Water-related Impacts of In-Situ Oil Shale Processing," *California Univ., Berkeley, Lawrence Berkeley Lab*, Chapters 6-7.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Hill, G.R. et al. (1967) "The Characteristics of a Low Temperature In Situ Shale Oil," *4th Symposium on Oil Shale, Quarterly of the Colorado School of Mines*, v.62(3), pp. 641-656.
Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.
Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," *University of Utah*, May 1966.
Katz, D.L. et al. (1978) "*Predicting Phase Behavior of Condensate/Crude-Oil Systems Using Methane Interaction Coefficients, J Petroleum Technology*", pp. 1649-1655.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.
Ali, A.H.A, et al, (2003) "Watching Rocks Change-Mechanical Earth Modeling", *Oilfield Review*, pp. 22-39.
Asquith, G., et al., (2004) *Basic Well Log Analysis*, Second Ed., Chapter 1, pp. 1-20.
Ball, J.S., et al. (1949) "Composition of Colorado Shale-Oil Naphtha", *Industrial and Engineering Chemistry*, vol. 41, No. 3 pp. 581-587.
Barnes, A. L. et al. (1968) "Quarterly of the Colorado School of Mines" *Fifth Symposium on Oil Shale*, v. 63(4), Oct. 1968, pp. 827-852.
Bastow, T.P., (1998) Sedimentary Processes Involving Aromatic Hydrocarbons . Thesis (PhD in Applied Chemistry) Curtin University of Technology (Australia), Dec., p. 102.
Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.
Cipolla, C.L., et al. (1994), "Practical Application of in-situ Stress Profiles", *Society of Petroleum Engineers*, SPE 28607, pp. 487-499.
Domine, F. et al. (2002) "Up to What Temperature is Petroleum Stable? New Insights from a 5200 Free Radical Reactions Model", *Organic Chemistry*, 33, pp. 1487-1499.
Dusseault, M.B. (1998) "Casing Shear: Causes, Cases, Cures", Society of Petroleum Engineers, SPE 48,864 pp. 337-349.
Fainberg, V. et al. (1998) "Integrated Oil Shale Processing Into Energy and Chemicals Using Combined-Cycle Technology," *Energy Sources*, v.20.6, pp. 465-481.
Farouq Ali, S. M., (1994), "Redeeming features of in situ combustion", DOE/NIPER *Symposium on In Situ Combustion Practices-Past, Present, and Future Application*, Tulsa, OK, Apr. 21-22, No. ISC 1, p. 3-8.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", SPE *Reservoir Eval. & Eng.3*, vol. 4, Aug., pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (Aug.) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, Dec. pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.

(56) References Cited

OTHER PUBLICATIONS

Hansen, K. S. et al, (1995) "Modeling of Reservoir Compaction and Surface Subsidence at South Belridge", *SPE Production & Facilities*, Aug. pp. 134-143.
Henderson, W, et al. (1968) "Thermal Alteration as a Contributory Process to the Genesis of Petroleum", *Nature* vol. 219, pp. 1012-1016.
Hill, G. R. et al. (1967) "Direct Production of a Low Pour Point High Gravity Shale Oil", *I&EC Product Research and Development*, 6(1), Mar. pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.
Holmes, A. S. et al. (1983) "Pilot Tests Prove Out Cryogenic Acid-Gas/Hydrocarbon Separation Processes," *Oil & Gas Journal*, pp. 85-86 and 89-91.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium (NARMS): Rock Mechanics Across Borders and Disciplines*, Houston, Texas, Jun. 5-9, ARMA/NARMS 04-627.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-8.
Moschovidis, Z. (1989) "Interwell Communication by Concurrent Fracturing—a New Stimulation Technique", *Journ. of Canadian Petro. Tech*. 28(5), pp. 42-48.
Nottenburg, R.N. et al. (1979) "Temperature and stress dependence of electrical and mechanical properties of Green River oil shale," *Fuel*, 58, pp. 144-148.
Nowacki, P. (ed.), (1981) Oil Shale Technical Handbook, Noyes Data Corp; pp. 4-23, 80-83 and 160-183.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Plischke, B., (1994) "Finite Element Analysis of Compaction and Subsidence—Experience Gained from Several Chalk Fields", *Society of Petroleum Engineers*, SPE 28129, 1994, pp. 795-802.
Ruzicka, D.J. et al. (1987) "Modified Method Measures Bromine Number of Heavy Fuel Oils", *Oil & Gas Journal*, 85(31), Aug. 3, pp. 48-50.
Sahu, D. et al. (1988) "Effect of Benzene and Thiophene on Rate of Coke Formation During Naphtha Pyrolysis", *Canadian Journ. of Chem. Eng.*, 66, Oct. pp. 808-816.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, ARMA/NARMS 04-470.
Syunyaev, Z.I. et al. (1965) "Change in the Resistivity of Petroleum Coke on Calcination," Chemistry and Technology of Fuels and Oils, 1(4), pp. 292-295.
Turta, A., (1994), "In situ combustion—from pilot to commercial application", *DOE/NIPER Symposium on In Situ Combustion Practices-Past, Present, and Future Application*, Tulsa, OK, Apr. 21-22, Nno. ISC 3, p. 15-39.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: Reprint Series No. 28", *Soc. of Petroleum Engineers* SPE 14085, Part I, Overview, pp. 12-44.
Warpinski, N. R., (1989) "Elastic and Viscoelastic Calculations of Stresses in Sedimentary Basins", *SPE Formation Evaluation*, vol. 4, pp. 522-530.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.

* cited by examiner

WATER TREATMENT FOLLOWING SHALE OIL PRODUCTION BY IN SITU HEATING

STATEMENT OF RELATED APPLICATIONS

This application claims the benefit of U.S. Provisional Patent Application 61/154,670 filed 23 Feb. 2009 entitled "Water Treatment Following Shale Oil Production by In Situ Heating", the entirety of which is incorporated by reference herein.

This application also claims the benefit of pending U.S. non-provisional patent application Ser. No. 11/726,651, which was filed on Mar. 22, 2007. That application is titled "In Situ Co-Development of Oil Shale with Mineral Recovery" and is incorporated herein in its entirety by reference. That application in turn claims the benefit of pending U.S. provisional patent application No. 60/793,841, which was filed on Apr. 21, 2006. That application was also titled "In Situ Co-Development of Oil Shale with Mineral Recovery."

BACKGROUND

1. Technical Field

This description relates to the field of hydrocarbon recovery from subsurface formations. More specifically, the present invention relates to the in situ recovery of hydrocarbon fluids from organic-rich rock formations including, for example, oil shale formations, coal formations and tar sands formations. This description also relates to methods for treating water used to flush a formation of impurities following shale oil production by in situ heating.

2. Discussion of Technology

Certain geological formations are known to contain an organic matter known as "kerogen." Kerogen is a solid, carbonaceous material. When kerogen is imbedded in rock formations, the mixture is referred to as oil shale. This is true whether or not the mineral is, in fact, technically shale, that is, a rock formed from compacted clay.

Kerogen is subject to decomposing upon exposure to heat over a period of time. Upon heating, kerogen molecularly decomposes to produce oil, gas, and carbonaceous coke. Small amounts of water may also be generated. The oil, gas and water fluids become mobile within the rock matrix, while the carbonaceous coke remains essentially immobile.

Oil shale formations are found in various areas worldwide, including the United States. Such formations are notably found in Wyoming, Colo., and Utah. Oil shale formations tend to reside at relatively shallow depths and are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature-dependent. Temperatures generally in excess of 270° C. (518° F.) over the course of many months may be required for substantial conversion. At higher temperatures substantial conversion may occur within shorter times. When kerogen is heated to the necessary temperature, chemical reactions break the larger molecules forming the solid kerogen into smaller molecules of oil and gas. The thermal conversion process is referred to as pyrolysis or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well. Such countries include Australia, Brazil, China, Estonia, France, Russia, South Africa, Spain, Jordan, and Sweden. However, the practice has been mostly discontinued in recent years because it has proven to be uneconomical or because of environmental constraints on spent shale disposal. (See T. F. Yen, and G. V. Chilingarian, "*Oil Shale*," Amsterdam, Elsevier, p. 292, the entire disclosure of which is incorporated herein by reference.) Further, surface retorting requires mining of the oil shale, which limits that particular application to very shallow formations.

In the United States, the existence of oil shale deposits in northwestern Colorado has been known since the early 1900's. While research projects have been conducted in this area from time to time, no serious commercial development has been undertaken. Most research on oil shale production was carried out in the latter half of the 1900's. The majority of this research was on shale oil geology, geochemistry, and retorting in surface facilities.

In 1947, U.S. Pat. No. 2,732,195 issued to Ljungstrom. That patent, entitled "Method of Treating Oil Shale and Recovery of Oil and Other Mineral Products Therefrom," proposed the application of heat at high temperatures to the oil shale formation in situ. The purpose of such in situ heating was to distill hydrocarbons and produce them to the surface. The '195 Ljungstrom patent is incorporated herein by reference.

Ljungstrom coined the phrase "heat supply channels" to describe bore holes drilled into the formation. The bore holes received an electrical heat conductor which transferred heat to the surrounding oil shale. Thus, the heat supply channels served as early heat injection wells. The electrical heating elements in the heat injection wells were placed within sand or cement or other heat-conductive material to permit the heat injection wells to transmit heat into the surrounding oil shale while preventing the inflow of fluid. According to Ljungstrom, the "aggregate" was heated to between 500° and 1,000° C. in some applications.

Along with the heat injection wells, fluid producing wells were also completed in near proximity to the heat injection wells. As kerogen was pyrolyzed upon heat conduction into the rock matrix, the resulting oil and gas would be recovered through the adjacent producing wells.

Ljungstrom applied his approach of thermal conduction from heated wellbores through the Swedish Shale Oil Company. A full scale plant was developed that operated from 1944 into the 1950's. (See G. Salamonsson, "The Ljungstrom In Situ Method for Shale-Oil Recovery," $2^{nd}$ Oil Shale and Cannel Coal Conference, v. 2, Glasgow, Scotland, Institute of Petroleum, London, p. 260-280 (1951), the entire disclosure of which is incorporated herein by reference.)

Additional in situ methods have been proposed. These methods generally involve the injection of heat and/or solvent into a subsurface oil shale formation. Heat may be in the form of heated methane (see U.S. Pat. No. 3,241,611 to J. L. Dougan), flue gas, or superheated steam (see U.S. Pat. No. 3,400,762 to D. W. Peacock). Heat may also be in the form of electric resistive heating, dielectric heating, radio frequency (RF) heating (U.S. Pat. No. 4,140,180, assigned to the ITT Research Institute in Chicago, Ill.) or oxidant injection to support in situ combustion. In some instances, artificial permeability has been created in the matrix to aid the movement of pyrolyzed fluids. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W. Hoover, et al.), heat fracturing (see U.S. Pat. No.

3,284,281 to R. W. Thomas), and steam fracturing (see U.S. Pat. No. 2,952,450 to H. Purre).

In 1989, U.S. Pat. No. 4,886,118 issued to Shell Oil Company, the entire disclosure of which is incorporated herein by reference. That patent, entitled "Conductively Heating a Subterranean Oil Shale to Create Permeability and Subsequently Produce Oil," declared that "[c]ontrary to the implications of . . . prior teachings and beliefs . . . the presently described conductive heating process is economically feasible for use even in a substantially impermeable subterranean oil shale." (col. 6, ln. 50-54). Despite this declaration, it is noted that few, if any, commercial in situ shale oil operations have occurred other than Ljungstrom's enterprise. The '118 patent proposed controlling the rate of heat conduction within the rock surrounding each heat injection well to provide a uniform heat front.

As indicated above, resistive heating techniques for a subsurface formation have been considered. F. S. Chute and F. E. Vermeulen, Present and Potential Applications of Electromagnetic Heating in the In Situ Recovery of Oil, AOSTRA J. Res., v. 4, p. 19-33 (1988) describes a heavy-oil pilot test where "electric preheat" was used to flow electric current between two wells to lower viscosity and create communication channels between wells for follow-up with a steam flood. It has been disclosed to run alternating current or radio frequency electrical energy between stacked conductive fractures or electrodes in the same well in order to heat a subterranean formation. See U.S. Pat. No. 3,149,672 titled "Method and Apparatus for Electrical Heating of Oil-Bearing Formations;" U.S. Pat. No. 3,620,300 titled "Method and Apparatus for Electrically Heating a Subsurface Formation;"U.S. Pat. No. 4,401,162 titled "In Situ Oil Shale Process;" and U.S. Pat. No. 4,705,108 titled "Method for In Situ Heating of Hydrocarbonaceous Formations." U.S. Pat. No. 3,642,066 titled "Electrical Method and Apparatus for the Recovery of Oil," provides a description of resistive heating within a subterranean formation by running alternating current between different wells. Others have described methods to create an effective electrode in a wellbore. See U.S. Pat. No. 4,567,945 titled "Electrode Well Method and Apparatus;" and U.S. Pat. No. 5,620,049 titled "Method for Increasing the Production of Petroleum From a Subterranean Formation Penetrated by a Wellbore." U.S. Pat. No. 3,137,347 titled "In Situ Electrolinking of Oil Shale," describes a method by which electric current is flowed through a fracture connecting two wells to get electric flow started in the bulk of the surrounding formation. Heating of the formation occurs primarily due to the bulk electrical resistance of the formation.

Additional history behind oil shale retorting and shale oil recovery can be found in co-owned U.S. Pat. No. 7,331,385 entitled "Methods of Treating a Subterranean Formation to Convert Organic Matter into Producible Hydrocarbons." The Background and technical disclosure of this patent is incorporated herein by reference.

Regardless of the in situ heating method employed, the pyrolysis process may create residual contaminants. When kerogen is converted into hydrocarbon fluids in situ, a number of potential contaminants, both organic and inorganic, may also be generated. It is desirable to remove such contaminants from the spent shale so as to prevent a migration of such contaminants into aquifers.

A need exists for improved processes for the production of shale oil. In addition, a need exists for improved methods for the removal of contaminants from the spent shale. Still further, a need exists for methods of treating water that is circulated through a subsurface formation containing spent shale in order to remove volatile organic compounds and other contaminants.

SUMMARY

In one general aspect, a method for recovering hydrocarbons from a subsurface formation in a development area includes applying heat to the subsurface formation using in situ heat in order to pyrolyze formation hydrocarbons into hydrocarbon fluids. The hydrocarbon fluids are produced from one or more hydrocarbon production wells. Water is pumped from an injection pump into one or more water injection wells. The water from the one or more water injection wells is circulated through the subsurface formation, into one or more water production wells, and up to a water treatment facility at the surface of the development area. The water is treated at the water treatment facility in order to (i) substantially separate hydrocarbons from the water. The water treatment facility is also configured to (ii) substantially remove organic materials from the water and/or one or more other water treatment processes.

Implementations of this aspect may include one or more of the following features. For example, the water treatment facility may also be configured to accomplish one or more of the following: (iii) substantially reducing hardness and alkalinity of the water, (iv) substantially removing dissolved inorganic solids from the water, and/or (v) substantially removing suspended solids from the water, thereby providing treated water. The water treatment facility may be configured to treat the water at the water treatment facility in order to (i) substantially separate hydrocarbons from the water, (ii) substantially remove organic materials from the water, (iii) substantially reduce hardness and alkalinity of the water, (iv) substantially remove dissolved inorganic solids from the water, and (v) substantially remove suspended solids from the water. Treating the water at the water treatment facility may include one or more of substantially removing organic materials from the water, substantially reducing hardness and alkalinity of the water, substantially removing dissolved inorganic solids from the water, and/or substantially removing suspended solids from the water. Treating the water at the water treatment facility to provide treated water may include two, three, four, or more of (i) substantially separating hydrocarbons from the water, (ii) substantially removing organic materials from the water, (iii) substantially reducing hardness and alkalinity of the water, (iv) substantially removing dissolved inorganic solids from the water, and (v) substantially removing suspended solids from the water.

The water may be tested after the water has been treated. The formation hydrocarbons may include solid hydrocarbons, e.g., such as oil shale. The subsurface formation may be heated using electrical resistance heating, such as wellbore heaters or heat sources formed in place, e.g., electrically conductive fractures. The water treatment facility may include one or more induced air flotation separators, and treating the water in order to substantially separate hydrocarbons from the water may include passing the water through the one or more induced air flotation separators. Treating the water in order to substantially remove suspended solids from the water may include in part passing the water through the one or more induced air flotation separators. The water treatment facility may include one or more porous media filters, and treating the water in order to substantially remove suspended solids from the water may include passing the water through the one or more porous media filters. The water treatment facility may include one or more gravity settling vessels, one or more centrifugal separators, and/or combinations thereof, and treating the water in order to substantially separate hydrocarbons from the water may include passing the water through the one or more gravity settling vessels, one or more centrifugal separators, and/or combinations thereof. The water treatment facility may include one or more biological oxidation reactors, and treating the water in order to substantially remove organic materials from the water may include passing the water through the one or more biological oxidation reactors. The water may pass through the one or more biological oxidation reactors after the water passes through the one or more induced air flotation separators. The water treatment facility may include one or more hot lime softening vessels, and treating the water in order to substantially reduce hardness and alkalinity of the water may include passing the water through the one or more hot lime softening vessels. Reducing hardness may include substantially removing calcium and magnesium ions. Reducing alkalinity may include substantially removing carbonate and bicarbonate species. The water treatment facility may include one or more reverse osmosis filters, and treating the water in order to substantially reduce alkalinity may include passing the water through the one or more reverse osmosis filters after passing the water through the one or more hot lime softening vessels. The water may pass through the one or more porous media filters after the water passes through the one or more induced air flotation separators. The water treatment facility may include one or more hot lime softening vessels and one or more reverse osmosis filters, and treating the water in order to substantially reduce hardness and alkalinity of the water may include passing the water through the one or more hot lime softening vessels and the one or more reverse osmosis filters. The water may pass through the one or more hot lime softening vessels and the one or more reverse osmosis filters after the water passes through the one or more biological oxidation reactors. The water treatment facility may include one or more reverse osmosis filters, and treating the water in order to substantially remove dissolved inorganic solids from the water may include passing the water through the one or more reverse osmosis filters.

A pore volume of a portion of the subsurface formation may be determined through which the treated water is circulated. The treated water may be circulated from an injection pump through the subsurface formation over time in a volume that represents about 2 to 6 times the determined pore volume. The water may be tested after the water has been treated. Testing of treated or partially treated water may include testing the water after at least two pore volumes of water have been circulated through the subsurface formation for compliance with regulatory ground water standards. For example, the regulatory ground water standards may include regulations of an environmental regulatory body of the State of Colorado. The circulation of the treated water may be discontinued upon determining that regulatory ground water standards for water in the subsurface formation have been met. The subsurface formation may be allowed to cool after producing the hydrocarbon fluids for a predetermined period of time and before circulating the water into the water injection wells. One or more of the plurality of hydrocarbon production wells may be converted into the one or more water production wells.

In another general aspect, a method for treating water at a water treatment facility, the water having been circulated through a subsurface formation in a shale oil development area, and the subsurface formation comprising shale that has been spent due to pyrolysis of formation hydrocarbons, the method includes receiving the water at the water treatment facility. The water is treated at the water treatment facility to (i) substantially separate oil from the water, (ii) substantially remove organic materials from the water, (iii) substantially reduce hardness and alkalinity of the water, (iv) substantially remove dissolved inorganic solids from the water, and/or (v) substantially remove suspended solids from the water, thereby providing treated water. The treated water is delivered to a pump and re-injected into the subsurface formation to leach out contaminants from the spent shale.

Implementations of this aspect may include one or more of the following features. For example, the water may be tested following treatment. The contaminants may include organic compounds, heavy metal compounds, and ionic species. The organic compounds may include benzene, toluene, xylene, tri-methylbenzene, anthracene, naphthalene, pyrene, and/or combinations thereof. The heavy metal contaminants may include arsenic, chromium, mercury, selenium, lead, vanadium, nickel, zinc, and/or combinations thereof. The ionic species may include sulfates, chlorides, fluorides, and/or combinations thereof. The contaminants may include boron. The water treatment facility may include one or more induced air flotation separators. Treating the water in order to substantially separate oil from the water may include passing the water through the one or more induced air flotation separators. Treating the water in order to substantially remove suspended solids from the water may include in part, passing the water through the one or more induced air flotation separators. The water treatment facility may include one or more porous media filters, and treating the water in order to substantially remove suspended solids from the water may include passing the water through the one or more porous media filters.

The water treatment facility may include one or more gravitational separators. Treating the water in order to substantially separate oil from the water may include passing the water through the one or more gravitational separators. The water treatment facility may include one or more biological oxidation reactors. Treating the water in order to substantially remove organic materials from the water may include passing the water through the one or more biological oxidation reactors. Treating the water in order to substantially remove organic materials from the water may include passing the water through an adsorbent media comprising activated carbon, fuller's earth, or both. The water may pass through the one or more biological oxidation reactors after the water passes through the one or more induced air flotation separators. The water treatment facility may include one or more hot lime softening vessels. Treating the water in order to substantially reduce hardness and alkalinity of the water may include passing the water through the one or more hot lime softening vessels. The water treatment facility may include one or more hot lime softening vessels. Treating the water in order to substantially reduce hardness and alkalinity of the water may include passing the water through the one or more hot lime softening vessels. The water may pass through the one or more hot lime softening vessels after it passes through the one or more biological oxidation reactors. Removing hardness may include substantially removing calcium and magnesium ions. Removing alkalinity may include substantially removing carbonate and bi-carbonate species.

The water treatment facility may include one or more reverse osmosis filters. Treating the water in order to substantially remove alkalinity may include passing the water through the one or more reverse osmosis filters after passing the water through the one or more hot lime softening vessels. The water treatment facility may include one or more hot lime softening vessels and one or more reverse osmosis filters.

Treating the water in order to substantially reduce hardness and alkalinity of the water may include passing the water through the one or more hot lime softening vessels and the one or more reverse osmosis filters. The water may pass through the one or more hot lime softening vessels and the one or more reverse osmosis filters after the water passes through the one or more biological oxidation reactors. The water treatment facility may include one or more reverse osmosis filters. Treating the water in order to substantially remove dissolved inorganic solids from the water may include passing the water through the one or more reverse osmosis filters. The water may pass through the one or more reverse osmosis filters after the water passes through the one or more induced air flotation separators. The water treatment facility may include one or more porous media filters. Treating the water in order to substantially remove suspended solids from the water may include passing the water through the one or more porous media filters. The water passes through the one or more porous media filters after it passes through the one or more induced air flotation separators. A pore volume of a portion of the subsurface formation through which the treated water is circulated is determined. Re-injecting treated water from the pump may include injecting a volume of treated water over time representing about 2 to 6 times the determined pore volume. Testing the water may include testing the water for compliance with regulatory ground water standards. The regulatory ground water standards comprise regulations of an environmental regulatory body of the State of Colorado. The re-injection of the treated water may be discontinued upon determining that regulatory ground water standards for water in the subsurface formation have been met. The formation hydrocarbons may include oil shale, or other heavy hydrocarbons such as tar sands.

In another general aspect, a system for recovering hydrocarbons from a subsurface formation in a development area may include at least one in situ heat source configured to apply heat to the subsurface formation using in situ heat to pyrolyze formation hydrocarbons into hydrocarbon fluids. The system includes at least one hydrocarbon production well for producing the hydrocarbon fluids, at least one injection pump, and at least one water injection well. The at least one injection pump is configured to pump water into the at least one water injection well. The system includes a water treatment facility at the surface of the development area. The water treatment facility is in fluid communication with the at least one injection well and the at least one water injection well, the fluid communication permitting the water to be circulated from the one or more water injection well through the subsurface formation, into one or more water production wells, and up to a water treatment facility at the surface of the development area. The water treatment facility may be configured to treat the circulated water by two or more of the following treatment methods: (i) substantially separating hydrocarbons from the water, (ii) substantially removing organic materials from the water, (iii) substantially reducing hardness and alkalinity of the water, (iv) substantially removing dissolved inorganic solids from the water, and/or (v) substantially removing suspended solids from the water. The formation hydrocarbons may include heavy hydrocarbons, such as oil shale or tar sands. The in situ heat source may include one or more electrically resistive heat sources.

A method for recovering hydrocarbons from a subsurface formation in a development area is provided. In one aspect, the method includes applying heat to the subsurface formation using in situ heat in order to pyrolyze formation hydrocarbons into hydrocarbon fluids, and then producing the hydrocarbon fluids from a plurality of hydrocarbon production wells for a desired period of time. Preferably, the formation hydrocarbons include solid hydrocarbons. The solid hydrocarbons may be, for example, oil shale. In this instance, the development area will be a shale oil development area.

The method may also include circulating water from an injection pump at a surface at the development area and into one or more water injection wells, and further circulating the water through the subsurface formation, into one or more water production wells, and back to a water treatment facility at the surface. Preferably, the subsurface formation is allowed to cool after the desired period of time before the water is circulated into the water injection wells.

The method may also include treating the water at the water treatment facility. The purpose for treating the water is to (i) substantially separate oil from the water, (ii) substantially remove organic materials from the water, (iii) substantially reduce hardness and alkalinity from the water, (iv) substantially remove dissolved inorganic solids from the water; and (v) substantially remove suspended solids from the water, thereby providing treated water.

In one aspect, the water treatment facility includes one or more induced air flotation separators. In addition, the water treatment facility may include one or more gravitational separators. In these instances, treating the water in order to substantially separate oil from the water includes passing the water through the one or more induced air flotation separators and, optionally, one or more gravitational separators.

In another aspect, the water treatment facility includes one or more biological oxidation reactors. In this instance, treating the water in order to substantially remove organic materials from the water may include passing the water through the one or more biological oxidation reactors. Preferably, the water passes through the one or more biological oxidation reactors after it passes through the one or more induced air flotation separators.

In another aspect, the water treatment facility includes one or more hot lime softening vessels. In this instance, treating the water in order to substantially reduce hardness and alkalinity of the water includes passing the water through the one or more hot lime softening vessels and one or more reverse osmosis filters. Preferably, the water passes through the one or more hot lime softening vessels and one or more reverse osmosis filters after it passes through the one or more biological oxidation reactors.

In another aspect, the water treatment facility includes one or more solids filters such as porous media filters. In this instance, treating the water in order to substantially remove suspended solids from the water may include passing the water through the one or more porous media filters. Preferably, the water passes through the one or more porous media filters after it passes through the one or more hot lime softening vessels.

The method may also include testing the water after the water has been treated. The testing is for the purpose of determining compliance with regulatory ground water standards. For example, the standards may be environmental standards established by a regulatory body of the State of Colorado or another state of the United States.

The method may also include the steps of determining a pore volume of a portion of the subsurface formation through which the treated water is circulated, and then circulating the treated water from an injection pump through the subsurface formation over time in a volume that represents about 2 to 6 times the determined pore volume. Preferably, the water is tested after at least two pore volumes of water have been circulated through the subsurface formation.

A method for treating water at a water treatment facility is also provided herein. In one aspect, the water has been circulated through a subsurface formation in a shale oil development area. The subsurface formation includes shale that has been spent due to pyrolysis of formation hydrocarbons. The method in one embodiment includes receiving the water at the water treatment facility, and treating the water at the facility in order to (i) substantially separate oil from the water, (ii) substantially remove organic materials from the water, (iii) substantially reduce hardness and alkalinity of the water, (iv) substantially remove dissolved inorganic solids from the water, and (v) substantially remove suspended solids from the water. The method further includes delivering water that has been treated at the surface facility to a pump as treated water, and re-injecting the treated water into the subsurface formation to continue leaching out migratory contaminant species from the spent shale.

The migratory contaminant species may include, for example, organic compounds. Organic compounds may include benzene, toluene, xylene, tri-methylbenzene, anthracene, naphthalene, pyrene, boron, or combinations thereof. The migratory contaminant species may alternatively, or in addition, include heavy metal compounds. Heavy metal compounds may include, for example arsenic, chromium, mercury, selenium, lead, vanadium, nickel, zinc, or combinations thereof. The migratory contaminant species may alternatively, or in addition, include ionic species. Ionic species may include sulfates, chlorides, fluorides, or other materials that alter the pH of water in the subsurface formation.

The method may further include determining a pore volume of a portion of the subsurface formation through which the treated water is circulated. The step of re-injecting treated water from the pump may then include injecting a volume of treated water over time representing about 2 to 6 times the determined pore volume. The re-injected water is produced through water production wells and returned to the water treatment facility.

The method may also include testing the water following treatment. This may mean, for example, testing the water for compliance with regulatory ground water standards. The regulatory ground water standards may be regulations of an environmental regulatory body of the State of Colorado or another state. The method may then include discontinuing circulating the treated water upon determining that regulatory ground water standards for water in the subsurface formation have been met.

BRIEF DESCRIPTION OF THE DRAWINGS

So that the present application can be better understood, certain drawings, charts, graphs and flow charts are appended hereto. It is to be noted, however, that the drawings illustrate only selected embodiments and are therefore not to be considered limiting of scope, for the embodiments may admit to other equally effective embodiments and applications.

DETAILED DESCRIPTION

Definitions

Figure 1:
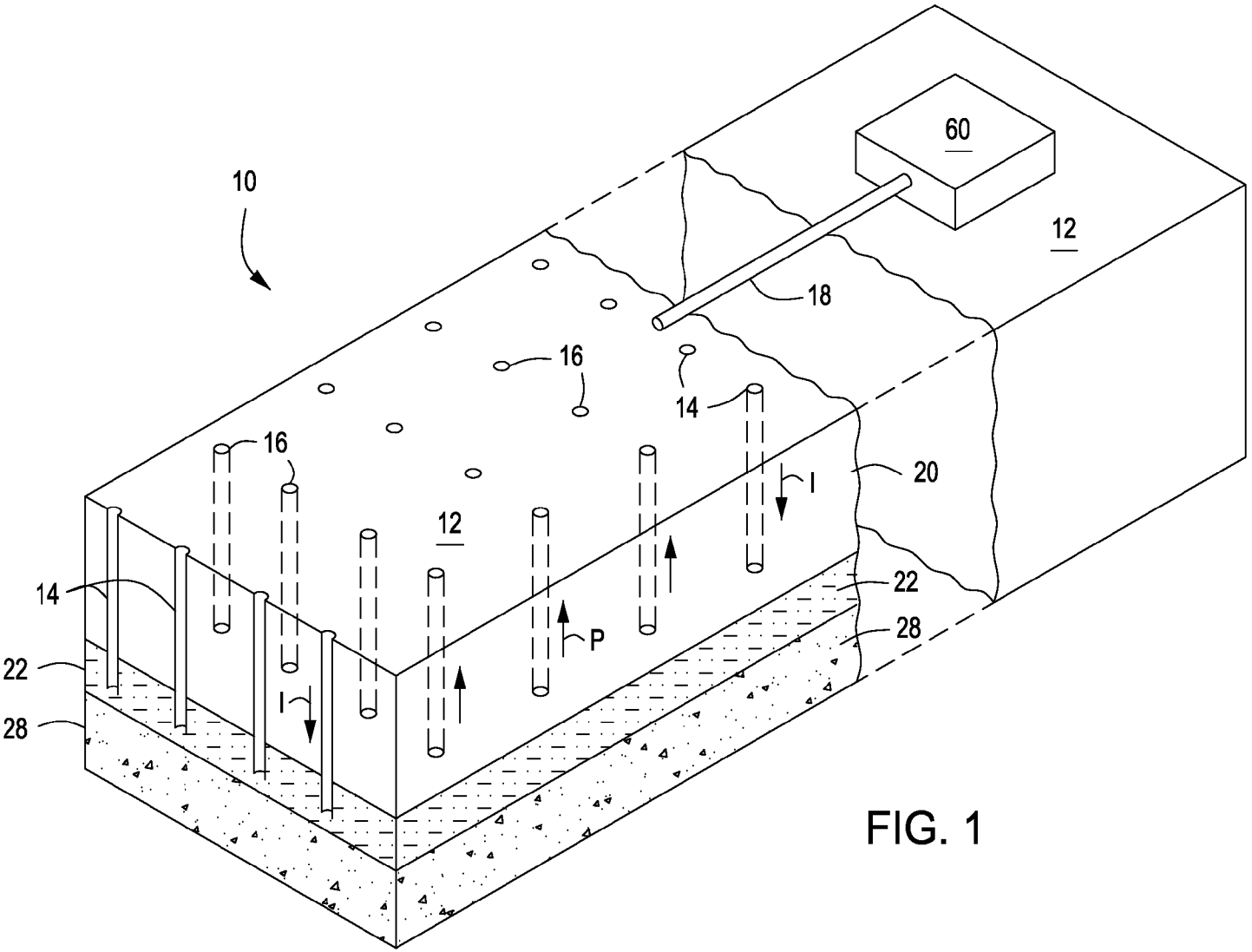
FIG. 1 is a cross-sectional isometric view of an illustrative hydrocarbon development area. The subsurface area includes an organic-rich rock matrix that defines a subsurface formation.

As used herein, the term "hydrocarbon(s)" refers to organic material with molecular structures containing carbon bonded to hydrogen. Hydrocarbons may also include other elements such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Production fluids may include, but are not limited to, pyrolyzed shale oil, synthesis gas, a pyrolysis product of coal, carbon dioxide, hydrogen sulfide and water (including steam). Produced fluids may include both hydrocarbon fluids and non-hydrocarbon fluids.

As used herein, the term "condensable hydrocarbons" means those hydrocarbons that condense at 25° C. and one atmosphere absolute pressure. Condensable hydrocarbons may include a mixture of hydrocarbons having carbon numbers greater than 4.

As used herein, the term "non-condensable hydrocarbons" means those hydrocarbons that do not condense at 25° C. and one atmosphere absolute pressure. Non-condensable hydrocarbons may include hydrocarbons having carbon numbers less than 5.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10 to 20 degrees, whereas tar generally has an API gravity below about 10 degrees. The viscosity of heavy hydrocarbons is generally greater than about 100 centipoise at 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that principally contains carbon, hydrogen, nitrogen, oxygen, and sulfur. Oil shale contains kerogen.

As used herein, the term "bitumen" refers to a non-crystalline solid or viscous hydrocarbon material that is substantially soluble in carbon disulfide.

As used herein, the term "oil" refers to a hydrocarbon fluid containing a mixture of condensable hydrocarbons.

As used herein, the term "subsurface" refers to geologic strata occurring below the earth's surface.

As used herein, the term "hydrocarbon-rich formation" refers to any formation that contains more than trace amounts of hydrocarbons. For example, a hydrocarbon-rich formation may include portions that contain hydrocarbons at a level of greater than 5 volume percent. The hydrocarbons located in a hydrocarbon-rich formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen.

As used herein, the term "formation" refers to any finite subsurface region. The formation may contain one or more hydrocarbon-containing layers, one or more non-hydrocarbon containing layers, an overburden, and/or an underburden of any subsurface geologic formation. An "overburden" is geological material above the formation of interest, while an "underburden" is geological material below the formation of interest. An overburden or underburden may include one or more different types of substantially impermeable materials. For example, overburden and/or underburden may include rock, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "organic-rich rock formation" refers to any formation containing organic-rich rock. Organic-rich rock formations include, for example, oil shale formations, coal formations, and tar sands formations.

As used herein, the term "pyrolysis" refers to the breaking of chemical bonds through the application of heat. For example, pyrolysis may include transforming a compound into one or more other substances by heat alone or by heat in combination with an oxidant. Pyrolysis may include modifying the nature of the compound by addition of hydrogen atoms which may be obtained from molecular hydrogen, water, or carbon dioxide. Heat may be transferred to a section of the formation to cause pyrolysis.

As used herein, the term "water-soluble minerals" refers to minerals that are soluble in water. Water-soluble minerals include, for example, nahcolite (sodium bicarbonate), soda ash (sodium carbonate), dawsonite ($NaAl(CO_3)(OH)_2$), or combinations thereof. Substantial solubility may require heated water and/or a non-neutral pH solution.

As used herein, the term "formation water-soluble minerals" refers to water-soluble minerals that are found naturally in a formation.

As used herein, the term "migratory contaminant species" refers to species that are both soluble or moveable in water or an aqueous fluid, and are considered to be potentially harmful or of concern to human health or the environment. Migratory contaminant species may include inorganic and organic contaminants. Organic contaminants may include saturated hydrocarbons, aromatic hydrocarbons, and oxygenated hydrocarbons. Inorganic contaminants may include metal contaminants, and ionic contaminants of various types that may significantly alter pH or the formation fluid chemistry. Aromatic hydrocarbons may include, for example, benzene, toluene, xylene, ethylbenzene, and tri-methylbenzene, and various types of polyaromatic hydrocarbons such as anthracenes, naphthalenes, chrysenes and pyrenes. Oxygenated hydrocarbons may include, for example, alcohols, ketones, phenols, and organic acids such as carboxylic acid. Metal contaminants may include, for example, arsenic, boron, chromium, cobalt, molybdenum, mercury, selenium, lead, vanadium, nickel, zinc, lithium, iron and strontium. Ionic contaminants include, for example, sulfides, sulfates, chlorides, fluorides, ammonia, nitrates, calcium, magnesium and potassium.

As used herein, the term "subsidence" refers to a downward movement of a surface relative to an initial elevation of the surface.

As used herein, the term "thickness" of a layer refers to the distance between the upper and lower boundaries of a cross section of a layer, wherein the distance is measured normal to the average tilt of the cross section.

As used herein, the term "thermal fracture" refers to fractures created in a formation caused directly or indirectly by expansion or contraction of a portion of the formation and/or fluids within the formation, which in turn is caused by increasing/decreasing the temperature of the formation and/or fluids within the formation, and/or by increasing/decreasing a pressure of fluids within the formation due to heating. Thermal fractures may propagate into or form in neighboring regions significantly cooler than the heated zone.

As used herein, the term "hydraulic fracture" refers to a fracture at least partially propagated into a formation, wherein the fracture is created through injection of pressurized fluids into the formation. While the term "hydraulic fracture" is used, the inventions herein are not limited to use in hydraulic fractures. The invention is suitable for use in any fracture created in any manner considered to be suitable by one skilled in the art. The fracture may be artificially held open by injection of a proppant material. Hydraulic fractures may be substantially horizontal in orientation, substantially vertical in orientation, or oriented along any other plane.

As used herein, the term "wellbore" refers to a hole in the subsurface made by drilling or insertion of a conduit into the subsurface. A wellbore may have a substantially circular cross section, or other cross-sectional shapes (e.g., circles, ovals, squares, rectangles, triangles, slits, or other regular or irregular shapes). As used herein, the term "well", when referring to an opening in the formation, may be used interchangeably with the term "wellbore."

The inventions are described herein in connection with certain specific embodiments. However, to the extent that the following detailed description is specific to a particular embodiment or a particular use, such is intended to be illustrative only and is not to be construed as limiting the scope of the invention.

As discussed herein, some embodiments of the invention include or have application related to an in situ method of recovering natural resources. The natural resources may be recovered from an organic-rich rock formation including, for example, an oil shale formation. The organic-rich rock formation may include formation hydrocarbons including, for example, kerogen, coal, and heavy hydrocarbons. In some embodiments of the invention the natural resources may include hydrocarbon fluids including, for example, products of the pyrolysis of formation hydrocarbons such as shale oil. In some embodiments of the invention the natural resources may also include water-soluble minerals including, for example, nahcolite (sodium bicarbonate, or $Na_2HCO_3$), soda ash (sodium carbonate, or $Na_2CO_3$) and dawsonite ($NaAl(CO_3)(OH)_2$).

FIG. 1 presents a perspective view of an illustrative oil shale development area 10. A surface 12 of the development area 10 is indicated. Below the surface 12 are various subsurface strata 20. The strata 20 include, for example, an organic-rich rock formation 22 and a non-organic-rich rock formation 28 there below. The illustrative organic-rich rock formation 22 contains formation hydrocarbons (such as, for example, kerogen) and possibly valuable water-soluble minerals (such as, for example, nahcolite).

It is understood that the representative formation 22 may be any organic-rich rock formation, including a rock matrix containing coal or tar sands, for example. In addition, the rock matrix making up the formation 22 may be permeable, semi-permeable or essentially non-permeable. The present inventions are particularly advantageous in oil shale development areas initially having very limited or effectively no fluid permeability.

In order to access formation 22 and recover natural resources therefrom, a plurality of wellbores is formed. First, certain wellbores 14 are shown along a periphery of the portion of the development area 12 shown. These wellbores 14 are designed originally to serve as heater wells. The heater wells provide heat to pyrolyze hydrocarbon solids in the organic-rich rock formation 22. Subsequent to the pyrolysis process, the peripheral wellbores 14 may be converted to water injection wells. Selected injection wells 14 are denoted with a downward arrow "I."

The illustrative wellbores 14 are presented in so-called "line drive" arrangements. However, as discussed more fully in connection with FIG. 4, various other arrangements may be provided. The inventions disclosed herein are not limited to the arrangement of or method of selection for heater wells or water injection wells.

Additional wellbores 16 are shown at 14 internal to the portion of the development area 10. These represent production wells. The representative wellbores 16 for the production wells are essentially vertical in orientation relative to the surface 12. However, it is understood that some or all of the wellbores 16 for the production wells could deviate into an obtuse or even horizontal orientation. Selected production wells 16 are denoted with an upward arrow "P."

In the arrangement of FIG. 1, each of the wellbores 14, 16 is completed in the oil shale formation 22. The completions may be either open or cased hole. The well completions for the production well wellbores 16 may also include propped or unpropped hydraulic fractures emanating therefrom. Subsequent to production, some of these internal wellbores 16 may be converted to water production wells.

In the view of FIG. 1, only eight wellbores 14 are shown for the injection wells and only eight wellbores 16 are shown for the production wells. However, it is understood that in an oil shale development project, numerous additional wellbores 14, 16 will be drilled. The wellbores 16 for the production wells may be located in relatively close proximity, being from 300 feet down to 10 feet in separation. In some embodiments, a well spacing of 15 to 25 feet is provided. Typically, the wellbores 16 are also completed at shallow depths, being from 200 to 5,000 feet at true vertical depth. In some embodiments the oil shale formation targeted for in situ retorting is at a depth greater than 200 feet below the surface or alternatively 400 feet below the surface. Alternatively, conversion and production occur at depths between 500 and 2,500 feet.

As noted, the wellbores 14, 16 will be selected for certain initial functions before being converted to water injection wells and oil production wells and/or water-soluble mineral solution production wells. In one aspect, the wellbores 14, 16 are dimensioned to serve two, three, or four different purposes in designated sequences. Suitable tools and equipment may be sequentially run into and removed from the wellbores 14, 16 to serve the various purposes.

A production fluids processing facility 60 is also shown schematically in FIG. 1. The processing facility 60 is equipped to receive fluids produced from the organic-rich rock formation 22 through one or more pipelines or flow lines 18. The fluids processing facility 60 may include equipment suitable for receiving and separating oil, gas, and water produced from the heated formation 22. The fluids processing facility 60 may further include equipment for separating out dissolved water-soluble minerals and/or migratory contaminant species. Equipment for separating out components and treating produced water are discussed more fully below in connection with FIG. 6.

Figure 2A:
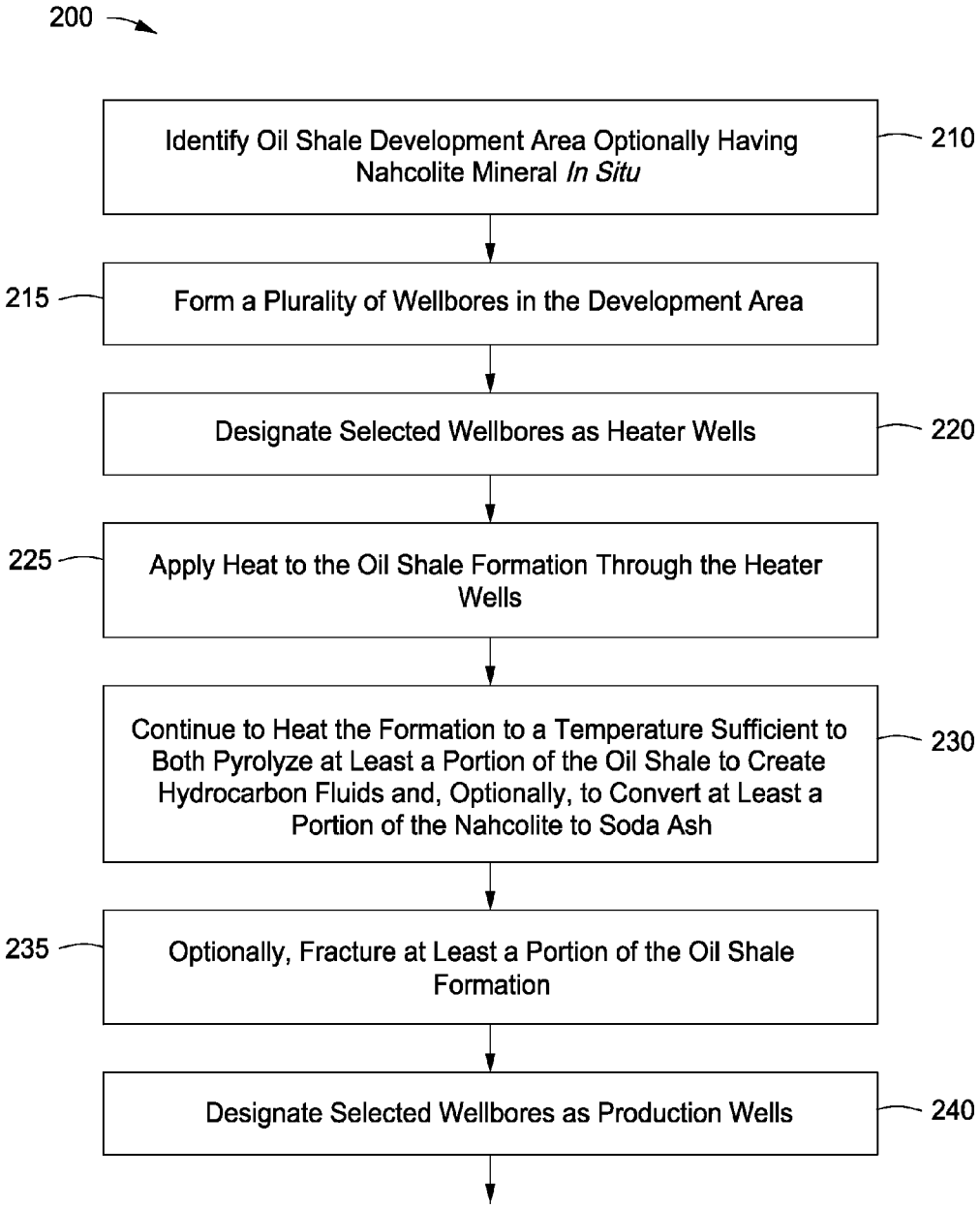
FIGS. 2A-2B present a unified flow chart demonstrating a general method of in situ thermal recovery of oil and gas from an organic-rich rock formation, in one embodiment.
Figure 2B:
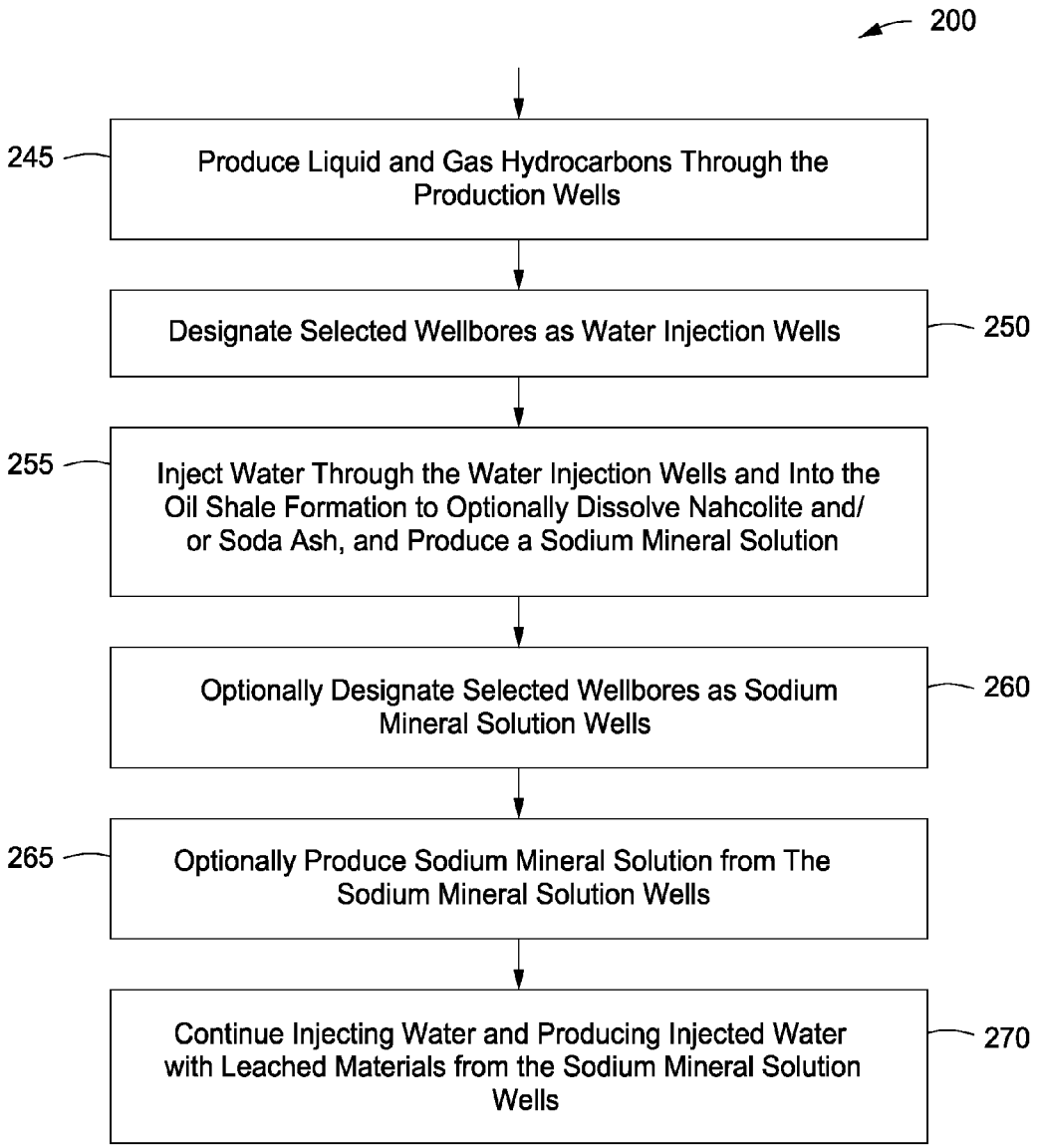

In order to recover oil, gas, and sodium bicarbonate (or other water-soluble minerals), a series of steps may be undertaken. FIG. 2 presents a flow chart demonstrating a method 200 of in situ thermal recovery of oil and gas from an organic-rich rock formation, in one embodiment. It is understood that the order of some of the steps from FIG. 2 may be changed, and that the sequence of steps is merely for illustration.

First, an oil shale development area 12 is identified. This step is shown in Box 210. The oil shale development area includes an oil shale (or other organic-rich rock) formation 22. Optionally, the oil shale formation 22 contains nahcolite or other sodium minerals.

The targeted development area 12 within the oil shale formation 22 may be identified by measuring or modeling the depth, thickness and organic richness of the oil shale as well as evaluating the position of the formation 22 relative to other rock types, structural features (e.g. faults, anticlines or synclines), or hydrogeological units (i.e. aquifers). This is accomplished by creating and interpreting maps and/or models of depth, thickness, organic richness and other data from available tests and sources. This may involve performing geological surface surveys, studying outcrops, performing seismic surveys, and/or drilling boreholes to obtain core samples from subsurface rock.

In some fields, formation hydrocarbons, such as oil shale, may exist in more than one subsurface formation. In some instances, the organic-rich rock formations may be separated by rock layers that are hydrocarbon-free or that otherwise have little or no commercial value. Therefore, it may be desirable for the operator of a field under hydrocarbon development to undertake an analysis as to which of the subsurface, organic-rich rock formations to target or in which order they should be developed.

The organic-rich rock formation may be selected for development based on various factors. One such factor is the thickness of the hydrocarbon-containing layer within the formation. Greater pay zone thickness may indicate a greater potential volumetric production of hydrocarbon fluids. Each of the hydrocarbon-containing layers may have a thickness that varies depending on, for example, conditions under which the formation hydrocarbon-containing layer was formed. Therefore, an organic-rich rock formation 22 will typically be selected for treatment if that formation includes at least one formation hydrocarbon-containing layer having a thickness sufficient for economical production of produced hydrocarbon fluids.

An organic-rich rock formation 22 may also be chosen if the thickness of several layers that are closely spaced together is sufficient for economical production of produced fluids. For example, an in situ conversion process for formation hydrocarbons may include selecting and treating a layer within an organic-rich rock formation having a thickness of greater than about 5 meters, 10 meters, 50 meters, or even 100 meters. In this manner, heat losses (as a fraction of total injected heat) to layers formed above and below an organic-rich rock formation may be less than such heat losses from a thin layer of formation hydrocarbons.

The richness of one or more organic-rich rock formations may also be considered. For an oil shale formation, richness is generally a function of the kerogen content. The kerogen content of an oil shale formation may be ascertained from outcrop or core samples using a variety of data. Such data may include organic carbon content, hydrogen index, and modified Fischer assay analyses. The Fischer Assay is a standard method which involves heating a sample of a formation hydrocarbon containing layer to approximately 500° C. in one hour, collecting fluids produced from the heated sample, and quantifying the amount of fluids produced.

Richness may depend on many factors including the conditions under which the formation hydrocarbon-containing layer was formed, an amount of formation hydrocarbons in the layer, and/or a composition of formation hydrocarbons in the layer. A thin and rich formation hydrocarbon layer may be able to produce significantly more valuable hydrocarbons than a much thicker, less rich formation hydrocarbon layer. Of course, producing hydrocarbons from a formation that is both thick and rich is desirable.

Subsurface formation permeability may also be assessed via rock samples, outcrops, or studies of ground water flow. Furthermore the connectivity of the development area to ground water sources may be assessed. Thus, an organic-rich rock formation may be chosen for development based on the permeability or porosity of the formation matrix even if the thickness of the formation is relatively thin. Reciprocally, an organic-rich rock formation may be rejected if there appears to be a likelihood of fluid communication with a formation containing groundwater.

Other factors known to petroleum engineers may be taken into consideration when selecting a formation for development. Such factors include depth of the perceived pay zone, continuity of thickness, and other factors. For instance, the assessed fluid production content within a formation will also effect eventual volumetric production.

Next, a plurality of wellbores 14, 16 is formed across the targeted development area 10. This step is shown schematically in Box 215. The purposes of the wellbores 14, 16 are set forth above and need not be repeated. However, it is noted that for purposes of the wellbore formation step of Box 215, only a portion of the wellbores need be completed initially. For instance, at the beginning of the project, heat injection wells are needed, while a majority of the hydrocarbon production wells are not yet needed. Production wells may be brought in once conversion begins, such as after 4 to 12 months of heating.

The purpose for heating the organic-rich rock formation is to pyrolyze at least a portion of the solid formation hydrocarbons to create hydrocarbon fluids. The solid formation hydrocarbons may be pyrolyzed in situ by raising the organic-rich rock formation, (or zones within the formation), to a pyrolysis temperature. In certain embodiments, the temperature of the formation may be slowly raised through the pyrolysis temperature range. For example, an in situ conversion process may include heating at least a portion of the organic-rich rock formation to raise the average temperature of the zone above about 270° C. at a rate less than a selected amount (e.g., about 10° C., 5° C.; 3° C., 1° C., 0.5° C., or 0.1° C.) per day. In a further embodiment, the portion may be heated such that an average temperature of the selected zone may be less than about 375° C. or, in some embodiments, less than about 400° C. (752° F.).

The formation is heated such that a temperature within the formation reaches (at least) an initial pyrolysis temperature, that is, a temperature at the lower end of the temperature range where pyrolysis begins to occur. The pyrolysis temperature range may vary depending on the types of formation hydrocarbons within the formation, the heating methodology, and the distribution of heating sources. For example, a pyrolysis temperature range may include temperatures between about 270° C. and about 900° C. Alternatively, the bulk of the target zone of the formation may be heated to between 300° to 600° C. In an alternative embodiment, a pyrolysis temperature range may include temperatures between about 270° C. to about 500° C.

It is understood that petroleum engineers will develop a strategy for the best depth and arrangement for the wellbores 14, 16, depending upon anticipated reservoir characteristics, economic constraints, and work scheduling constraints. In addition, engineering staff will determine what wellbores 14, 16 shall be used for initial formation 22 heating. This selection step is represented by Box 220.

Concerning heat injection wells, there are various methods for applying heat to the organic-rich rock formation 22. The methods disclosed herein are not limited to the heating technique employed unless specifically so stated in the claims. The heating step is represented generally by Box 225.

The organic-rich rock formation 22 is heated to a temperature sufficient to pyrolyze at least a portion of the oil shale in order to convert the kerogen to hydrocarbon fluids. The conversion step is represented in FIG. 2 by Box 230. The resulting liquids and hydrocarbon gases may be refined into products which resemble common commercial petroleum products. Such liquid products include transportation fuels such as diesel, jet fuel and naphtha. Generated gases include light alkanes, light alkenes, $H_2$, $CO_2$, CO, and $NH_3$.

Conversion of oil shale into hydrocarbon fluids may increase permeability in rocks in the formation 22 that were originally substantially impermeable. For example, permeability may increase due to formation of thermal fractures within a heated portion caused by application of heat. As the temperature of the heated portion increases, water may be removed due to vaporization. The vaporized water may escape and/or be removed from the formation. In addition, permeability of the heated portion may also increase as a result of production of hydrocarbon fluids from pyrolysis of at least some of the formation hydrocarbons within the heated portion on a macroscopic scale.

In one embodiment, the organic-rich rock formation has an initial total permeability less than 1 millidarcy, alternatively less than 0.1 or 0.01 millidarcies, before heating the organic-rich rock formation. Permeability of a selected zone within the heated portion of the organic-rich rock formation 22 may rapidly increase while the selected zone is heated by conduction. For example, pyrolyzing at least a portion of organic-rich rock formation may increase permeability within a selected zone of the portion to about 1 millidarcy, alternatively, greater than about 10 millidarcies, 50 millidarcies, 100 millidarcies, 1 Darcy, 10 Darcies, 20 Darcies, or 50 Darcies. Therefore, a permeability of a selected zone of the portion may increase by a factor of more than about 10, 100, 1,000, 10,000, or 100,000.

Preferably, for in situ processes the heating and conversion processes of Boxes 225 and 230, occur over a lengthy period of time. In one aspect, the heating period is from three months to four or more years. Alternatively, the formation may be heated for one to fifteen years, alternatively, 3 to 10 years, 1.5 to 7 years, or 2 to 5 years. Also as an optional part of Box 230, the formation 22 may be heated to a temperature sufficient to convert at least a portion of nahcolite, if present, to soda ash. In this respect, heat applied to mature the oil shale and recover oil and gas will also convert nahcolite to sodium carbonate (soda ash), a related sodium mineral. The process of converting nahcolite (sodium bicarbonate) to soda ash (sodium carbonate) is described herein.

In connection with the heating step 225 and the conversion step 230, the organic-rich rock formation 22 may optionally be fractured to aid heat transfer or later hydrocarbon fluid production. The optional fracturing step is shown in Box 235. Fracturing may be accomplished by creating thermal fractures within the formation through the application of heat. By heating the organic-rich rock and transforming the kerogen to oil and gas, the permeability of portions of the formation 22 are increased via thermal fracture formation and subsequent production of a portion of the hydrocarbon fluids generated from the kerogen. Alternatively, a process known as hydraulic fracturing may be used. Hydraulic fracturing is a process known in the art of oil and gas recovery where an injection fluid is pressurized within the wellbore above the fracture pressure of the formation, thus developing fracture planes within the formation to relieve the pressure generated within the wellbore. Hydraulic fractures may be used to create additional permeability in portions of the formation 22 and/or be used to provide a planar source for heating.

International patent publication WO 2005/010320 entitled "Methods of Treating a Subterranean Formation to Convert Organic Matter into Producible Hydrocarbons" describes one use of hydraulic fracturing, and is incorporated herein by reference in its entirety. This international patent publication teaches the use of electrically conductive fractures to heat oil shale. A heating element is constructed by forming wellbores and then hydraulically fracturing the oil shale formation around the wellbores. The fractures are filled with an electrically conductive material which forms the heating element. Calcined petroleum coke is an exemplary suitable conductant material. Preferably, the fractures are created in a vertical orientation extending from horizontal wellbores. Electricity may be conducted through the conductive fractures from the heel to the toe of each well. The electrical circuit may be completed by an additional horizontal well that intersects one or more of the vertical fractures near the toe to supply the opposite electrical polarity. The WO 2005/010320 process creates an "in situ toaster" that artificially matures oil shale through the application of electric heat. Thermal conduction heats the oil shale to conversion temperatures in excess of 300° C., causing artificial maturation.

It is noted that U.S. Pat. No. 3,137,347 also describes the use of granular conductive materials to connect subsurface electrodes for the in situ heating of oil shale. The '347 patent envisions the granular material being a primary source of heat until the oil shale undergoes pyrolysis. At that point, the oil shale itself is said to become electrically conductive. Heat generated within the formation and heat conducted into the surrounding formation due to the passing of current through the shale oil material itself is claimed to generate hydrocarbon fluids for production.

Co-owned U.S. Prov. Pat. Appl. No. 61/109,369 is also instructive. That application was filed on Oct. 29, 2008 and is entitled "Electrically Conductive Methods for Heating a Subsurface Formation to Convert Organic Matter into Hydrocarbon Fluids." That application teaches the use of two or more materials placed within an organic-rich rock formation and having varying properties of electrical resistance. An electrical current is passed through the materials in the formation to generate resistive heat. The materials placed in situ provide for resistive heat without creating hot spots near the wellbores. The technical disclosures in that pending application are incorporated herein by reference in their entireties.

As part of the hydrocarbon fluid production process 200, certain wellbores 16 may be designated as oil and gas production wells. This step is depicted by Box 240. Oil and gas production might not be initiated until it is determined that the kerogen has been sufficiently retorted to allow a steady flow of oil and gas from the formation 22. In some instances, dedicated production wells are not drilled until after heat injection wells 14 (Box 225) have been in operation for a period of several weeks or months. Thus, Box 240 may include the formation of additional wellbores 16 for production. In other instances, selected heater wells are converted to production wells.

After certain wellbores 16 have been designated as oil and gas production wells, oil and/or gas is produced from the wellbores 16. The oil and/or gas production process is shown at Box 245. At this stage (Box 245), any water-soluble minerals, such as nahcolite and converted soda ash likely remain substantially trapped in the organic-rich rock formation 22 as finely disseminated crystals or nodules within the oil shale beds, and are not produced. However, some nahcolite and/or soda ash may be dissolved in the water created during heat conversion (Box 235) within the formation. Thus, production fluids may contain not only hydrocarbon fluids, but also aqueous fluid containing water-soluble minerals. In such a case, the production fluids may be separated into a hydrocarbon stream and an aqueous stream at a production fluids processing facility 60. Thereafter, the water-soluble minerals and any migratory contaminant species may be recovered from the aqueous stream as discussed more fully below.

Box 250 presents an optional next step in the oil and gas recovery method 100. Here, certain wellbores 14 are designated as water or aqueous fluid injection wells. This is preferably done after the production wells have ceased operation.

The aqueous fluids used for the injection wells are solutions of water with other species. The water may constitute "brine," and may include dissolved inorganic salts of chloride, sulfates and carbonates of Group I and II elements of The Periodic Table of Elements. Organic salts can also be present in the aqueous fluid. The water may alternatively be fresh water containing other species. The other species may be present to alter the pH. Alternatively, the other species may reflect the availability of brackish water not saturated in the species wished to be leached from the subsurface. Preferably, wellbores 14 used for the water injection wells are selected from some or all of the wellbores initially used for heat injection or for oil and/or gas production. However, the scope of the step of Box 250 may include the drilling of yet additional wellbores 14 for use as dedicated water injection wells.

It is noted that in the arrangement of FIG. 1, the wellbores 14 for the water injection wells are completed along a periphery of the development area 10. This serves to create a boundary of high pressure. However, as discussed above other arrangements for water injection wells may be employed.

Next, water or an aqueous fluid is injected through the water injection wells and into the oil shale formation 22. This step is shown at Box 255. The water may be in the form of steam or pressurized hot water. Alternatively, the injected water may be cool and becomes heated as it contacts the previously heated formation. The injection process may further induce fracturing. This process may create fingered caverns and brecciated zones in the nahcolite-bearing intervals some distance, for example up to 200 feet out, from the water injection wellbores 14. In one aspect, a gas cap, such as nitrogen, may be maintained at the top of each "cavern" to prevent vertical growth.

Along with the designation of certain wellbores 14 as water injection wells, the design engineers may also designate certain wellbores 14 as water or water-soluble mineral solution production wells. This step is shown in Box 260. These wells may be the same as wells used to previously produce hydrocarbons. These recovery wells may be used to produce an aqueous solution of dissolved water-soluble minerals. For example, the solution may be one primarily of dissolved soda ash. This step is shown in Box 265. Alternatively, single wellbores may be used to both inject water and then to recover a sodium mineral solution. Thus, Box 265 includes the option of using the same wellbores 14 for both water injection and water or aqueous-solution production (Box 265).

In one aspect, an operator may calculate a pore volume of the oil shale formation after production is completed. The operator will then circulate an amount of water equal to one pore volume for the primary purpose of producing the aqueous solution of dissolved soda ash and other water-soluble sodium minerals. The operator may then circulate an amount of water equal to two, three, four, five, or even six additional pore volumes for the purpose of leaching out any remaining water-soluble minerals and other non-aqueous species, including, for example, hydrocarbons and migratory contaminant species. The produced water, or leachate, is carried through a water treatment facility as outlined below in connection with FIGS. 7 through-9. The step of injecting water and then recovering the injected water with leached minerals is demonstrated in Box 270.

During the pyrolysis process, migration of hydrocarbon fluids and migratory contaminant species may be obtained by creating a peripheral area in which the temperature of the formation is maintained below a pyrolysis temperature. Preferably, temperature of the formation is maintained below the freezing temperature of in situ water. The use of subsurface freezing to stabilize poorly consolidated soils or to provide a barrier to fluid flow is known in the art. Shell Exploration and Production Company has discussed the use of freeze walls for oil shale production in several patents, including U.S. Pat. No. 6,880,633 and U.S. Pat. No. 7,032,660. Shell's '660 patent uses subsurface freezing to protect against groundwater flow and groundwater contamination during in situ shale oil production. Additional patents that disclose the use of so-called freeze walls are U.S. Pat. No. 3,528,252, U.S. Pat. No. 3,943,722, U.S. Pat. No. 3,729,965, U.S. Pat. No. 4,358,222, U.S. Pat. No. 4,607,488, and WO Pat. No. 98996480.

Freeze walls may be formed by circulating refrigerant through peripheral wells to substantially reduce the temperature of the rock formation 22. This, in turn, prevents the pyrolyzation of kerogen present at the periphery of the field and the outward migration of oil and gas. Freeze walls will also cause native water in the formation along the periphery to freeze. This serves to prevent the migration of pyrolyzed fluids into ground water outside of the field.

Once production of hydrocarbons begins, control of the migration of hydrocarbons and migratory contaminant species can be obtained via selective placement of injection 16 and production wells 14 such that fluid flow out of the heated zone is minimized. Typically, this involves placing injection wells at the periphery of the heated zone so as to cause pressure gradients which prevent flow inside the heated zone from leaving the zone. The injection wells may inject water, steam, $CO_2$, heated methane, or other fluids to drive cracked kerogen fluids inwardly towards production wells.

Figure 3:
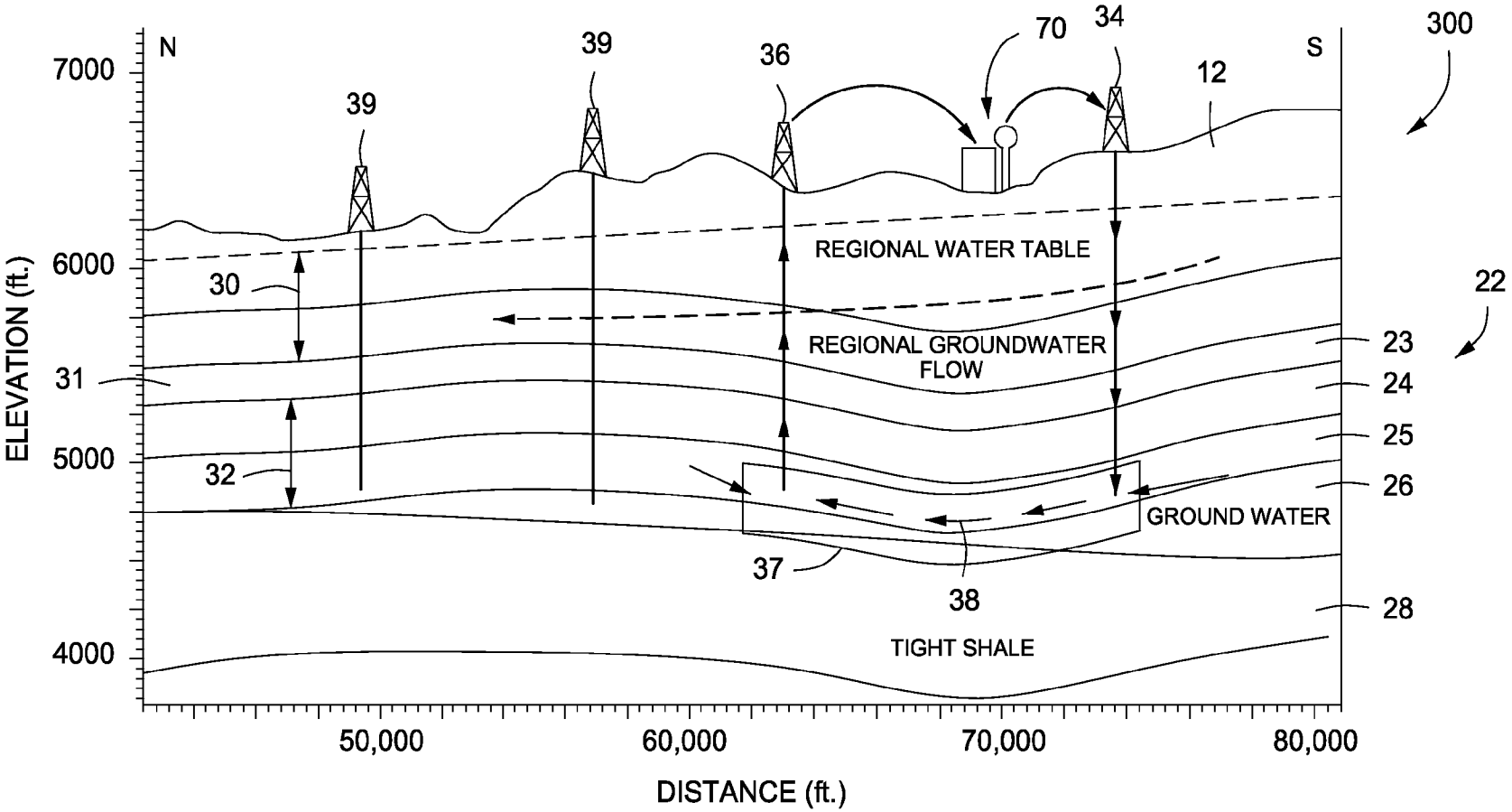
FIG. 3 is a cross-sectional side view of an illustrative oil shale formation that is within or connected to groundwater aquifers, and a formation leaching operation.

The circulation of water through a shale oil formation is shown in one embodiment in FIG. 3. FIG. 3 presents a field 300 under hydrocarbon development. FIG. 3 is a cross-sectional view of an illustrative oil shale formation 22 within the field 300. The formation 22 is within or connected to ground water aquifers and a formation leaching operation. Four separate oil shale formation zones 23, 24, 25, and 26 are depicted within the oil shale formation. The water aquifers are below the ground surface 12, and are categorized as an upper aquifer 30 and a lower aquifer 32. Intermediate the upper 30 and lower 32 aquifers is an aquitard 31. It can be seen that certain zones of the formation 22 are both aquifers or aquitards and oil shale zones. A pair of wells 34, 36 is shown traversing vertically downward through the aquifers 30, 32. One of the wells is serving as a water injection well 34, while another is serving as a water production well 36. In this way, water is circulated 38 through at least the lower aquifer 32.

FIG. 3 shows diagrammatically water circulating 38 through an oil shale volume 37 that was heated, that resides within or is connected to the lower aquifer 32, and from which hydrocarbon fluids were previously recovered. Introduction of water via the water injection well 34 forces water into the previously heated oil shale 37 and water-soluble minerals and migratory contaminants species are swept to the water production well 36. The water may then be processed in a facility wherein the water-soluble minerals (e.g. nahcolite or soda ash) and the migratory contaminants may be substantially removed from the water stream.

Water is re-injected into the oil shale volume 37 and the formation leaching is repeated. This leaching with water is intended to continue until levels of migratory contaminant species are at environmentally acceptable levels within the previously heated oil shale zone 37. This may require one cycle, two cycles, five cycles or more cycles of formation leaching, where a single cycle indicates injection and production of approximately one pore volume of water.

It is understood that there may be numerous water injection 34 and water production 36 wells in an actual oil shale development 10. Moreover, the system may include one or more monitoring wells 39 disposed at selected points in the field. The monitoring wells 39 can be utilized during the oil shale heating phase, the shale oil production phase, the leaching phase, or during any combination of these phases to monitor for migratory contaminant species and/or water-soluble minerals. Further, the monitoring wells 39 may be configured with one or more devices that measure a temperature, a pressure, and/or a property of a fluid in the wellbore. In some instances, a production well may also serve as a monitoring well, or otherwise be instrumented.

As noted above, several different types of wells may be used in the development of an organic-rich rock formation, including, for example, an oil shale field. For example, the heating of the organic-rich rock formation may be accomplished through the use of heater wells. The heater wells may include, for example, electrical resistance heating elements. In one aspect, the resistive heat is generated primarily from electrically conductive material injected into the formation from wellbores. An electrical current is then passed through the conductive material so that electrical energy is converted to thermal energy. The thermal energy is transported to the formation by thermal conduction to heat the organic-rich rocks.

The production of hydrocarbon fluids from the formation may be accomplished through the use of wells completed for the production of fluids. The injection of an aqueous fluid may be accomplished through the use of injection wells. Finally, the production of an aqueous solution may be accomplished through use of solution production wells.

The different wells listed above may be used for more than one purpose. Stated another way, wells initially completed for one purpose may later be used for another purpose, thereby lowering project costs and/or decreasing the time required to perform certain tasks. For example, one or more of the production wells may also be used as injection wells for later injecting water into the organic-rich rock formation. Alternatively, one or more of the production wells may also be used as water production wells for later circulating an aqueous solution through the organic-rich rock formation in order to leach out migratory contaminant species.

In other aspects, production wells (and in some circumstances heater wells) may initially be used as dewatering wells (e.g., before heating is begun and/or when heating is initially started). In addition, in some circumstances dewatering wells can later be used as production wells (and in some circumstances heater wells). As such, the dewatering wells may be placed and/or designed so that such wells can be later used as production wells and/or heater wells. The heater wells may be placed and/or designed so that such wells can be later used as production wells and/or dewatering wells. The production wells may be placed and/or designed so that such wells can be later used as dewatering wells and/or heater wells. Similarly, injection wells may be wells that initially were used for other purposes (e.g., heating, production, dewatering, monitoring, etc.), and injection wells may later be used for other purposes. Similarly, monitoring wells may be wells that initially were used for other purposes (e.g., heating, production, dewatering, injection, etc.). Finally, monitoring wells may later be used for other purposes such as water production.

It is desirable to arrange the heater wells and production wells for an oil shale field in a pre-planned pattern. For instance, heater wells may be arranged in a variety of patterns including, but not limited to triangles, squares, hexagons, and other polygons. The pattern may include a regular polygon to promote uniform heating through at least the portion of the formation in which the heater wells are placed. The pattern may also be a line drive pattern. A line drive pattern generally includes a first linear array of heater wells, a second linear array of heater wells, and a production well or a linear array of production wells between the first and second linear array of heater wells.

The arrays of heater wells may be disposed such that a distance between each heater well is less than about 70 feet (21 meters). A portion of the formation may be heated with heater wells disposed substantially parallel to a boundary of the hydrocarbon formation. In alternative embodiments, the array of heater wells may be disposed such that a distance between each heater well may be less than about 100 feet, or 50 feet, or 30 feet. Regardless of the arrangement of or distance between the heater wells, in certain embodiments, a ratio of heater wells to production wells disposed within a organic-rich rock formation may be greater than about 5, 8, 10, 20, or more.

Interspersed among the heater wells are typically one or more production wells. In one embodiment, individual production wells are surrounded by at most one layer of heater wells. This may include arrangements such as 5-spot, 7-spot, or 9-spot arrays, with alternating rows of production and heater wells. In another embodiment, two layers of heater wells may surround a production well, but with the heater wells staggered so that a clear pathway exists for the majority of flow away from the further heater wells. Flow and reservoir simulations may be employed to assess the pathways and temperature history of hydrocarbon fluids generated in situ as they migrate from their points of origin to production wells.

Figure 4:
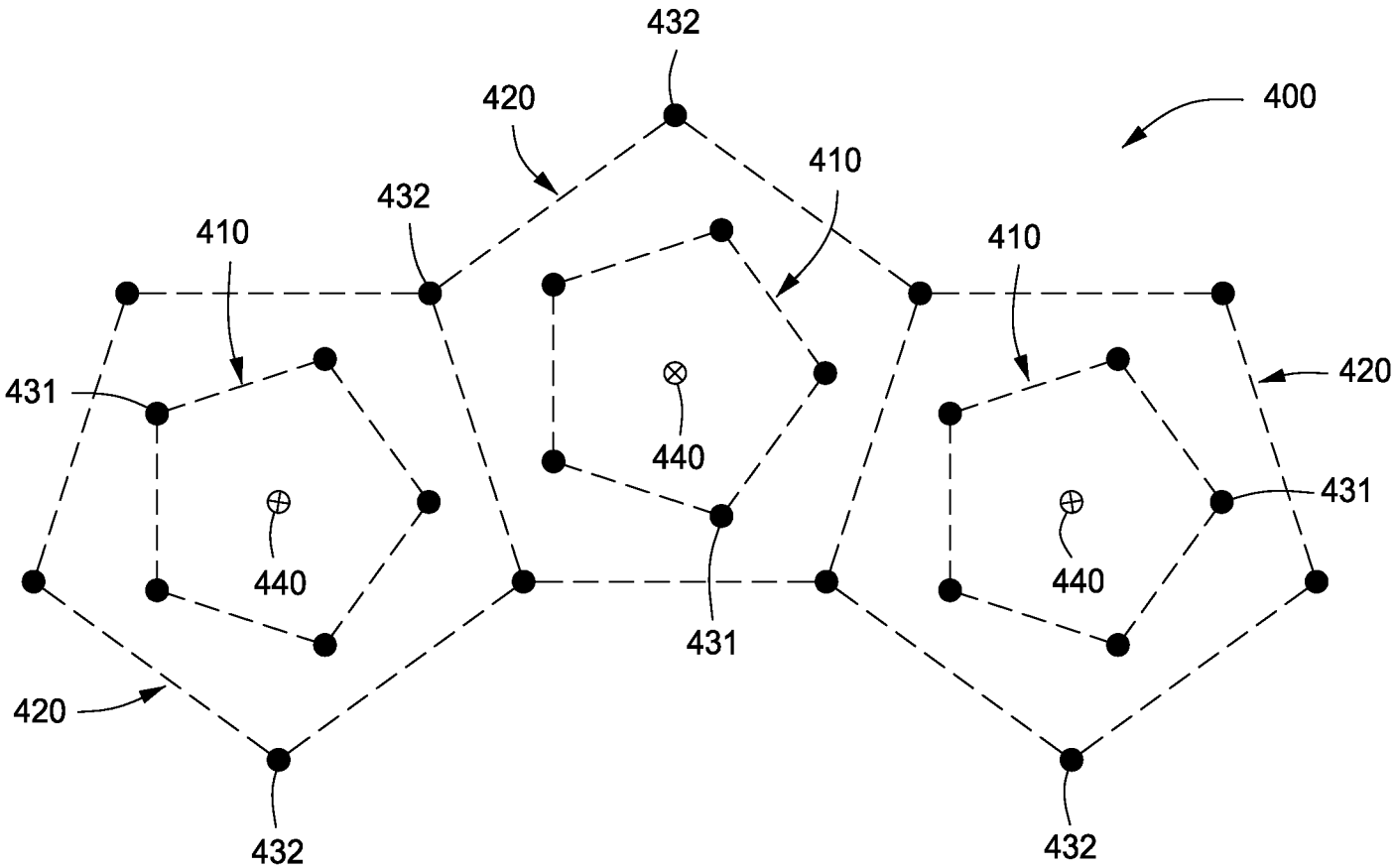
FIG. 4 is a plan view of an illustrative heater well pattern. Two layers of heater wells are shown around respective production wells.

FIG. 4 provides a plan view of an illustrative heater well arrangement using more than one layer of heater wells. The heater well arrangement is used in connection with the production of hydrocarbons from a shale oil development area 400. In FIG. 4, the heater well arrangement employs a first layer of heater wells 410, surrounded by a second layer of heater wells 420. The heater wells in the first layer 410 are referenced at 431, while the heater wells in the second layer 420 are referenced at 432.

A production well 440 is shown central to the well layers 410 and 420. It is noted that the heater wells 432 in the second layer 420 of wells are offset from the heater wells 431 in the first layer 410 of wells, relative to the production well 440. The purpose is to provide a flowpath for converted hydrocarbons that minimizes travel near a heater well in the first layer 410 of heater wells. This, in turn, minimizes secondary cracking of hydrocarbons converted from kerogen as hydrocarbons flow from the second layer of wells 420 to the production wells 440.

In the illustrative arrangement of FIG. 4, the first layer 410 and the second layer 420 each defines a 5-spot pattern. However, it is understood that other patterns may be employed, such as 3-spot or 6-spot patterns. In any instance, a plurality of heater wells 431 comprising a first layer of heater wells 410 is placed around a production well 440, with a second plurality of heater wells 432 comprising a second layer of heater wells 420 placed around the first layer 410.

The heater wells in the two layers also may be arranged such that the majority of hydrocarbons generated by heat from each heater well 432 in the second layer 420 are able to migrate to a production well 440 without passing substantially near a heater well 431 in the first layer 410. The heater wells 431, 432 in the two layers 410, 420 further may be arranged such that the majority of hydrocarbons generated by heat from each heater well 432 in the second layer 420 are able to migrate to the production well 440 without passing through a zone of substantially increasing formation temperature.

In some instances it may be desirable to use well patterns that are elongated in a particular direction, particularly in a direction determined to provide the most efficient thermal conductivity. Heat convection may be affected by various factors such as bedding planes and stresses within the formation. For instance, heat convection may be more efficient in the direction perpendicular to the least horizontal principal stress on the formation. In some instances, heat convection may be more efficient in the direction parallel to the least horizontal principal stress. Elongation may be practiced in, for example, line drive patterns or spot patterns.

In connection with the development of a shale oil field, it may be desirable that the progression of heat through the subsurface in accordance with steps 230 and 235 be uniform. However, for various reasons the heating and maturation of formation hydrocarbons in a subsurface formation may not proceed uniformly despite a regular arrangement of heater and production wells. Heterogeneities in the oil shale properties and formation structure may cause certain local areas to be more or less efficient in terms of pyrolysis. Moreover, formation fracturing which occurs due to the heating and maturation of the oil shale can lead to an uneven distribution of preferred pathways and, thus, increase flow to certain production wells and reduce flow to others. Uneven fluid maturation may be an undesirable condition since certain subsurface regions may receive more heat energy than necessary where other regions receive less than desired. This, in turn, leads to the uneven flow and recovery of production fluids. Produced oil quality, overall production rate, and/or ultimate recoveries may be reduced.

To detect uneven flow conditions, production and heater wells may be instrumented with sensors. Sensors may include equipment to measure temperature, pressure, flow rates, and/or compositional information. Data from these sensors can be processed via simple rules or input to detailed simulations to reach decisions on how to adjust heater and production wells to improve subsurface performance. Production well performance may be adjusted by controlling backpressure or throttling on the well. Heater well performance may also be adjusted by controlling energy input. Sensor readings may also sometimes imply mechanical problems with a well or downhole equipment which requires repair, replacement, or abandonment.

In one embodiment, flow rate, compositional, temperature and/or pressure data are utilized from two or more wells as inputs to a computer algorithm to control heating rate and/or production rates. Unmeasured conditions at or in the neighborhood of the well are then estimated and used to control the well. For example, in situ fracturing behavior and kerogen maturation are estimated based on thermal, flow, and compositional data from a set of wells. In another example, well integrity is evaluated based on pressure data, well temperature data, and estimated in situ stresses. In a related embodiment the number of sensors is reduced by equipping only a subset of the wells with instruments, and using the results to interpolate, calculate, or estimate conditions at uninstrumented wells. Certain wells may have only a limited set of sensors (e.g., wellhead temperature and pressure only) where others have a much larger set of sensors (e.g., wellhead temperature and pressure, bottomhole temperature and pressure, production composition, flow rate, electrical signature, casing strain, etc.).

As noted above, there are various methods for applying heat to an organic-rich rock formation. For example, one method may include electrical resistance heaters disposed in a wellbore or outside of a wellbore. One such method involves the use of electrical resistive heating elements in a cased or uncased wellbore. Electrical resistance heating involves directly passing electricity through a conductive material such that resistive losses cause it to heat the conductive material. Other heating methods include the use of downhole combustors, in situ combustion, radio-frequency (RF) electrical energy, or microwave energy. Still others include injecting a hot fluid into the oil shale formation to directly heat it. The hot fluid may or may not be circulated.

One method for formation heating involves the use of electrical resistors in which an electrical current is passed through a resistive material which dissipates the electrical energy as heat. This method is distinguished from dielectric heating in which a high-frequency oscillating electric current induces electrical currents in nearby materials and causes them to heat. The electric heater may include an insulated conductor, an elongated member disposed in the opening, and/or a conductor disposed in a conduit. An early patent disclosing the use of electrical resistance heaters to produce oil shale in situ is U.S. Pat. No. 1,666,488. The '488 patent issued to Crawshaw in 1928. Since 1928, various designs for downhole electrical heaters have been proposed. Illustrative designs are presented in U.S. Pat. No. 1,701,884, U.S. Pat. No. 3,376,403, U.S. Pat. No. 4,626,665, U.S. Pat. No. 4,704,514, and U.S. Pat. No. 6,023,554).

In the production of oil and gas resources, it may be desirable to use the produced hydrocarbons as a source of power for ongoing operations. This may be applied to the development of oil and gas resources from oil shale. In this respect, when electrically resistive heaters are used in connection with in situ shale oil recovery, large amounts of power are required.

Electrical power may be obtained from turbines that turn generators. It may be economically advantageous to power the gas turbines by utilizing produced gas from the field. However, such produced gas must be carefully controlled so not to damage the turbine, cause the turbine to misfire, or generate excessive pollutants (e.g., $NO_x$).

One source of problems for gas turbines is the presence of contaminants within the fuel. Contaminants include solids, water, heavy components present as liquids, and hydrogen sulfide. Additionally, the combustion behavior of the fuel is important. Combustion parameters to consider include heating value, specific gravity, adiabatic flame temperature, flammability limits, autoignition temperature, autoignition delay time, and flame velocity. Wobbe Index (WI) is often used as a key measure of fuel quality. WI is equal to the ratio of the lower heating value to the square root of the gas specific gravity. Control of the fuel's Wobbe Index to a target value and range of, for example, ±10% or ±20% can allow simplified turbine design and increased optimization of performance.

Fuel quality control may be useful for shale oil developments where the produced gas composition may change over the life of the field and where the gas typically has significant amounts of $CO_2$, CO, and $H_2$ in addition to light hydrocarbons. Commercial scale oil shale retorting is expected to produce a gas composition that changes with time.

Inert gases in the turbine fuel can increase power generation by increasing mass flow while maintaining a flame temperature in a desirable range. Moreover inert gases can lower flame temperature and thus reduce $NO_x$ pollutant generation. Gas generated from oil shale maturation may have significant $CO_2$ content. Therefore, in certain embodiments of the production processes, the $CO_2$ content of the fuel gas is adjusted via separation or addition in the surface facilities to optimize turbine performance.

Achieving a certain hydrogen content for low-BTU fuels may also be desirable to achieve appropriate burn properties. In certain embodiments of the processes herein, the $H_2$ content of the fuel gas is adjusted via separation or addition in the surface facilities to optimize turbine performance. Adjustment of $H_2$ content in non-shale oil surface facilities utilizing low BTU fuels has been discussed in the patent literature (e.g., U.S. Pat. No. 6,684,644 and U.S. Pat. No. 6,858,049, the entire disclosures of which are hereby incorporated by reference).

As noted, the process of heating formation hydrocarbons within an organic-rich rock formation, for example, by pyrolysis, may generate fluids. The heat-generated fluids may include water which is vaporized within the formation. In addition, the action of heating kerogen produces pyrolysis fluids which tend to expand upon heating. The produced pyrolysis fluids may include not only water, but also, for example, hydrocarbons, oxides of carbon, ammonia, molecular nitrogen, and molecular hydrogen. Therefore, as temperatures within a heated portion of the formation increase, pressure within the heated portion may also increase as a result of increased fluid generation, molecular expansion, and vaporization of water. Thus, some corollary exists between subsurface pressure in an oil shale formation and the fluid pressure generated during pyrolysis. This, in turn, indicates that formation pressure may be monitored to detect the progress of a kerogen conversion process.

The pressure within a heated portion of an organic-rich rock formation depends on other reservoir characteristics. These may include, for example, formation depth, distance from a heater well, a richness of the formation hydrocarbons within the organic-rich rock formation, the degree of heating, and/or a distance from a producer well.

It may be desirable for the developer of an oil shale field to monitor formation pressure during development. Pressure within a formation may be determined at a number of different locations. Such locations may include, but may not be limited to, at a wellhead and at varying depths within a wellbore. In some embodiments, pressure may be measured at a producer well. In an alternate embodiment, pressure may be measured at a heater well. In still another embodiment, pressure may be measured downhole of a dedicated monitoring well.

The process of heating an organic-rich rock formation to a pyrolysis temperature range not only will increase formation pressure, but will also increase formation permeability. The pyrolysis temperature range should be reached before substantial permeability has been generated within the organic-rich rock formation. An initial lack of permeability may prevent the transport of generated fluids from a pyrolysis zone within the formation. In this manner, as heat is initially transferred from a heater well to an organic-rich rock formation, fluid pressure within the organic-rich rock formation may increase proximate to that heater well. Such an increase in fluid pressure may be caused by, for example, the generation of fluids during pyrolysis of at least some formation hydrocarbons in the formation.

Alternatively, pressure generated by expansion of pyrolysis fluids or other fluids generated in the formation may be allowed to increase. This assumes that an open path to a production well or other pressure sink does not yet exist in the formation. In one aspect, a fluid pressure may be allowed to increase to or above a lithostatic stress. In this instance, fractures in the hydrocarbon containing formation may form when the fluid pressure equals or exceeds the lithostatic stress. For example, fractures may form from a heater well to a production well. The generation of fractures within the heated portion may reduce pressure within the portion due to the production of produced fluids through a production well.

Once pyrolysis has begun within an organic-rich rock formation, fluid pressure may vary depending upon various factors. These include, for example, thermal expansion of hydrocarbons, generation of pyrolysis fluids, rate of conversion, and withdrawal of generated fluids from the formation. For example, as fluids are generated within the formation, fluid pressure within the pores may increase. Removal of generated fluids from the formation may then decrease the fluid pressure within the near wellbore region of the formation.

In certain embodiments, a mass of at least a portion of an organic-rich rock formation may be reduced due, for example, to pyrolysis of formation hydrocarbons and the production of hydrocarbon fluids from the formation. As such, the permeability and porosity of at least a portion of the formation may increase. Any in situ method that effectively produces oil and gas from oil shale will create permeability in what was originally a very low permeability rock. The extent to which this will occur is illustrated by the large amount of expansion that must be accommodated if fluids generated from kerogen are unable to flow. The concept is illustrated in FIG. 5.

Figure 5:
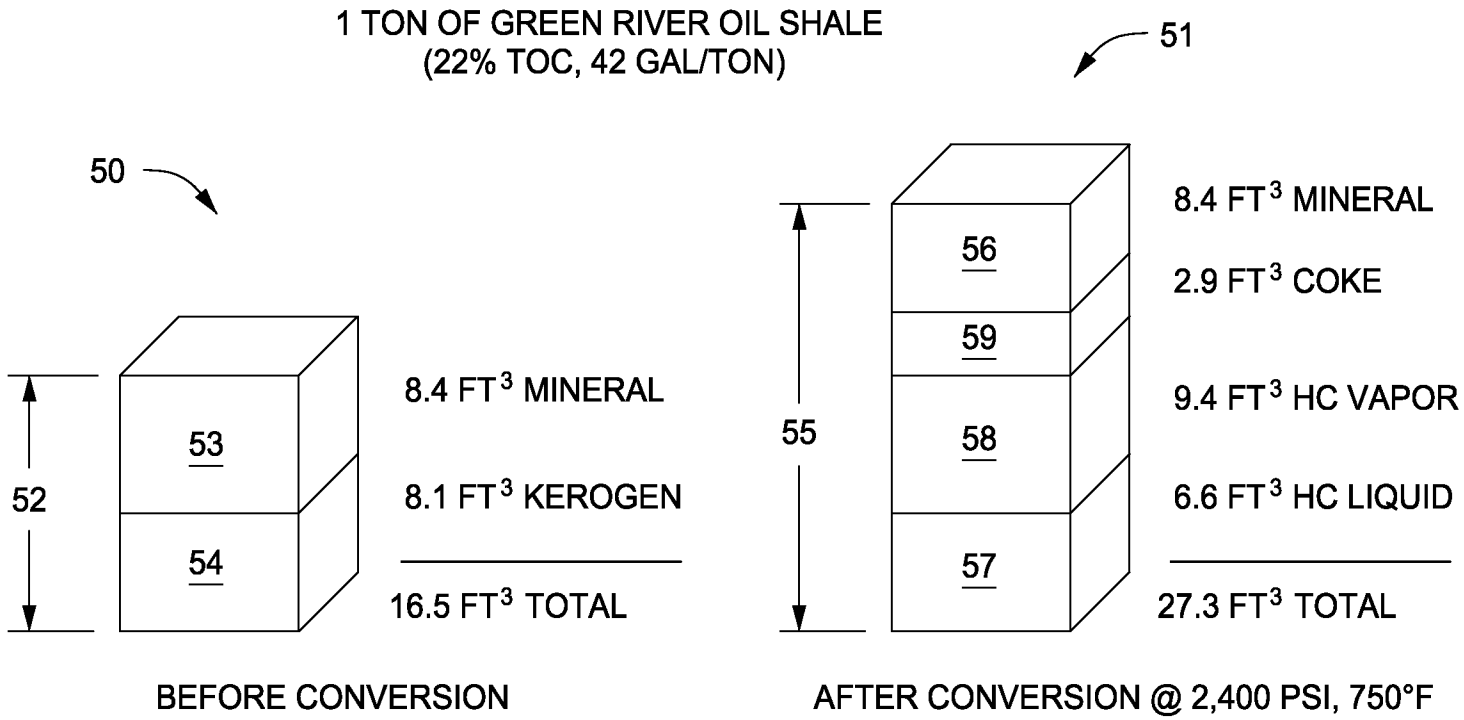
FIG. 5 is a bar chart comparing one ton of Green River oil shale before and after a simulated in situ, retorting process.

FIG. 5 provides a bar chart comparing one ton of Green River oil shale before 50 and after 51 a simulated in situ, retorting process. The simulated process was carried out at 2,400 psi and 750° F. (about 400° C.) on oil shale having a total organic carbon content of 22 wt. % and a Fisher assay of 42 gallons/ton. Before the conversion, a total of 16.5 $ft^3$ of rock matrix 52 existed. This matrix comprised 8.4 $ft^3$ of mineral 53, i.e., dolomite, limestone, etc., and 8.1 $ft^3$ of kerogen 54 imbedded within the shale. As a result of the conversion the material expanded to 27.3 $ft^3$ 55. This represented 8.4 $ft^3$ of mineral 56 (the same number as before the conversion), 6.6 $ft^3$ of hydrocarbon liquid 57, 9.4 $ft^3$ of hydrocarbon vapor 58, and 2.9 $ft^3$ of coke 59. It can be seen that substantial volume expansion occurred during the conversion process. This, in turn, increases permeability of the rock structure.

Figure 6:
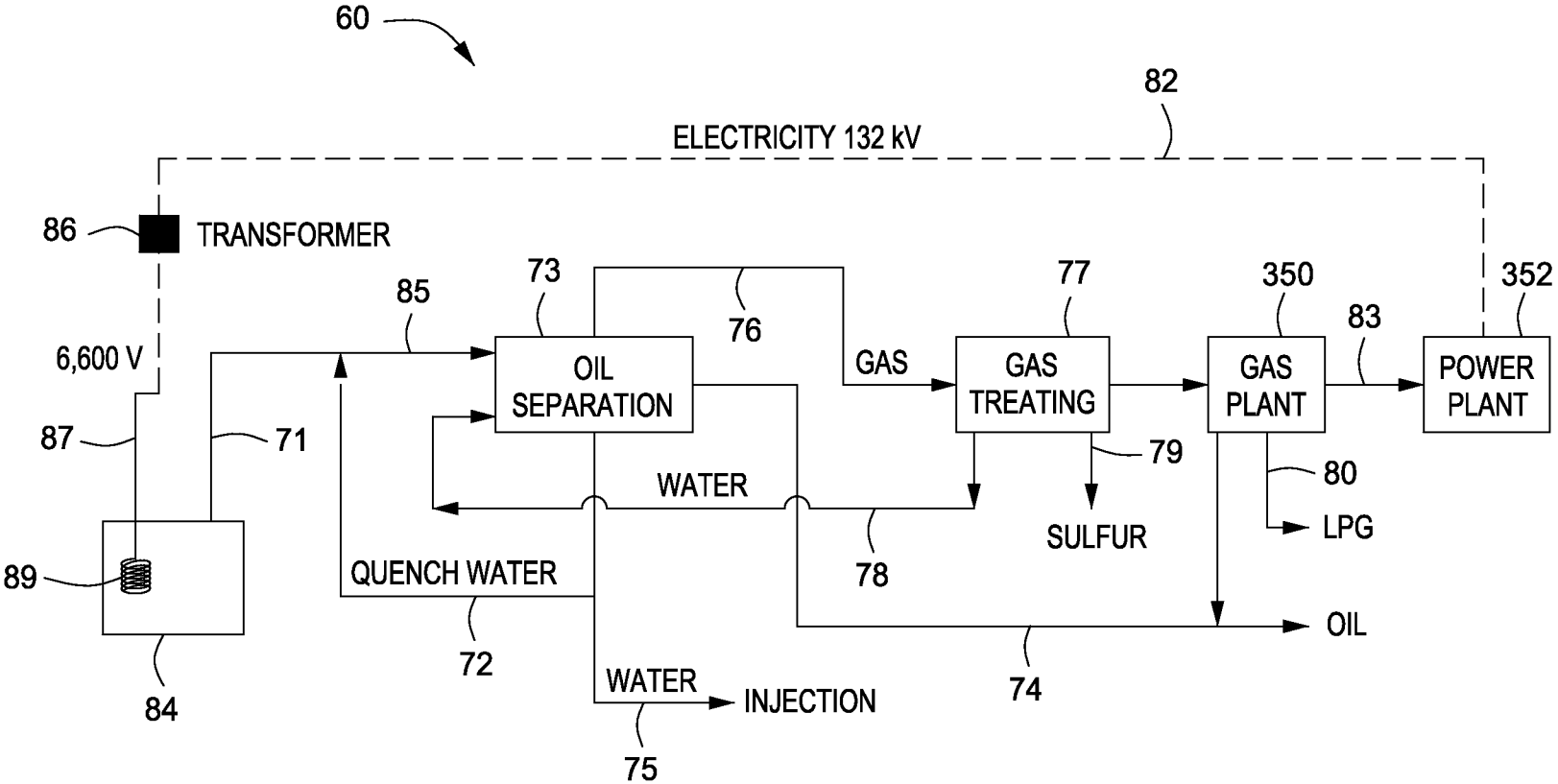
FIG. 6 is a process flow diagram of exemplary surface processing facilities for a subsurface formation development.

Once fluids begin to be produced from subsurface strata, the fluids will be treated. FIG. 6 illustrates a schematic diagram of an embodiment of the production fluids processing facility 60 that may be configured to treat produced fluids. The fluids 85 are produced from a subsurface formation, shown schematically at 84, though a production well 71.

The subsurface formation 84 may be any subsurface formation including, for example, an organic-rich rock formation containing any of oil shale, coal, or tar sands for example. In the illustrative surface facilities 70, the produced fluids are quenched 72 to a temperature below 300° F., 200° F., or even 100° F. This serves to separate out condensable components (i.e., oil 74 and water 75).

The produced fluids 85 may include any of the produced fluids produced by any of the methods as described herein. In the case of in situ oil shale production, produced fluids contain a number of components which may be separated in the fluids processing facility 60. The produced fluids 85 typically contain water 78, noncondensable hydrocarbon alkane species (e.g., methane, ethane, propane, n-butane, isobutane), noncondensable hydrocarbon alkene species (e.g., ethene, propene), condensable hydrocarbon species composed of (alkanes, olefins, aromatics, and polyaromatics among others), $CO_2$, CO, $H_2$, $H_2S$, and $NH_3$. In a surface facility such as fluids processing facility 60, condensable components 74 may be separated from non-condensable components 76 by reducing temperature and/or increasing pressure. Temperature reduction may be accomplished using heat exchangers cooled by ambient air or available water 72. Alternatively, the hot produced fluids may be cooled via heat exchange with produced hydrocarbon fluids previously cooled. The pressure may be increased via centrifugal or reciprocating compressors. Alternatively, or in conjunction, a diffuser-expander apparatus may be used to condense out liquids from gaseous flows. Separations may involve several stages of cooling and/or pressure changes.

In the arrangement of FIG. 6, the fluids processing facility 60 includes an oil separator 73 for separating liquids, or oil 74, from hydrocarbon vapors, or gas 76. The noncondensable vapor components 76 are treated in a gas treating unit 77 to remove water 78 and sulfur species 79. Heavier components are removed from the gas (e.g., propane and butanes) in a gas plant 350 to form liquid petroleum gas (LPG) 80. The LPG 80 may be further chilled and placed into a truck or line for sale.

Water 78 in addition to condensable hydrocarbons may be dropped out of the gas 76 when reducing temperature or increasing pressure. Liquid water may be separated from condensable hydrocarbons after gas treating 77 via gravity settling vessels or centrifugal separators. In the arrangement of FIG. 6, condensable fluids 78 are routed back to the oil separator 73.

At the oil separator 73, water 75 is separated from oil 74. Preferably, the oil separation 73 process includes the use of demulsifiers to aid in water separation. The water 78 may be directed to a separate water treatment facility for treatment and, optionally, storage for later re-injection.

The production fluids processing facility 60 also operates to generate electrical power 82 in a power plant 352. To this end, the remaining gas 83 is used to generate electrical power 82. The electrical power 82 may be used as an energy source for heating the subsurface formation 84 through any of the methods described herein. For example, the electrical power 82 may be fed at a high voltage, for example 132,000 V, to a transformer 86 and let down to a lower voltage, for example 6,600 V, before being fed to an electrical resistance heater element 89 located in a heater well 87 in the subsurface formation 84. In this way all or a portion of the power required to heat the subsurface formation 84 may be generated from the non-condensable portion 76 of the produced fluids 85. Excess gas, if available, may be exported for sale.

Some production procedures include in situ heating of an organic-rich rock formation that contains both formation hydrocarbons and formation water-soluble minerals prior to substantial removal of the formation water-soluble minerals from the organic-rich rock formation. In some embodiments of the invention there is no need to partially, substantially or completely remove the water-soluble minerals prior to in situ heating. For example, in an oil shale formation that contains naturally occurring nahcolite, the oil shale may be heated prior to substantial removal of the nahcolite by solution mining. Substantial removal of a water-soluble minerals may represent the degree of removal of a water-soluble mineral that occurs from any commercial solution mining operation as known in the art. Substantial removal of a water-soluble mineral may be approximated as removal of greater than 5 weight percent of the total amount of a particular water-soluble mineral present in the zone targeted for hydrocarbon fluid production in the organic-rich rock formation. In alternative embodiments, in situ heating of the organic-rich rock formation to pyrolyze formation hydrocarbons may be commenced prior to removal of greater than 3 weight percent, alternatively 7 weight percent, 10 weight percent or 13 weight percent of the formation water-soluble minerals from the organic-rich rock formation.

The impact of heating oil shale to produce oil and gas prior to producing nahcolite is to convert the nahcolite to a more recoverable form (soda ash), and provide permeability facilitating its subsequent recovery. Water-soluble mineral recovery may take place as soon as the retorted oil is produced, or it may be left for a period of years for later recovery. If desired, the soda ash can be readily converted back to nahcolite on the surface. The ease with which this conversion can be accomplished makes the two minerals effectively interchangeable.

In some production processes, heating the organic-rich rock formation includes generating soda ash by decomposition of nahcolite. The method may include processing an aqueous solution containing water-soluble minerals in a surface facility to remove a portion of the water-soluble minerals. The processing step may include removing the water-soluble minerals by precipitation caused by altering the temperature of the aqueous solution.

The water-soluble minerals may include sodium. The water-soluble minerals may also include nahcolite (sodium bicarbonate), soda ash (sodium carbonate), dawsonite ($NaAl(CO_3)(OH)_2$), or combinations thereof. The surface processing may further include converting the soda ash back to sodium bicarbonate (nahcolite) in the surface facility by reaction with $CO_2$. After partial or complete removal of the water-soluble minerals, the aqueous solution may be reinjected into a subsurface formation where it may be sequestered. The subsurface formation may be the same as or different from the original organic-rich rock formation.

In some production processes, heating of the organic-rich rock formation both pyrolyzes at least a portion of the formation hydrocarbons to create hydrocarbon fluids and makes available migratory contaminant species previously bound in the organic-rich rock formation. The migratory contaminant species may be formed through pyrolysis of the formation hydrocarbons, may be liberated from the formation itself upon heating, or may be made accessible through the creation of increased permeability upon heating of the formation. The migratory contaminant species may be soluble in water or other aqueous fluids present in or injected into the organic-rich rock formation.

In connection with the production of hydrocarbons from a rock matrix, particularly those of shallow depth, a concern may exist with respect to earth subsidence. This is particularly true in the in situ heating of organic-rich rock where a portion of the matrix itself is thermally converted and removed. Initially, the formation may contain formation hydrocarbons in solid form, such as, for example, kerogen. The formation may also initially contain water-soluble minerals. Initially, the formation may also be substantially impermeable to fluid flow.

The in situ heating of the matrix pyrolyzes at least a portion of the formation hydrocarbons to create hydrocarbon fluids. This, in turn, creates permeability within a matured (pyrolyzed) organic-rich rock zone in the organic-rich rock formation. The combination of pyrolyzation and increased permeability permits hydrocarbon fluids to be produced from the formation. At the same time, the loss of supporting matrix material also creates the potential for subsidence relative to the earth surface.

In some instances, subsidence is sought to be minimized in order to avoid environmental or hydrogeological impact. In this respect, changing the contour and relief of the earth surface, even by a few inches, can change runoff patterns, affect vegetation patterns, and impact watersheds. In addition, subsidence has the potential of damaging heater wells, monitoring wells, injection wells and production wells completed in a production area. Such subsidence can create damaging hoop and compressional stresses on wellbore casings, cement jobs, and downhole equipment.

In order to avoid or minimize subsidence, it is proposed to leave selected portions of the formation hydrocarbons substantially unpyrolyzed. This serves to preserve one or more unmatured, organic-rich rock zones. In some embodiments, the unmatured organic-rich rock zones may be shaped as substantially vertical pillars extending through a substantial portion of the thickness of the organic-rich rock formation.

The heating rate and distribution of heat within the formation may be designed and implemented to leave sufficient unmatured pillars to prevent subsidence. In one aspect, heat injection wellbores are formed in a pattern such that untreated pillars of oil shale are left therebetween to support the overburden and minimize subsidence.

In some embodiments, compositions and properties of the hydrocarbon fluids produced by an in situ conversion process may vary depending on, for example, conditions within an organic-rich rock formation. Controlling heat and/or heating rates of a selected section in an organic-rich rock formation may increase or decrease production of selected produced fluids.

In one embodiment, operating conditions may be determined by measuring at least one property of the organic-rich rock formation. The measured properties may be input into a computer executable program. At least one property of the produced fluids selected to be produced from the formation may also be input into the computer executable program. The program may be operable to determine a set of operating conditions from at least the one or more measured properties. The program may also be configured to determine the set of operating conditions from at least one property of the selected produced fluids. In this manner, the determined set of operating conditions may be configured to increase production of selected produced fluids from the formation.

Certain heater well embodiments may include an operating system that is coupled to any of the heater wells such as by insulated conductors or other types of wiring. The operating system may be configured to interface with the heater well. The operating system may receive a signal (e.g., an electromagnetic signal) from a heater that is representative of a temperature distribution of the heater well. Additionally, the operating system may be further configured to control the heater well, either locally or remotely. For example, the operating system may alter a temperature of the heater well by altering a parameter of equipment coupled to the heater well. Therefore, the operating system may monitor, alter, and/or control the heating of at least a portion of the formation.

In some embodiments, a heater well may be turned down and/or off after an average temperature in a formation may have reached a selected temperature. Turning down and/or off the heater well may reduce input energy costs, substantially inhibit overheating of the formation, and allow heat to substantially transfer into colder regions of the formation.

Temperature (and average temperatures) within a heated organic-rich rock formation may vary, depending on, for example, proximity to a heater well, thermal conductivity and thermal diffusivity of the formation, type of reaction occurring, type of formation hydrocarbon, and the presence of water within the organic-rich rock formation. At points in the field where monitoring wells are established, temperature measurements may be taken directly in the wellbore. Further, at heater wells the temperature of the immediately surrounding formation is fairly well understood. However, it is desirable to interpolate temperatures to points in the formation intermediate temperature sensors and heater wells.

In accordance with one aspect of the production processes of the present inventions, a temperature distribution within the organic-rich rock formation may be computed using a numerical simulation model. The numerical simulation model may calculate a subsurface temperature distribution through interpolation of known data points and assumptions of formation conductivity. In addition, the numerical simulation model may be used to determine other properties of the formation under the assessed temperature distribution. For example, the various properties of the formation may include, but are not limited to, permeability of the formation.

The numerical simulation model may also include assessing various properties of a fluid formed within an organic-rich rock formation under the assessed temperature distribution. For example, the various properties of a formed fluid may include, but are not limited to, a cumulative volume of a fluid formed in the formation, fluid viscosity, fluid density, and a composition of the fluid formed in the formation. Such a simulation may be used to assess the performance of a commercial-scale operation or small-scale field experiment. For example, a performance of a commercial-scale development may be assessed based on, but not limited to, a total volume of product that may be produced from a research-scale operation.

After production fluids 71 have been produced from the formation 84 for a desired period of time, it may be desirable to inject water into the formation 84. This is done by passing the water through one or more pumps and then into water injection wells. One or more of the water injection wells may be converted heater wells or converted production wells.

In one aspect, an operator may calculate a pore volume of an oil shale formation after production is completed. The operator will then circulate an amount of water equal to one pore volume. This may be for the primary purpose of producing an aqueous solution of dissolved soda ash and other water-soluble sodium minerals. Other constituents may be leached out of the formation including oil and migratory contaminant species. In this way, operations may be conducted in an environmentally responsible manner by mitigating against possible contamination of aquifers within and adjacent to an oil shale formation.

The injected water is produced back to the surface through water production wells. The water production wells may be, for example, converted heater wells and/or converted production wells. As the water returns to the surface, it is directed to a water processing facility.

Figure 7:
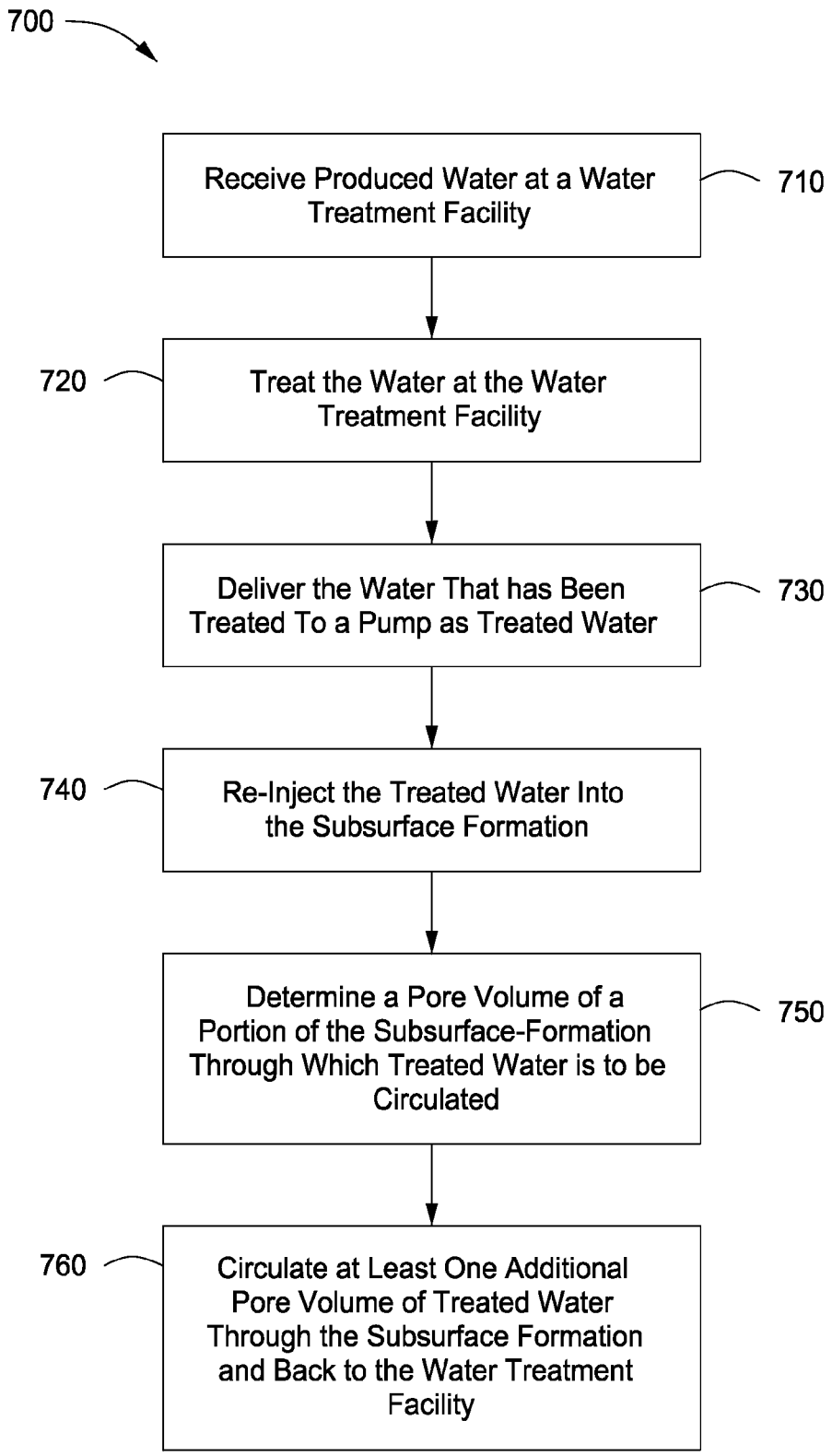
FIG. 7 is a flow chart showing steps that may be performed in circulating water from a water treatment facility through a subsurface formation after pyrolysis of formation hydrocarbons.

A method 700 is disclosed herein for circulating water to a water treatment facility. FIG. 7 is a flow chart showing steps that may be performed in the method 700 for circulating and treating water. The method 700 includes receiving water at the water treatment facility. This step is shown at Box 710 of FIG. 7. The received water is water that has been produced from a subsurface formation that has undergone heating. The water may be water 75, 78 obtained from produced fluids 71 during production operations (shown in FIG. 6). The water may also be water that has been previously circulated through the subsurface formation and now contains any of trace hydrocarbons, sodium minerals, solids particles, and migratory contaminant species.

The method 700 also includes treating the water at the water treatment facility. This step is demonstrated at Box 720 of FIG. 7. This is a dedicated water treatment facility that is preferably separate from the production fluids processing facility 60. There are a number of purposes for treating the water.

First, it is desirable to separate oil that is emulsified or otherwise mixed in with the received water. The oil and water may be separated by using gravity settling vessels, centrifugal separators, or other separating vessels known in the art. Demulsifiers may be used as part of the separation process. Alternatively, or in addition, the oil and water may be separated by using one or more induced air flotation separators.

Second, it is desirable to remove organic materials from the water, particularly migratory contaminant species. In this respect, producing hydrocarbons from pyrolyzed oil shale will generally leave behind some migratory contaminant species which are at least partially water-soluble. The types of potential migratory contaminant species depend on the nature of the oil shale pyrolysis and the composition of the oil shale being converted. If the pyrolysis is performed in the absence of oxygen or air, the contaminant species may include aromatic hydrocarbons (e.g. benzene, toluene, ethylbenzene, xylenes, and tri-methylbenzene), polyaromatic hydrocarbons (e.g. anthracene, pyrene, naphthalene, chrysene), metal contaminants (e.g. As, Co, Pb, Mo, Ni, Al, K, Mg, and Zn), and other species such as sulfates, ammonia, chlorides, flourides and phenols. If oxygen or air is employed, contaminant species may also include ketones, alcohols, and cyanides. Further, the specific migratory contaminant species present may include any subset or combination of the above-described species. Other types of migratory contaminant species are listed above in connection with the Definitions section.

Organic materials may be removed from the water by using one or more biological oxidation reactors. Biological oxidation is a natural reaction whereby micro-organisms are used to capture the energy in an organic substance and use it for an oxidation process. In essence, the organic substance is food, and the oxidation process is digestion.

The micro-organisms are aerobic bacteria. The aerobic bacteria break down oxygen-containing compounds found in migratory contaminant species and release less harmful materials. The final by-products of bio-oxidation are $CO_2$, water and inert bio-solids. Using this technology, heavy metals and solids may be consolidated in the bio-solids.

For example, benzene may be oxidized to $CO_2$ and $H_2O$ in the following way:

$$C_6H_6+O_2 \rightarrow CO_2+H_2O$$

Biological oxidation reactors allow biological oxidation to take place without a large increase in temperature or energy usage. An example of a suitable biological oxidation reactor is an activated sludge process as used to treat domestic sewage and industrial waste water.

Third, it is desirable to reduce hardness and alkalinity of the water. Hardness generally refers to calcium and magnesium ions. Alkalinity generally refers to carbonate, bicarbonate and hydroxide species. Reduction of hardness and alkalinity may be accomplished by use of one or more hot lime softening vessels. Alkalinity may be further reduced by passing the water through one or more reverse osmosis filters.

Fourth, it is desirable to remove dissolved inorganic solids. These may include inorganic migratory contaminant species from the water such as heavy metal compounds. Heavy metal compounds may include, for example arsenic, chromium, mercury, selenium, lead, vanadium, nickel, zinc, or combinations thereof. Dissolved inorganic solids may alternatively, or in addition, include ionic species. Ionic species may include sulfates, chlorides, fluorides, lithium, potassium, aluminum, ammonia or other materials that alter the pH of water in the subsurface formation.

Some dissolved inorganic solids may be recovered as precipitates in the hot lime softening vessels, while others may be removed through reverse osmosis following hot lime softening. Dissolved inorganic solids may refer to various cations such as iron (Fe), arsenic (As), chromium (Cr), aluminum (Al), selenium (Se), chloride ($Cl^-$), potassium (K), sodium (Na), nitrate ($NO_3^-$), sulfate ($SO_4^2$), fluoride ($F^-$) and silica ($SiO_2$).

Removal of dissolved inorganic solids may be accomplished by the use of one or more reverse osmosis filters. A reverse osmosis filter essentially provides filtration of dissolved solids at the molecular level. Water pressure forces the water through a semi-permeable membrane, while retarding the passage of the dissolved solids.

Finally, it is desirable to remove suspended inorganic solids from the water. To some extent, removal of solids occurs in connection with the separation of oil from water when an air flotation system is employed. Removal of solids is further provided by passing the water through a solids filtration system such as one or more porous media filters.

The method 700 next includes delivering water that has been treated at the surface facility to a pumping station as treated water. This step is presented at Box 730 of FIG. 7. The treated water has been treated to substantially remove oil, inorganic precipitates, inorganic dissolved solids, and organic contaminant species.

Next, the treated water is re-injected into the subsurface formation. This step is shown at Box 740 of FIG. 7. The purpose for re-injecting the treated water is to circulate the water through the subsurface formation, to one or more water production wells, and back to the surface facility. In this way, yet additional migratory contaminant species and other materials are leached from the spent shale (or other pyrolyzed formation).

The method 700 may further include determining a pore volume of a portion of the subsurface formation through which the treated water is to be circulated. This step is presented at Box 750 of FIG. 7. This is for the purpose of leaching out any remaining water-soluble minerals and other non-aqueous species, including, for example, hydrocarbons and migratory contaminant species. It is understood that the step 750 of determining a pore volume may be performed prior to step 710.

The method 700 also includes circulating at least one additional pore volume of treated water through the subsurface formation and back up to the water treatment facility. This is shown in Box 760.

In order to more fully demonstrate the step 720 for treating water at the water treatment facility, schematic diagrams of an illustrative water treatment facility 800 are provided.

Figures 8A, 8B:
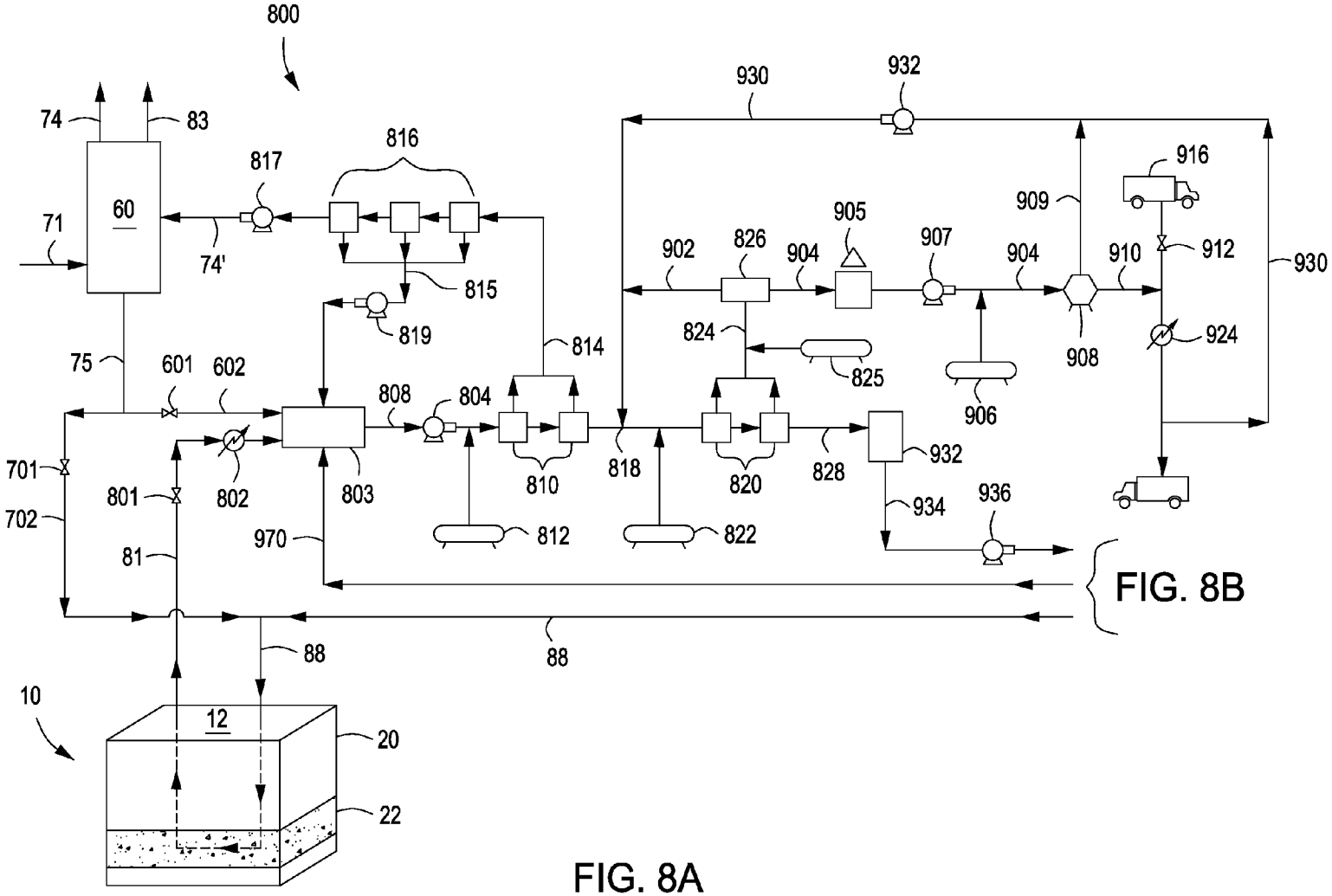
FIGS. 8A and 8B together present a schematic diagram of a water treatment facility of the present invention, in one embodiment.

FIGS. 8A and 8B together represent a schematic diagram showing the water treatment facility 800 of the present invention, in one embodiment. The water treatment facility 800 is designed to treat water that has been circulated through spent oil shale or some other post-pyrolysis organic-rich rock formation.

In FIG. 8A, a hydrocarbon development area is shown schematically at 10. This is the same number as used for the development area in FIG. 1. The development area 10 has a surface 12. It is understood that the water treatment facility 800 is located on the surface 12. Below the surface are subsurface strata 20. An organic-rich rock formation 22 is shown as part of the subsurface strata 20.

A water injection stream 88 is seen flowing into the development area 10. It is understood that the water injection stream 88 represents a flow of water that is being injected into the shale oil formation 22. This is accomplished through one or more water injection wells (such as wells 14 from FIG. 1).

In operation, water is circulated through the shale oil formation 22, then to one or more water production wells (such as production wells 16 of FIG. 1) via pressure created in situ by the water injection wells, and then up to the surface 12. In FIG. 8A, a water production stream 81 is shown. It is understood that the water production stream 81 represents a flow of aqueous fluids being produced by one or more water production wells.

The water production stream 81 is shown flowing into the water treatment facility 800. One or more valves (represented by valve 801) are placed along the fluid production stream 81 to regulate the flow of aqueous fluids comprising the water production stream 81 into the water treatment facility. A booster pump (not shown) is preferably placed in-line with the valve(s) 801 to provide pressure as water enters the water treatment facility 800.

In general, the water treatment facility 800 comprises an oil/water separator 810, a bio-oxidation system 820, one or more hot lime softener treatment vessels 830, one or more porous media filtration vessels 840, and, optionally, a reverse osmosis filter 850. In addition, the water treatment facility 800 contains a clean water storage facility 844, coupled with water delivery lines 88' and/or 88" leading to the water injection stream 88.

It is noted here that the water production stream 81 need not be the only source of water entering the water treatment facility 800. In some instances, the shale oil development area 10 may still be undergoing hydrocarbon production. In this instance, hydrocarbon production will continue to enter a production facility such as the production fluids processing facility 60 shown and described in connection with FIG. 6. In this instance, the produced water 75 separated in the facility 60 may also be delivered into the water treatment facility 800.

In FIG. 8A, the production facility 60 is shown schematically. A production stream is shown going into the production facility at line 71. Separated oil 74 and separated gas 83 are seen leaving the production fluids processing facility 60. In addition, separated water 75 is seen leaving the facility 60. Water 75 leaving the production fluids processing facility 60 may be directed immediately back into the oil shale formation 22. In this instance, a valve 601 leading into the water treatment facility 800 is closed, and a separate valve 701 leading to the water injection stream 88 is opened. Water line 702 is provided to direct produced water 75 back to the water injection stream 88. In this way, water 75 from the production fluids processing facility 60 is able to merge with the water injection stream 88 and be directed into the oil shale formation 22.

It is preferred that the produced water 75 from the facility 60 enters the water treatment facility 800 for treatment before injection into the oil shale formation 22. For this purpose, water line 602 is provided. In this instance, valve 701 is closed and valve 601 is opened. Preferably, water line 602 and accompanying valve 601 are separate from the water production stream 81 and accompanying valve 801.

Produced water 75 and water production stream 81 will likely be flowing at different pressures and temperatures. In one aspect, produced water 75 leaving the production fluids processing facility 60 enters the pressure equalization tank 803 at a rate of 400 gallons per minute, and at a temperature of 77° F. At the same time, the water production stream 81 entering the pressure equalization tank 803 may flow at a rate of 7,200 gallons per minute, and at a temperature of 68° F. Of course, it is understood that these rates and temperatures are merely illustrative. Therefore, upon entering the water treatment facility 800 the produced water 75 and the water production stream 81 preferably pass through a pressure equalization tank 803.

It is understood that the temperatures and pressures provided above are merely illustrative. The water treatment and formation leaching methods disclosed herein are not limited to any particular line pressures, fluid temperatures, vessel sizes, pump capacities, or other specific design values identified herein.

Returning to the discussion of water production stream 81, in one aspect the water production stream 81 may pass through a heat exchanger 802 before entering the pressure equalization tank 803. The heat exchanger 802 may operate, for example, through the use of steam at a pressure of 150 psig. This serves to warm the water and facilitate separation of oil and various impurities.

The pressure equalization tank 803 defines a large vessel for temporarily receiving and holding produced water from line 602 and the water production stream 81. In one aspect, the tank 803 has a circumference of 160 feet and a height of 43 feet. As will be described more fully below, the pressure equalization tank 803 may also receive dirty backwash water from line 970 as directed from the porous media filter 840.

Water received in the pressure equalization tank 803 from produced water 75, water production stream 81, and dirty backwash water 970 leaves the tank 803 through water line 808. As water leaves the tank 803 through water line 808, it preferably passes through a pressure booster 804. This provides pressure needed for water to travel through subsequent components in the water treatment facility 800. In one aspect, the pressure booster 804 comprises three separate booster pumps, each of which has a 250 horsepower rating and is capable of generating a fluid flow rate of about 4,500 gallons per minute. Water in water line 808 may then leave the booster pumps 804 at an amplified rate of, for example, 8,590 gallons per minute.

Before or after passing through booster pumps 804, the water in line 808 may optionally be treated with chemicals. Such chemicals may include demulsifiers. A chemical feed tank 812 is shown in FIG. 8A for delivering chemicals to water in line 808.

Water in the water line 808 is next directed through an oil/water separator 810. Induced air flotation separators operate by inducing air bubbles into a chemically treated water stream. The chemicals cause oil droplets to attach themselves to the air bubbles. The air bubbles then rise to the surface carrying oil droplets, and are skimmed off.

In the illustrative arrangement of FIG. 8A, the oil/water separator 810 comprises two or more induced air flotation separators. Each air flotation separator 810 may be, for example, 50 feet in length, 12 feet in width, and 15 feet in height. Each induced air floatation separator 810 may operate at an internal pressure of, for example, 5 to 10 psig.

Water leaving the oil/water separators 810 will have a substantial amount of oil and gas removed. The induced air floatation separators 810 will preferably accomplish a 90 percent removal of hydrocarbon materials, plus some solids. Water leaves the oil/water separators 810 through water line 818. In one aspect, the flow rate for water in water line 818 is 7,825 gallons per minute.

As the water moves through the water line 818, it may again be treated with chemicals. A separate chemical treatment vessel 822 is shown in FIG. 8A. This vessel 822 may provide, for example, control of pH of the water.

It is noted that a separate stream of fluid is delivered from the oil/water separators 810. That stream, of course is a hydrocarbon stream 814 representing separated oil and gas. The hydrocarbon stream 814 may be returned to the production fluids processing facility 60. There, the hydrocarbon stream 814 is further processed for the separation of oil, gas and water.

More preferably, the hydrocarbon stream 814 is first delivered to a subsequent oil/water separator 816. In the illustrative arrangement of FIG. 8A, the hydrocarbon stream 814 is directed to a plurality of CPI concentrators. Each concentrator may be, for example, 15 feet in length, 12 feet in width, and 15 feet in height. Each concentrator may process oil and gas at about 400 gallons per minute.

The CPI concentrators represent centrifugal processing separators. These may process fluid at a rate of, for example, 4,800 gallons per minute. As a result of processing through the CPI concentrators 816, a stream of clean water 815 is delivered at, for example, about 750 gallons per minute. The water may optionally travel through a pressure booster 819 and then be redelivered to the pressure equalization tank 803.

An oil stream 74' is also delivered from the CPI concentrators 816. The oil stream 74' is comprised primarily of condensable and non-condensable hydrocarbons. The oil stream 74' is returned to the production fluids processing facility 60 for further fluid processing as described generally in connection with FIG. 6. The oil stream 74' may be delivered at, for example, a fluid flow rate of 15 gallons per minute. This translates to about 500 barrels per day. The oil stream 74' may optionally be carried through a pressure booster 817.

Returning now to water line 818, water is carried from the induced air floatation separators 810 to vessels that comprise an integrated bio-oxidation system 820. Biological oxidation is a process by which naturally occurring bacteria are used in a controlled reactor to remove organic materials from water. The results of biological oxidation are carbon dioxide, water, and inert bio-solids.

In one aspect, the vessels in the bio-oxidation system 820 each process fluid at a rate of 4,215 gallons per minute. Each vessel may be, for example, 320 feet in circumference and 34 feet in height. The bio-oxidation system 820 may also include various components such as blowers and mixers (not shown).

As a result of processing through the bio-oxidation system 820, a cleaner stream of water is generated that exits through water line 828. The water in line 828 is substantially devoid of organic materials. The water in line 828 may travel at a fluid flow rate of approximately 7,819 gallons per minute. The water in fluid line 828 may be at a temperature of, for example, 87° F., and at a pH of 7.8.

As an additional byproduct of the bio-oxidation system 820, organic materials are released in a bio-solids line 824. Solids in the bio-solids line 824 represent a waste sludge. Waste sludge in the bio-solids line 824 may flow at a rate of 600 gallons per minute and comprise up to one percent solids. Treatment chemicals may be delivered to bio-solids line 824 through a vessel, such as vessel 825 shown in FIG. 8A. The chemicals may include polymers to facilitate thickening of the solids up to 5 percent.

The organic waste sludge in bio-solids line 824 is preferably thickened by introduction into rotary drum thickeners 826. In one aspect, four separate rotary drum thickeners 826 are employed, each being capable of carrying fluid at a rate of about 200 gallons per minute. Each thickener 826 may be, for example, 15 feet in length, 5 feet in width and 7 feet in height.

The rotary drum thickeners 826 are capable of releasing clean water. This is shown at water line 902. Clean water in water line 902 may travel at a fluid flow rate of, for example, 492 gallons per minute. This clean water may be reintroduced into fluid line 818 for re-processing through the vessels in the bio-oxidation system 820.

The rotary drum thickeners 826 also release thickened sludge through thickened sludge line 904. The thickened sludge may travel at a rate of about 108 gallons per minute and represent up to 5 percent solids. Sludge in thickened sludge line 904 may be stored temporarily in a sludge holdup tank 905. The sludge holdup tank 905 may be, for example, a large tank that is 50 feet in length, 5 feet in width and 9 feet in height.

The thickened sludge in thickened sludge line 904 may exit the sludge holdup tank 905 and pass through a booster pump 907. The booster pump 907 provides pressure to thickened sludge as it leaves the holdup tank 905. From there, the thickened sludge is directed into one or more filter presses 908. The filter presses 908 may represent small presses that are 3 meters by 2 meters. The filter presses serve to remove solids from the thickened sludge line 904 that has left the rotary drum thickeners 826 and squeeze out water.

En route to the filter presses 908, chemicals may be introduced into the thickened sludge line 904. An illustrative chemical vessel or chemical feed system 906 is shown in FIG. 8A. The sludge is treated for solids removal before entering the one or more filter presses 908. Polymers are added from the chemical feed system 906 as filter aids to facilitate filtration.

Dewatered contaminant solids will exit the filter presses 908 via a sludge line 910. The sludge line 910 will transport contaminant solids at a rate of, for example, about 36 gallons per minute. The contaminant solids are in the form of a "cake" comprised of about 15 to 20 percent solids. The contaminant solids in sludge line 910 will be moved into a vehicle 916 for offsite disposal. Valve 912 is provided to regulate the flow of contaminant solids in sludge line 910.

In addition, the filter presses 908 release "clean" water. Clean water is transported away from the filter presses 908 through water line 909. Water line 909 ultimately rejoins clean water line 902 and is redirected through the vessels and other equipment in the bio-oxidation system 820.

Upon leaving the filter presses 908, a portion of the contaminant solids from sludge line 910 may be subjected to a steam heating system. This is shown through heat exchanger 924. The result is that further removal of water through an evaporative process takes place. Evaporated water (referred to as condensate) is carried away through line 930. Condensate in line 930 joins clean water from lines 909 and 902. The clean water combined from lines 902, 909 and 930 may flow at a rate of, for example, 594 gallons per minute. Again, such combined water is redirected through the vessels in the bio-oxidation system 820 for reprocessing.

In one aspect, condensate in line 930 flows at a fluid flow rate of 30 gallons per minute. Booster pump 932 may be provided along line 930 to increase operating pressure. The pump 932 may comprise a pair of 40-horse power pumps that can pump up to 125 gallons per minute, for example.

Referring again to the bio-oxidation system 820, a clean water stream 828 is generated from the system 820. The clean water stream 828 is preferably carried through a sump pump 932. The sump pump 932 may comprise one or more vessels that is, for example, 24 feet in circumference and 14 feet in height. The sump pump 932 may be, for example, a Clearwell sump. The purpose of the sump pump is to temporarily hold the clean water from the bio-oxidation system 820 before sending the water downstream for further processing.

Water under treatment is carried away from the sump pump 932 via line 934. The water in line 934 is preferably carried through a pressure booster 936. The pressure booster may comprise, for example, three large, 200-horse power pumps each capable of pumping water at 4,500 gallons per minute. The water under treatment then moves further through the water treatment facility 800 as now demonstrated in FIG. 8B.

FIG. 8B shows water from line 934 traveling through additional parts of the water treatment facility 800. The water is next taken into a hot lime softening vessel 830. In one aspect, water travels through line 934 at a fluid flow rate of 7,819 gallons per minute. Water in line 934 may be at, for example, 87° F. and have a pH of 7.8.

The purpose of hot lime softening is to reduce hardness and alkalinity of the water. Hardness is reduced by causing precipitation of dissolved ions, principally calcium and magnesium as carbonates and hydroxides, respectively. To accomplish this, the hot lime softening vessel 830 receives steam from a steam vessel 832. Steam is introduced into the hot lime softening vessel 830. In addition, lime (or calcium hydroxide ($Ca(OH)_2$) is introduced into the vessel 830. Calcium hydroxide is maintained at a lime addition storage facility 834 in close proximity to the hot lime softening vessel 830.

A sludge byproduct is released from the hot lime softening vessel 830. The sludge represents inorganic precipitates such as calcium carbonate, magnesium hydroxide, and a variety of other metal precipitates. The sludge material is transported through sludge material line 942, and into a sludge sump 944. The sludge sump 944 may be capable of containing, for example, 10,000 gallons of fluidic material. The sludge sump 944 serves to hold sludge material as needed pending further processing and the disposal of the unwanted byproduct.

Sludge material is released from the sludge sump 944 at a rate of about 630 gallons per minute. In one aspect, the sludge material comprises a composition that is about five percent solids. The sludge material exiting the sludge sump 944 is transported through line 946. The sludge material is preferably carried through a pressure boosting pump 945. The boosting pump 945 preferably represents a series of small, positive displacement pumps, each having 5-horse power engines. Each pump generates fluid at a rate of, for example, approximately 100 gallons per minute. Sludge material is then carried from the booster pumps 945 along line 946 at a rate of 630 gallons per minute. In one aspect the sludge material remains warm at 200° F., and has a pH of 10.0.

The sludge material in line 946 enters a filter press 948. The filter press 948 separates sludge from water. In one aspect, the filter press 948 is a belt filter press. Sludge material exits the filter press 948 through channel 950, where it is taken to a truck 952 for offsite disposal. In one arrangement, the truck 952 receives sludge material that is 30 percent solids at 107 gallons per minute. Approximately 1,250,000 pounds of filtered sludge may be taken offsite per day.

The belt filter press 948 also releases "clean" water through water line 956. The clean water is preferably transported into a holdup sump 958. The holdup sump 958 may represent a small uninsulated vessel that is, for example, 10 feet in circumference and 7 feet in height. The holdup sump 958 temporarily holds water released from the belt filter press 948, and then releases that water through line 960. Water in line 960 preferably passes through a booster pump 962. The booster pump 962 may comprise, for example, two 75-horsepower pumps each capable of pumping at 550 gallons per minute. From there, water may travel at a fluid flow rate of 523 gallons per minute where it merges with water in line 836. Water in line 836 undergoes further treatment before re-injection into the shale oil formation 22.

Returning to the hot lime softening vessel 830, softened water is also released from the vessel 830. The hot lime softening process reduces hardness, alkalinity and silica content in the water. The softened water exits the vessel 830 through water line 833. In one aspect, water travels through water line 833 at a rate of 8,180 gallons per minute. The softened water is transported to a holdup sump 835. The holdup sump 835 is much larger than holdup sump 958. Holdup sump 835 may be, for example, an insulated vessel having a circumference of 25 feet, and a height of 4 feet. Water is temporarily held in the holdup sum 835 until it exits via line 836. Preferably, the water travels through a booster pump 837 to increase operating pressure. From there, water in line 836 merges with water from line 960. The combined pressurized water lines 836, 960 then enter a next phase of water treatment—solids filtration.

A porous media filtration system 840 is provided for solids filtration. Preferably, the filtration system represents dual media filters. The solids filters 840 filter out suspended solids. The solid materials are inorganic and typically include rock or sediment swept during water circulation through the spent shale formation as well as precipitated solids from the hot lime softener. It is again noted that some solids filtration will necessarily take place in connection with the use of the induced air floatation separators 810. In any event, solid materials are washed away from the filtration system 840 in a dirty backwash water stream 970. Fluids in the dirty backwash water stream 970 are preferably returned to the pressure equalization tank 803 (from FIG. 8A) where the water is then recycled through the water treatment facility 800.

The dual media filters in the porous media filtration system 840 receive a clean backwash water stream 846. The clean backwash water stream 846 assists in washing away particles that become part of the dirty backwash water stream 970.

Clean water exits the porous media filtration system 840 by means of water line 841. The water line 841 preferably receives chemical treatment from chemical vessel 849. The chemical treatment vessel 849 may, for example, introduce sulfuric acid ($H_2SO_4$). The chemical treatment vessel 849 may, for example, hold 2,100 barrels of sulfuric acid. The sulfuric acid is introduced to water line 841 at a rate of about 4 gallons per minute.

The chemically treated water in water line 841 next preferably passes through a heat exchanger 842. The heat exchanger 842 may be, for example, a plate-and-frame heat exchanger. Cooling water is circulated through the heat exchanger 842 at, for example, a rate of about 4,400 gallons per minute. Up to three plate-and-frame heat exchangers may be employed.

Water leaves the heat exchanger 842 through line 843. The water in line 843 is then placed into a leachate clean water storage tank 844. The tank 844 defines a large vessel that may be, for example, 165 feet in circumference and 43 feet in height. Preferably, the leachate clean water storage tank 844 has an open top and is non-insulated.

The leachate clean water storage tank 844 holds treated water that is available to be circulated back into the oil shale formation 22 through water injection stream 88. A valve 845 controls the flow of the cleaned water residing in the clean water storage tank 844. When the valve 845 is opened, water travels through a line 88' and joins water injection stream 88. Preferably, one or more leachate clean water pumps 90 is provided to inject water into the shale oil formation 22. Water may travel through line 88' at a rate of, for example, 7,200 gallons per minute. This rate is maintained into water injection stream 88.

Some clean water may be taken from the clean water storage tank 844 and moved separately through a water line 846. Movement of water through water line 846 is controlled by a valve 847. Water moving through line 846 is preferably carried through a booster pump 848 where water is then taken to the dual media filters 840. The booster pump 848 may comprise, for example, two 40-horse power pumps capable of pumping 1,000 gallons of water per minute, each.

Some of the pumped water in pressurized line 846 is taken for use in the plate-and-frame heat exchanger 842. The remaining water may travel at a fluid flow rate of 240 gallons per minute towards the dual media filters of the porous media filtration system 840. The clean water from line 846 serves as the source for the clean backwash water in the porous media filtration system 840.

It is preferred that still additional treatment of water take place in the water treatment facility 800. To this end, water from the cleaned water storage tank 844 may be further carried through a cartridge filter 854. The cartridge filter 854 is designed to remove fine particulate mater. If the fine particulate matter is not removed, it may foul subsequent reverse osmosis filters.

En route to the cartridge filter 854, the water is preferably directed through a booster pump 852. The booster pump 852 may comprise, for example, three separate pumps, each of which operates at 75 horse power to pump at a rate of 670 gallons per minute. The pressurized water then travels through the cartridge filter 854 at a rate of 1,271 gallons per minute. The water may optionally undergo further pressurization by means of several large feed pumps (not shown).

The water next undergoes reverse osmosis filtration. A reverse osmosis filter is seen in FIG. 8B at 850. One or more reverse osmosis filters 850 are provided to filter out dissolved inorganic solids. As noted, these may include heavy metal compounds, and ionic species. Any non-dissolved solids in the water stream are generally filtered in the porous media filtration system 840. The reverse osmosis filter 850 is typically not suited for filtration of precipitated or suspended solids.

The reverse osmosis filter 850 produces a stream of highly purified water. The purified water, or permeate, is carried through line 88" where it joins water injection stream 88. Optionally, a portion of the purified water stream 88" from the reverse osmosis filter 850 may be stored in an underground reservoir or temporarily stored in a permeate tank 856.

Additional uses for highly purified water stream 88" (permeate) may also exist. The permeate may be used for steam generation or for processing water in the treatment facility 800. In the illustrative arrangement of FIG. 8B, a portion of the permeate from the reverse osmosis filter 850 may be taken through line 853 and then used in the steam generator 832. Preferably, a booster pump 859 is provided in line 853.

The water treatment facility 800 may be used in connection with the recovery of hydrocarbons from a subsurface formation.

Figure 9:
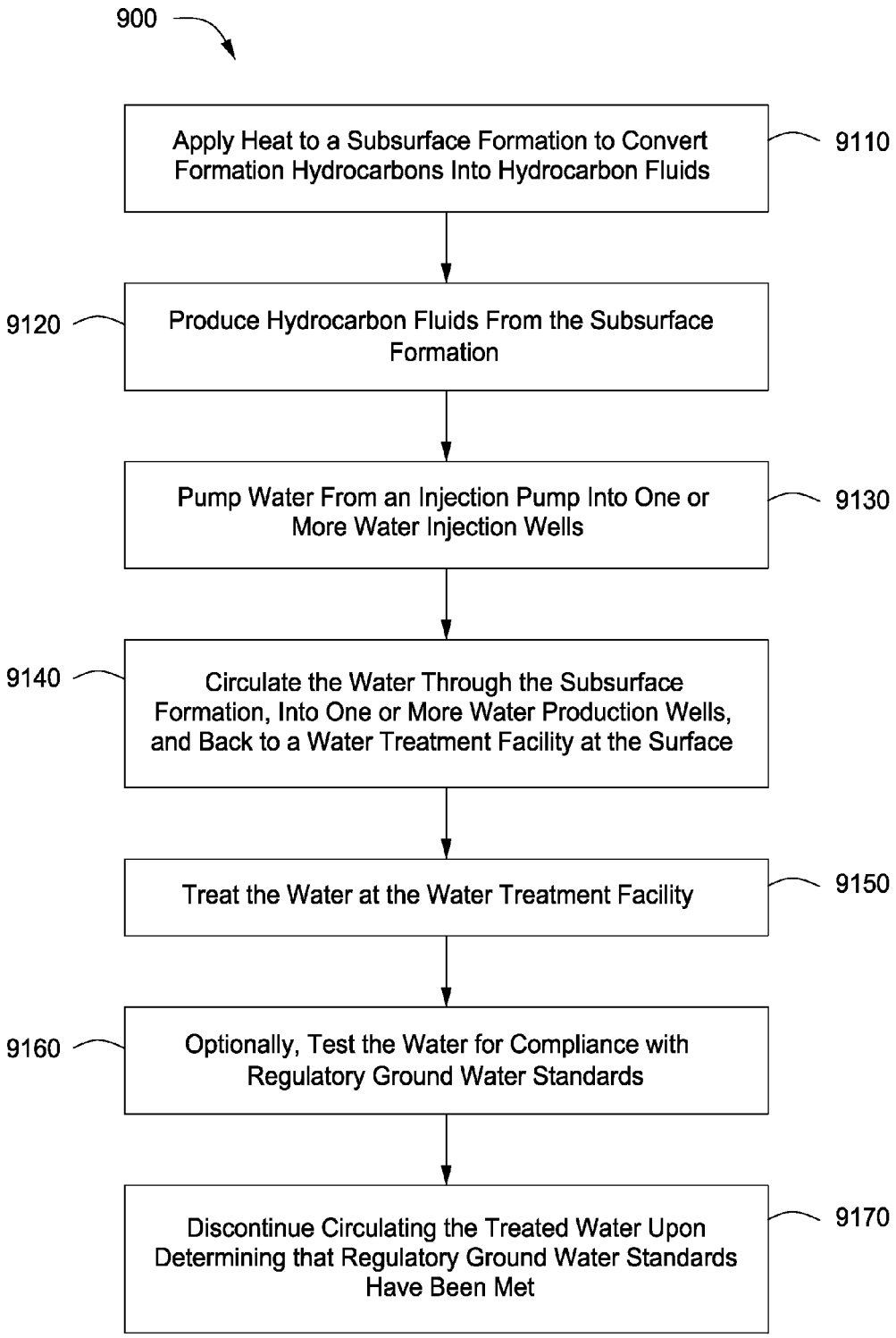
FIG. 9 is a flow chart showing steps that may be performed in recovering hydrocarbons from a subsurface formation in a development area, in one embodiment.

FIG. 9 is a flow chart showing steps of a method 900 that may be performed in recovering hydrocarbons from a subsurface formation in a development area, in one embodiment. The formation hydrocarbons may comprise solid hydrocarbons such as oil shale.

The method 900 includes applying heat to the subsurface formation. This step is presented in Box 9110 of FIG. 9. Heat is applied using in situ heat. The purpose of applying heat is to pyrolyze formation hydrocarbons into hydrocarbon fluids.

The heating step 9110 is not limited by the method employed for applying in situ heat to the subsurface formation. The heat may be applied, for example, by sending a current through a resistive heating element within a wellbore. Alternatively, heat may be applied by sending a current down a first wellbore, through a conductive medium within the subsurface formation, and back up a second wellbore. In one aspect, the conductive medium within the formation comprises a granular material having a significantly higher resistivity than conductive material in the first and second wellbores. In this way, the majority of resistive heat is generated from the conductive material within the formation. In another aspect, the conductive medium within the formation comprises a granular material having a significantly lower resistivity than conductive material in the first and second wellbores. In this way, the majority of resistive heat is generated from the conductive material within the wellbores. In either instance, the conductive material within the wellbores may be a rod, a pipe, a string of casing, or additional granular material.

The method 900 next includes producing the hydrocarbon fluids for a desired period of time. This step is shown in Box 9120. The hydrocarbon fluids are produced from a plurality of hydrocarbon production wells. The hydrocarbon production wells are completed in the subsurface formation.

The method 900 also includes circulating water from an injection pump into one or more water injection wells at a surface. This step is provided in Box 9130. Preferably, the subsurface formation is allowed to cool before the step 9130 of circulating the water into the water injection wells is commenced. In one aspect, the water injection wells define converted hydrocarbon production wells from step 9120. The water injection wells deliver the water from the surface and into the subsurface formation.

Next, the method 900 includes further circulating the water through the subsurface formation and into one or more water production wells. The water production wells may be converted hydrocarbon production wells from step 9120. The water is further circulated back to a water treatment facility at the surface. This step is shown in Box 9140. Together, steps 9130 and 9140 provide for a complete circulation of water from the surface, through the subsurface formation in a development area, and back to the surface. These steps 9130, 9140 may be carried out over a period of several months to a year. Inorganic solute levels are preferably reduced by 50% or more.

The method also includes treating the water upon arrival at the surface. This step is presented in Box 9150. The water is treated at the water treatment facility.

There are a number of purposes for treating the water. First, and as discussed above, it is desirable to separate oil emulsified within the water captured from the circulation step 9140. The oil and water may be separated at the water treatment facility by using traditional gravitational separators. Alternatively, or in addition, the oil and water may be separated by using one or more induced air flotation separators.

Second, it is desirable to remove organic materials from the water. As noted above, organic materials. Organic materials may be removed from the water by using one or more biological oxidation reactors. Preferably, the water passes through the one or more biological oxidation reactors after it passes through the one or more induced air flotation separators.

In one aspect, the water is further passed through an adsorbent media. Examples of such an adsorbent media include activated carbon, fuller's earth, or combinations thereof. Such an adsorbent media can help dampen any sudden increase in toxic loads to the subsequent biological oxidation reactors.

Third, it is desirable to reduce hardness and alkalinity of the water. As noted above, reducing hardness refers to the removal of calcium and magnesium ions. Calcium (Ca) is removed as $CaCO_3$, while magnesium (Mg) is removed as $Mg(OH)_2$. Reducing alkalinity refers to removing at least a portion of carbonate and bicarbonate species. The process of removing the calcium ions, magnesium ions, or other hardness ions also reduces the alkalinity and silica content of the water.

Reducing hardness and alkalinity may be accomplished by use of one or more hot lime softening vessels. Preferably, the water passes through the one or more hot lime softening vessels after it passes through the one or more biological oxidation reactors. Water containing dissolved precipitate-forming species such as Ca, $CO_3^{2-}$ (carbonate) or $SO_4^{2-}$ (sulfate) is passed through the hot lime vessels. The calcium in hot lime vessels interacts with the dissolved Ca, $CO_3^{2-}$, or $SO_4^{2-}$ and converts these solids to precipates, which are removed in the hot lime vessels.

Fourth, it is desirable to remove dissolved inorganic solids from the treated water. Dissolved inorganic solids refers to inorganic materials such as chlorides, fluorides, ammonia, sodium (Na) and potassium (K). Dissolved inorganic solids also refers to inorganic migratory contaminant species such as heavy metal compounds and ionic species. Removal of dissolved inorganic solids may be accomplished by the use of one or more reverse osmosis filters. Water pressure forces the water through a semi-permeable membrane, while retarding the passage of the dissolved solids. Preferably, the water passes through the one or more solids filters after it passes through the one or more hot lime softening vessels.

Finally, it is desirable to remove suspended solids. This is accomplished through the use of porous media filters. It is noted here that porous media filtration generally does not remove dissolved species; instead, solids filtration primarily removes suspended or undissolved solids, including sediment swept from the formation and undissolved precipitates.

The method 900 may further include determining a pore volume of a portion of the subsurface formation through which the treated water is to be circulated. In this instance, the step 9140 of circulating the water through the subsurface formation may comprise injecting a volume of treated water over time representing about 2 to 6 times the determined pore volume. It is believed that 2 to 6 pore volumes of injected water will typically be required to reduce leachate concentrations to background levels representative of any original aquifer composition.

It is also believed that as a result of circulating treated water, the remaining ground water will meet prevailing environmental standards for water quality. Those standards will vary depending on the state or governmental jurisdiction in which oil shale pyrolysis activities have taken place. Those standards may also vary depending on the anticipated use for the water.

To ensure compliance with groundwater regulations, the water may be tested after it has been treated in step 9150. Thus, the method 900 may also include testing the water for compliance with regulatory ground water standards. This step is shown in Box 9160. Testing preferably takes place periodically, such as after two, three, and four pore volumes of water have been circulated through the subsurface formation.

In one aspect, the method also includes discontinuing circulating the treated water. Circulation is discontinued upon determining that regulatory ground water standards for water in the subsurface formation have been met. This is shown at Box 9170. The regulatory ground water standards may be environmental standards from a regulatory body, such as the Water Quality Control Commission for the State of Colorado or another state agency.

Once it is determined from the sampling of water returns that the circulated water meets selected water quality standards, excess circulatory water may be released into a stream or body of surface water. Up to one pore volume of water may be left in the subsurface development area holding the spent shale. Optionally, a portion of the subsurface water may be pumped to the surface.

The above-described processes may be of merit in connection with the recovery of hydrocarbons in the Piceance Basin of Colorado. Some have estimated that in some oil shale deposits of the Western United States, up to 1 million barrels of oil may be recoverable per surface acre. One study has estimated the oil shale resource within the nahcolite-bearing portions of the oil shale formations of the Piceance Basin to be 400 billion barrels of shale oil in place. Overall, up to 1 trillion barrels of shale oil may exist in the Piceance Basin alone.

It is believed that the water treatment and circulation methods disclosed herein will reduce organic and inorganic contaminants to levels at or below Colorado groundwater standards for drinking water and agricultural use. The administrative agency responsible for developing water quality policies in Colorado is the Colorado Water Quality Control Commission. The Commission is part of the Colorado Department of Public Health and Environment. The Commission implements the broader policies set forth by the Colorado state legislature in the Colorado Water Quality Control Act by adopting water quality classifications and standards for surface and ground waters within the state.

The following Table 1 provides compositions of various organic and inorganic materials that may be found in a Colorado oil shale formation. Three columns of values are provided.

- The column entitled "Leachate" refers to the anticipated concentrations of compounds in a volume of water before significant formation flooding and water treatment begins. In other words, these are compounds anticipated to be present when a formation pyrolysis operation is concluded.
- The column entitled "Aquifer" refers to the anticipated concentrations of those compounds in a volume of water that would normally be found in an aquifer in the Piceance Basin. These are native water numbers, meaning no pyrolysis operations have been initiated.
- The column entitled "CO" Drinking Water Standard" refers to the maximum allotted concentrations of the listed compounds under Colorado regulations. In some instances (indicated as "n./a"), no statewide regulation is provided because the standard may be site-specific.

TABLE 1

| Compound | Units | Leachate | Aquifer | CO Drinking Water Standard |
|---|---|---|---|---|
| Ammonia | mg/l | 25 | 8.8 | n/a |
| K | mg/l | 100 | 12.6 | n/a |
| Na | mg/l | 2,000 | 1950 | n/a |
| $NO_3$—N | mg/l | 40 | 0.036 | 10 |
| $SO_4$ | mg/l | 2,000 | 68 | 250 |
| TDS | mg/l | 8,500 | 5900 | 500[1] |
| pH | s.u. | 9 | 8.3 | 6.5-8.5 |
| As | mg/l | 0.2 | 0.02 | 0.01 |
| B | mg/l | 5 | 3.1 | 0.75[2] |
| Cr (Total[3]) | mg/l | 2 | 0.0075 | 0.1 |
| Fe | mg/l | 1 | 0.38 | 0.3[4] |
| Li | mg/l | 4 | 0.94 | 2.5[2] |
| C (organic) | mg/l | 1,000 | 10 | n/a |
| Phenol | mg/l | 15 | <0.001 | 0.3 |
| Benzene | ppb | 50 | 0 | 5 |
| Oil | mg/l | <100 | 0 | 0 |
| Pyrene | ppb | <1,000 | 0 | 210 |
| Napthalene | ppb | <1,000 | 0 | 140 |
| Fluoranthene | ppb | <1,000 | 0 | 280 |

[1]The EPA secondary standard for Total Dissolved Solids, or "TDS," is 500 mg/L. The Colorado TDS Water Quality Standard is 1.25 times the background value, for background TDS values between 500 and 10,000 mg/L.
[2]This is an agricultural standard. There is no drinking water standard specified for Colorado or by the U.S. Environmental Protection Agency.
[3]This includes both trivalent and hexavalent forms of chromium.
[4]The agricultural standard for Fe is 5.0 mg/L. As expected, the drinking water standard is much lower.

The Applicant has not itself conducted field tests to determine whether the circulation of treated water will reduce the listed compounds to levels within the Colorado drinking water standards. However, technical literature reveals that field testing has been conducted by Amoco in an area that underwent "modified in situ" retort. Amoco's testing took place in the 1980's. According to the literature, two to four pore volumes of water were pumped through the retorted formation and then back to the surface. Pumping of the water produced reductions in both organic and inorganic solute levels in the returned leachate. Specific conductance, pH, ammonia levels and Total Dissolved Solids were observed to be reduced. In addition, Total Organic Carbon and BTEX (benzene, toluene, ethylbenzene, and xylene) were observed to be reduced. Evidence of microbial breakdown of organic compounds such as phenols and BTEX was further observed, while no progressive deterioration in water quality was detected.

In connection with Amoco's field testing, no significant organic or inorganic contaminants were observed to migrate beyond 100 feet from the retort. The only exception was benzene. However, the benzene levels within the leachate continued to decrease with further water circulation to a level below Colorado groundwater standards. At the end of circulation, no benzene was found in streams, wells or springs within a mile of the retort.

It is believed that the cycling of water through a spent shale formation will remove contaminants, whether the contaminants are part of the native aquifer or whether they are generated from the oil shale pyrolysis process. To bolster this belief, Applicant has conducted laboratory testing on spent shale plugs. The testing utilized intact spent shale plugs, which were immersed in de-ionized water for 24 hours and stirred. The water-rock ratio used was 20 to 1 by weight. The procedure was repeated up to five times, with a water analysis being done after each immersion.

From the laboratory tests, it was observed that most solute levels dropped significantly during the first and second leach. Total Organic Carbon, benzene, toluene, ethylbenzene, xylene, ammonia ($NH_3$), and sulfate ($SO_4$) all were reduced by more than 75%. Phenols, lithium and arsenic were reduced by more than 50%. Total Dissolved Solids were reduced and stabilized after the third leach. Poly-aromatic hydrocarbons were not detected at analysis detection limits.

In one exemplary embodiment, a method for recovering hydrocarbons from a subsurface formation in a development area includes applying heat to the subsurface formation using in situ heat in order to pyrolyze formation hydrocarbons into hydrocarbon fluids. The hydrocarbon fluids are produced from a plurality of hydrocarbon production wells for a desired period of time. Water is pumped from an injection pump at a surface at the development area and into one or more water injection wells. The water is circulated from the one or more water injection wells through the subsurface formation, into one or more water production wells, and up to a water treatment facility at the surface. The water is treated at the water treatment facility in order to (i) substantially separate oil from the water, (ii) substantially remove organic materials from the water, (iii) substantially reduce hardness and alkalinity of the water, (iv) substantially remove dissolved inorganic solids from the water, and (v) substantially remove suspended solids from the water, thereby providing treated water. The water may then be tested after the water has been treated. The water may then be iteratively circulated, treated, and/or tested, as many times as desired to treat the water to any threshold value desired by applicable local, state, and/or federal regulations.

In another general aspect, a method for treating water at a water treatment facility, the water having been circulated through a subsurface formation in a shale oil development area, and the subsurface formation comprising shale that has been spent due to pyrolysis of formation hydrocarbons, the method includes receiving the water at the water treatment facility. The water is treated at the water treatment facility in order to (i) substantially separate oil from the water, (ii) substantially remove organic materials from the water, (iii) substantially reduce hardness and alkalinity of the water, (iv) substantially remove dissolved inorganic solids from the water, and (v) substantially remove suspended solids from the water, thereby providing treated water. The treated water may be re-injected into the subsurface formation to leach out contaminants from the spent shale. The water may be tested following treatment. The water may also be iteratively circulated, treated, and/or tested, as many times as desired to treat the water to any threshold value desired by applicable local, state, and/or federal regulations.

Certain features of the present invention are described in terms of a set of numerical upper limits and a set of numerical lower limits. It should be appreciated that ranges formed by any combination of these limits are within the scope of the invention unless otherwise indicated. Although some of the dependent claims have single dependencies in accordance with U.S. practice, each of the features in any of such dependent claims can be combined with each of the features of one or more of the other dependent claims dependent upon the same independent claim or claims.

While it will be apparent that the invention herein described is well calculated to achieve the benefits and advantages set forth above, it will be appreciated that the invention is susceptible to modification, variation and change without departing from the spirit thereof.

What is claimed is:

1. A method for recovering hydrocarbons from a subsurface formation in a development area, comprising:

applying heat to the subsurface formation using in situ heat in order to pyrolyze formation hydrocarbons into hydrocarbon fluids;

producing the hydrocarbon fluids from one or more hydrocarbon production wells;

pumping water from an injection pump into one or more water injection wells;

circulating the water from the one or more water injection wells through the subsurface formation, into one or more water production wells, and up to a water treatment facility at the surface of the development area;

treating the water at the water treatment facility in order to (i) substantially separate hydrocarbons from the water, and wherein the water treatment facility is also configured to (ii) substantially remove organic materials from the water;

determining a pore volume of a portion of the subsurface formation through which the treated water is circulated; and circulating the treated water from an injection pump through the subsurface formation over time in a volume that represents about 2 to 6 times the determined pore volume.

2. The method of claim 1, wherein the water treatment facility is also configured to accomplish at least one of the group consisting of (iii) substantially reducing hardness and alkalinity of the water, (iv) substantially removing dissolved inorganic solids from the water, and (v) substantially removing suspended solids from the water, thereby providing treated water.

3. The method of claim 2, wherein treating the water at the water treatment facility to provide treated water comprises two or more of (i) substantially separating hydrocarbons from the water, (ii) substantially removing organic materials from the water, (iii) substantially reducing hardness and alkalinity of the water, (iv) substantially removing dissolved inorganic solids from the water, and (v) substantially removing suspended solids from the water.

4. The method of claim 2, wherein treating the water at the water treatment facility to provide treated water comprises (i) substantially separating hydrocarbons from the water, (ii) substantially removing organic materials from the water, (iii) substantially reducing hardness and alkalinity of the water, (iv) substantially removing dissolved inorganic solids from the water, and (v) substantially removing suspended solids from the water.

5. The method of claim 2, further comprising:

converting one or more of the plurality of hydrocarbon production wells into the one or more water production wells.

6. The method of claim 1, wherein the water treatment facility is configured to treat the water at the water treatment facility in order to (i) substantially separate hydrocarbons from the water, (ii) substantially remove organic materials from the water, (iii) substantially reduce hardness and alkalinity of the water, (iv) substantially remove dissolved inorganic solids from the water, and (v) substantially remove suspended solids from the water.

7. The method of claim 6, wherein treating the water at the water treatment facility comprises substantially removing organic materials from the water.

8. The method of claim 6, wherein treating the water at the water treatment facility comprises substantially reducing hardness and alkalinity of the water.

9. The method of claim 6, wherein treating the water at the water treatment facility comprises substantially removing dissolved inorganic solids from the water.

10. The method of claim 6, wherein treating the water at the water treatment facility comprises substantially removing suspended solids from the water.

11. The method of claim 6, wherein:

the water treatment facility comprises one or more induced air flotation separators; and treating the water in order to substantially separate hydrocarbons from the water comprises passing the water through the one or more induced air flotation separators.

12. The method of claim 11, wherein treating the water in order to substantially remove suspended solids from the water comprises in part passing the water through the one or more induced air flotation separators.

13. The method of claim 6, wherein:

the water treatment facility further comprises one or more porous media filters; and treating the water in order to substantially remove suspended solids from the water further comprises passing the water through the one or more porous media filters.

14. The method of claim 6, wherein:

the water treatment facility further comprises one or more gravity settling vessels, one or more centrifugal separators, or combinations thereof; and treating the water in order to substantially separate hydrocarbons from the water further comprises passing the water through the one or more gravity settling vessels, one or more centrifugal separators, or combinations thereof.

15. The method of claim 6, wherein:

the water treatment facility comprises one or more biological oxidation reactors; and treating the water in order to substantially remove organic materials from the water comprises passing the water through the one or more biological oxidation reactors.

16. The method of claim 15, wherein:

the water treatment facility comprises one or more induced air flotation separators;

treating the water in order to substantially separate hydrocarbons from the water comprises passing the water through the one or more induced air flotation separators;

the water passes through the one or more biological oxidation reactors after it passes through the one or more induced air flotation separators.

17. The method of claim 16, wherein:

the water treatment facility comprises one or more hot lime softening vessels and one or more reverse osmosis filters;

treating the water in order to substantially reduce hardness and alkalinity of the water comprises passing the water through the one or more hot lime softening vessels and the one or more reverse osmosis filters; and the water passes through the one or more hot lime softening vessels and the one or more reverse osmosis filters after it passes through the one or more biological oxidation reactors.

18. The method of claim 6, wherein:

the water treatment facility comprises one or more hot lime softening vessels; and treating the water in order to substantially reduce hardness and alkalinity of the water comprises passing the water through the one or more hot lime softening vessels.

19. The method of claim 18, wherein reducing hardness comprises substantially removing calcium and magnesium ions.

20. The method of claim 18, wherein reducing alkalinity comprises substantially removing carbonate and bicarbonate species.

21. The method of claim 20, wherein:

the water treatment facility further comprises one or more reverse osmosis filters; and treating the water in order to substantially reduce alkalinity further comprises passing the water through the one or more reverse osmosis filters after passing the water through the one or more hot lime softening vessels.

22. The method of claim 21, wherein:

the water passes through the one or more porous media filters after it passes through the one or more induced air flotation separators.

23. The method of claim 6, wherein:

the water treatment facility comprises one or more reverse osmosis filters;

treating the water in order to substantially remove dissolved inorganic solids from the water comprises passing the water through the one or more reverse osmosis filters.

24. The method of claim 6, further comprising:

allowing the subsurface formation to cool after producing the hydrocarbon fluids for a predetermined period of time and before circulating the water into the water injection wells.

25. The method of claim 1, further comprising testing the water after the water has been treated.

26. The method of claim 1, wherein the formation hydrocarbons comprise solid hydrocarbons.

27. The method of claim 1, wherein the subsurface formation is heated using electrical resistance heating.

28. The method of claim 1, wherein testing the water after the water has been treated comprises testing the water after at least two pore volumes of water have been circulated through the subsurface formation for compliance with regulatory ground water standards.

29. The method of claim 28, further comprising:

discontinuing circulating the treated water upon determining that regulatory ground water standards for water in the subsurface formation have been met.

* * * * *